US009662545B2

(12) United States Patent
Beach et al.

(10) Patent No.: US 9,662,545 B2
(45) Date of Patent: May 30, 2017

(54) GOLF CLUB WITH COEFFICIENT OF RESTITUTION FEATURE

(71) Applicant: Taylor Made Golf Company, Inc., Carlsbad, CA (US)

(72) Inventors: Todd P. Beach, Encinitas, CA (US); Matthew Greensmith, Vista, CA (US); Matthew David Johnson, Carlsbad, CA (US); Jason Andrew Mata, Carlsbad, CA (US); Kraig Alan Willett, Fallbrook, CA (US); Nathan T. Sargent, Oceanside, CA (US)

(73) Assignee: TAYLOR MADE GOLF COMPANY, INC., Carlton, CA (US)

( * ) Notice: Subject to any disclaimer, the term of this patent is extended or adjusted under 35 U.S.C. 154(b) by 113 days.

(21) Appl. No.: 13/839,727

(22) Filed: Mar. 15, 2013

(65) Prior Publication Data

US 2014/0274457 A1 Sep. 18, 2014

(51) Int. Cl.
*A63B 53/04* (2015.01)
*A63B 53/02* (2015.01)

(52) U.S. Cl.
CPC ..... *A63B 53/0466* (2013.01); *A63B 53/02* (2013.01); *A63B 53/04* (2013.01); *A63B 2053/0408* (2013.01); *A63B 2053/0433* (2013.01); *A63B 2053/0491* (2013.01)

(58) Field of Classification Search
CPC ..... A63B 53/0466; A63B 53/02; A63B 53/04; A63B 2053/0491; A63B 2053/0433; A63B 2053/0408
USPC ..... 473/338
See application file for complete search history.

(56) References Cited

U.S. PATENT DOCUMENTS

| | | | | |
|---|---|---|---|---|
| 4,432,549 A | | 2/1984 | Zebelean | |
| 5,000,454 A | | 3/1991 | Soda | |
| 5,797,807 A | | 8/1998 | Moore | |
| RE35,931 E | * | 10/1998 | Schroder et al. | 473/305 |
| 5,851,160 A | | 12/1998 | Rugge et al. | |

(Continued)

FOREIGN PATENT DOCUMENTS

| | | |
|---|---|---|
| JP | H06190088 | 7/1994 |
| JP | H10263118 | 10/1998 |

(Continued)

OTHER PUBLICATIONS

"Cleveland HiBore Driver Review," http://thesandtrip.com, 7 pages, May 19, 2006.

(Continued)

*Primary Examiner* — Stephen Blau
(74) *Attorney, Agent, or Firm* — Klarquist Sparkman, LLP

(57) ABSTRACT

A golf club head includes a face; a body, the body defining an interior and an exterior; the face and the body together defining a center of gravity, the center of gravity being proximate the face; a coefficient of restitution feature defined in the body; wherein the coefficient of restitution feature defines a gap in the body. A golf club head includes a face and a golf club body; the face and the golf club body defining a center of gravity, the center of gravity defined a distance, $\Delta_z$, from a ground plane as measured along a z-axis, the center of gravity defined a distance, $CG_y$, from the center face along the y-axis.

11 Claims, 33 Drawing Sheets

(56) References Cited

U.S. PATENT DOCUMENTS

| | | | | |
|---|---|---|---|---|
| 5,935,020 | A * | 8/1999 | Stites et al. | 473/345 |
| 6,086,485 | A * | 7/2000 | Hamada | A63B 53/04 473/329 |
| 6,139,445 | A | 10/2000 | Werner et al. | |
| 6,340,337 | B2 * | 1/2002 | Hasebe | 473/345 |
| 6,344,002 | B1 * | 2/2002 | Kajita | 473/330 |
| 6,572,491 | B2 * | 6/2003 | Hasebe | A63B 53/04 473/345 |
| 6,776,723 | B2 | 8/2004 | Bliss et al. | |
| 6,939,247 | B1 * | 9/2005 | Schweigert et al. | 473/314 |
| 7,025,695 | B2 * | 4/2006 | Mitsuba | 473/349 |
| 7,166,038 | B2 | 1/2007 | Williams et al. | |
| 7,674,187 | B2 | 3/2010 | Cackett et al. | |
| 7,674,189 | B2 | 3/2010 | Beach et al. | |
| 7,731,603 | B2 | 6/2010 | Beach et al. | |
| 7,771,291 | B1 | 8/2010 | Willett et al. | |
| 7,927,229 | B2 | 4/2011 | Jertson et al. | |
| 8,012,038 | B1 | 9/2011 | Beach et al. | |
| 8,012,039 | B2 | 9/2011 | Greaney et al. | |
| 8,133,135 | B2 * | 3/2012 | Stites et al. | 473/342 |
| 8,187,115 | B2 * | 5/2012 | Bennett et al. | 473/290 |
| 8,496,544 | B2 * | 7/2013 | Curtis et al. | 473/345 |
| 8,523,705 | B2 * | 9/2013 | Breier et al. | 473/334 |
| 8,529,368 | B2 * | 9/2013 | Rice | A63B 53/04 473/329 |
| 8,647,217 | B2 * | 2/2014 | Nishio | A63B 53/04 473/342 |
| 8,663,029 | B2 | 3/2014 | Beach et al. | |
| 8,827,831 | B2 * | 9/2014 | Burnett | A63B 53/04 473/329 |
| 9,220,953 | B2 * | 12/2015 | Beach | A63B 53/04 |
| 9,320,948 | B2 * | 4/2016 | Fossum | A63B 53/0466 |
| 2002/0183134 | A1 | 12/2002 | Allen et al. | |
| 2003/0114239 | A1 * | 6/2003 | Mase | 473/290 |
| 2004/0157678 | A1 | 8/2004 | Kohno | |
| 2004/0162156 | A1 | 8/2004 | Kohno | |
| 2005/0059508 | A1 | 3/2005 | Burnett et al. | |
| 2006/0116218 | A1 | 6/2006 | Burnett et al. | |
| 2008/0146374 | A1 | 6/2008 | Beach et al. | |
| 2009/0124411 | A1 * | 5/2009 | Rae et al. | 473/345 |
| 2009/0137338 | A1 | 5/2009 | Kajita | |
| 2009/0149275 | A1 | 6/2009 | Rae et al. | |
| 2009/0170632 | A1 | 7/2009 | Beach et al. | |
| 2009/0191980 | A1 | 7/2009 | Greaney et al. | |
| 2011/0014992 | A1 * | 1/2011 | Morrissey | 473/314 |
| 2013/0102408 | A1 * | 4/2013 | Shear | A63B 53/0466 473/329 |
| 2014/0256464 | A1 * | 9/2014 | Chao | A63B 53/0466 473/335 |
| 2016/0101328 | A1 * | 4/2016 | Luttrell | A63B 53/06 473/342 |

FOREIGN PATENT DOCUMENTS

| | | | | |
|---|---|---|---|---|
| JP | H11114102 | | 4/1999 | |
| JP | H11155982 | | 6/1999 | |
| JP | 2002-052099 | | 2/2002 | |
| JP | 2002136625 | | 5/2002 | |
| JP | 2003135632 | A * | 5/2003 | A63B 53/04 |
| JP | 2003135632 | A * | 5/2003 | |
| JP | 2003210621 | | 7/2003 | |
| JP | 2003524487 | | 8/2003 | |
| JP | 2003320061 | A * | 11/2003 | A63B 53/04 |
| JP | 2004174224 | | 6/2004 | |
| JP | 2004232397 | | 8/2004 | |
| JP | 2004-261451 | * | 9/2004 | |
| JP | 2004261451 | * | 9/2004 | |
| JP | 2004265992 | | 9/2004 | |
| JP | 2004271516 | | 9/2004 | |
| JP | 2004313762 | | 11/2004 | |
| JP | 2004-351173 | | 12/2004 | |
| JP | 2004351054 | | 12/2004 | |
| JP | 2005073736 | | 3/2005 | |
| JP | 2005111172 | | 4/2005 | |
| JP | 2005137494 | | 6/2005 | |
| JP | 2005137788 | | 6/2005 | |
| WO | WO 2005/009543 | A2 | 2/2005 | |

OTHER PUBLICATIONS

"Invalidity Search Report for Japanese Registered Patent No. 4128970," 4 pp. (Nov. 29, 2013).

* cited by examiner

GOLF CLUB WITH COEFFICIENT OF RESTITUTION FEATURE

CROSS-REFERENCE TO RELATED APPLICATIONS

This application references U.S. patent application Ser. No. 13/686,677 which is a continuation-in-part of U.S. patent application Ser. No. 13/340,039, filed Dec. 29, 2011, which is a continuation-in-part of U.S. patent application Ser. No. 13/166,668, filed Jun. 22, 2011, which is a continuation-in-part of U.S. patent application Ser. No. 12/646,769, filed Dec. 23, 2009, all of which applications are incorporated by reference herein in their entirety.

Application Ser. No. 13/686,677 is also a continuation-in-part of U.S. patent application Ser. No. 13/305,533, filed Nov. 28, 2011, which is a continuation of U.S. patent application Ser. No. 12/687,003, filed Jan. 13, 2010, now U.S. Pat. No. 8,303,431, which claims the benefit of U.S. Provisional Patent Application No. 61/290,822, filed Dec. 29, 2009, all of which applications are incorporated herein by reference in their entirety. U.S. patent application Ser. No. 12/687,003 is also a continuation-in-part of U.S. patent application Ser. No. 12/474,973, filed May 29, 2009, which is a continuation in-part of U.S. patent application Ser. No. 12/346,747, filed Dec. 30, 2008, now U.S. Pat. No. 7,887,431, which claims the benefit of U.S. Provisional Patent Application No. 61/054,085, filed May 16, 2008, all of which applications are incorporated by reference herein in their entirety.

Additionally, this application references U.S. patent application Ser. No. 13/528,632, which is a continuation of U.S. patent application Ser. No. 13/224,222, filed Sep. 1, 2011, which is a continuation of U.S. patent application Ser. No. 12/346,752, filed Dec. 30, 2008, now U.S. Pat. No. 8,025,587, which claims the benefit of U.S. Provisional Application No. 61/054,085, filed May 16, 2008. Application Ser. Nos. 13/224,222, 12/346,752 and 61/054,085 are incorporated herein by reference in their entirety.

Additionally, this application references U.S. patent application Ser. No. 12/813,442, which is a continuation-in-part of U.S. patent application Ser. No. 12/006,060, filed Dec. 28, 2007, which is a continuation-in-part of U.S. patent application Ser. No. 11/863,198, filed Sep. 27, 2007, both of which are incorporated herein by reference in their entirety.

Additionally, this application references U.S. patent application Ser. No. 12/791,025, filed Jun. 1, 2010, and U.S. patent application Ser. No. 13/338,197, filed Dec. 27, 2011, which are incorporated by reference herein in their entirety.

Further, this application references U.S. patent application Ser. No. 10/290,817, filed Nov. 8, 2002, now U.S. Pat. No. 6,773,360, which is incorporated herein by reference in its entirety. Additionally, this application references U.S. patent application Ser. No. 11/647,797, filed Dec. 28, 2006, now U.S. Pat. No. 7,452,285, which is a continuation of U.S. patent application Ser. No. 10/785,692, filed Feb. 23, 2004, now U.S. Pat. No. 7,166,040, which is a continuation-in-part of U.S. patent application Ser. No. 10/290,817, cited previously, all of which are incorporated by reference herein in their entirety. This application also reference U.S. patent application Ser. No. 11/524,031, filed Sep. 19, 2006, which is a continuation-in-part of application Ser. No. 10/785,692, cited previously, both of which are incorporated herein by reference in their entirety.

Other patents and patent applications concerning golf clubs, such as U.S. Pat. Nos. 7,407,447, 7,419,441, 7,513,296, and 7,753,806; U.S. Pat. Appl. Pub. Nos. 2004/0235584, 2005/0239575, 2010/0197424, and 2011/0312347; U.S. patent application Ser. Nos. 11/642,310, and 11/648,013; and U.S. Provisional Pat. Appl. Ser. No. 60/877,336 are incorporated herein by reference in their entireties.

TECHNICAL FIELD

The current disclosure relates to golf club heads. More specifically, the current disclosure relates to golf club heads with features for improving playability, including at least one of relocation of center of gravity and coefficient of restitution features.

BACKGROUND

In the golf industry, club design often takes into consideration many design factors, including weight, weight distribution, spin rate, coefficient of restitution, characteristic time, volume, face area, sound, materials, construction techniques, durability, and many other considerations. Historically, club designers have been faced with performance trade-offs between design features that enhance one aspect of club performance while reducing at least one other aspect of club performance. For example, lighter weight can often lead to faster club speed, which often leads to greater distance; however, clubs that are too light weight can become uncontrollable by the user. In another example, thinner club faces often lead to distance gains, but thinning faces reduces durability in manufacture. Yet another example, high-tech materials may be used in various club designs to achieve performance results, but the gains may not justify the added costs of material acquisition and processing. The challenges of engineering modern golf clubs center largely around maximizing performance benefits while minimizing design trade-offs.

SUMMARY

A golf club head includes a face; a body, the body defining an interior and an exterior; the face and the body together defining a center of gravity, the center of gravity being proximate the face; a coefficient of restitution feature defined in the body; wherein the coefficient of restitution feature defines a gap in the body. A golf club head includes a face and a golf club body; the face and the golf club body defining a center of gravity, the center of gravity defined a distance, $\Delta_z$, from a ground plane as measured along a z-axis, the center of gravity defined a distance, $CG_y$, from the center face along the y-axis.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1B:
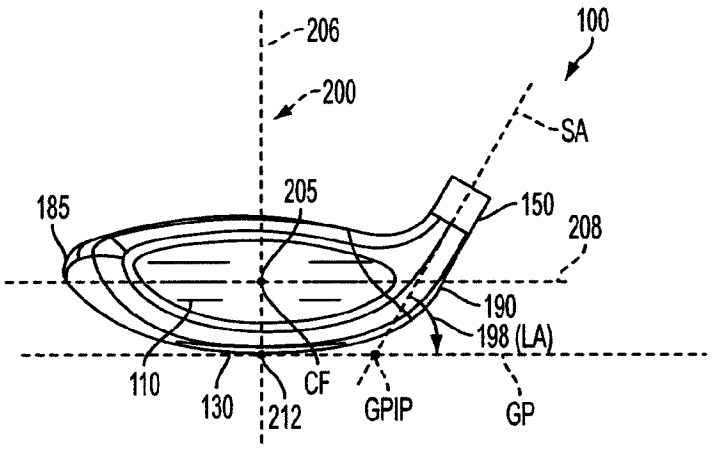
FIG. 1B is a face side view of the golf club head of FIG. 1A.

Disclosed is a golf club including a golf club head and associated methods, systems, devices, and various apparatus. It would be understood by one of skill in the art that the disclosed golf club is described in but a few exemplary embodiments among many. No particular terminology or description should be considered limiting on the disclosure or the scope of any claims issuing therefrom. For the sake of simplicity, standard unit abbreviations may be used, including but not limited to, "mm" for millimeters, "in." for inches, "lb." for pounds force, "mph" for miles per hour, and "rps" for revolutions per second, among others.

In the game of golf, when a player increases his or her distance with a given club, the result nearly always provides an advantage to the player. While golf club design aims to maximize the ability of a player to hit a golf ball as far as possible, the United States Golf Association—a rulemaking body in the game of golf—has provided a set rules to govern the game of golf. These rules are known as The Rules of Golf and are accompanied by various Decisions on The Rules of Golf. Many rules promulgated in The Rules of Golf affect play. Some of The Rules of Golf affect equipment, including rules designed to indicate when a club is or is not legal for play. Among the various rules are maximum and minimum limits for golf club head size, weight, dimensions, and various other features. For example, no golf club head may be larger than 460 cubic centimeters in volume. No golf club face may have a coefficient of restitution (COR) of greater than 0.830, wherein COR describes the efficiency of the golf club head's impact with a golf ball.

COR is a measure of collision efficiency. COR is the ratio of the velocity of separation to the velocity of approach. In this model, therefore, COR is determined using the following formula:

$$COR=(v_{club\text{-}post}-v_{ball\text{-}post})\div(v_{ball\text{-}pre}-v_{club\text{-}pre})$$

where, $vv_{club\text{-}post}$ represents the velocity of the club after impact;

$v_{ball\text{-}post}$ represents the velocity of the ball after impact;

$v_{club\text{-}pre}$ represents the velocity of the club before impact (a value of zero for USGA COR conditions); and $v_{ball\text{-}pre}$ represents the velocity of the ball before impact.

Although the USGA specifies the limit for maximum COR, there is no specified region in which COR may be maximized. While multiple golf club heads have achieved the maximum 0.830 COR, the region in which such COR may be found has generally been limited—typically, in a region at a geometric center of the face of the golf club head or in a region of maximum COR that is in relatively small proximity thereto. Many golf club heads are designed to launch a golf ball as far as possible within The Rules of Golf when properly struck. However, even the greatest of professional golfers do not strike each and every shot perfectly. For the vast majority of golfers, perfectly struck golf shots are an exception if not a rarity.

There are several methods to address a particular golfer's inability to strike the shot purely. One method involves the use of increased Moment of Inertia (MOI). Increasing MOI prevents the loss of energy for strikes that do not impact the center of the face by reducing the ability of the golf club head to twist on off-center strikes. Particularly, most higher MOI designs focus on moving weight to the perimeter of the golf club head, which often includes moving a center of gravity of the golf club head back in the golf club head, toward a trailing edge.

Another method involves use of variable face thickness (VFT) technology. With VFT, the face of the golf club head is not a constant thickness across its entirety, but rather varies. For example, as described in U.S. patent application Ser. No. 12/813,442—which is incorporated herein by reference in its entirety—the thickness of the face varies in an arrangement with a dimension as measured from the center of the face. This allows the area of maximum COR to be increased as described in the reference.

While VFT is excellent technology, it can be difficult to implement in certain golf club designs. For example, in the design of fairway woods, the height of the face is often too small to implement a meaningful VFT design. Moreover, there are problems that VFT cannot solve. For example, because the edges of the typical golf club face are integrated (either through a welded construction or as a single piece), a strike that is close to an edge of the face necessarily results in poor COR. It is common for a golfer to strike the golf ball at a location on the golf club head other than the center of the face. Typical locations may be high on the face or low on the face for many golfers. Both situations result in reduced COR. However, particularly with low face strikes, COR decreases very quickly. In various embodiments, the COR for strikes 5 mm below center face may be 0.020 to 0.035 difference. Further off-center strikes may result in greater COR differences.

To combat the negative effects of off-center strikes, certain designs have been implemented. For example, as described in U.S. patent application Ser. No. 12/791,025 to Albertsen, et al., filed Jun. 1, 2010, and U.S. patent application Ser. No. 13/338,197 to Beach, et al., filed Dec. 27, 2011—both of which are incorporated by reference herein in their entirety—coefficient of restitution features located in various locations of the golf club head provide advantages. In particular, for strikes low on the face of the golf club head, the coefficient of restitution features allow greater flexibility than would typically otherwise be seen from a region low on the face of the golf club head. In general, the low point on the face of the golf club head is not ductile and, although not entirely rigid, does not experience the COR that may be seen in the geometric center of the face.

Although coefficient of restitution features allow for greater flexibility, they can often be cumbersome to implement. For example, in the designs above, the coefficient of restitution features are placed in the body of the golf club head but proximal to the face. While the close proximity enhances the effectiveness of the coefficient of restitution features, it creates challenges from a design perspective. Manufacturing the coefficient of restitution features may be difficult in some embodiments. Particularly with respect to U.S. patent application Ser. No. 13/338,197, the coefficient of restitution feature includes a sharp corner at the vertical extent of the coefficient of restitution feature that experiences extremely high stress under impact conditions. It may become difficult to manufacture such features without compromising their structural integrity in use. Further, the coefficient of restitution features necessarily extend into the golf club body, thereby occupying space within the golf club head. The size and location of the coefficient of restitution features may make mass relocation difficult in various designs, particularly when it is desirous to locate mass in the region of the coefficient of restitution feature.

In particular, one challenge with current coefficient of restitution feature designs is the ability to locate the center of gravity (CG) of the golf club head proximal to the face. It has been desirous to locate the CG low in the golf club head, particularly in fairway wood type golf clubs. In certain types of heads, it may still be the most desirable design to locate the CG of the golf club head as low as possible regardless of its location within the golf club head. However, for reasons explained herein, it has unexpectedly been determined that a low and forward CG location may provide some benefits not seen in prior designs or in comparable designs without a low and forward CG.

For reference, within this disclosure, reference to a "fairway wood type golf club head" means any wood type golf club head intended to be used with or without a tee. For reference, "driver type golf club head" means any wood type golf club head intended to be used primarily with a tee. In general, fairway wood type golf club heads have lofts of 13 degrees or greater, and, more usually, 15 degrees or greater. In general, driver type golf club heads have lofts of 12 degrees or less, and, more usually, of 10.5 degrees or less. In general, fairway wood type golf club heads have a length from leading edge to trailing edge of 73-97 mm. Various definitions distinguish a fairway wood type golf club head form a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Fairway wood type golf club heads of the current disclosure are 16 degrees of loft. In various embodiments, fairway wood type golf club heads of the current disclosure may be from 15-19.5 degrees. In various embodiments, fairway wood type golf club heads of the current disclosure may be from 13-17 degrees. In various embodiments, fairway wood type golf club heads of the current disclosure may be from 13-19.5 degrees. In various embodiments, fairway wood type golf club heads of the current disclosure may be from 13-26 degrees. Driver type golf club heads of the current disclosure may be 12 degrees or less in various embodiments or 10.5 degrees or less in various embodiments.

Figure 1D:
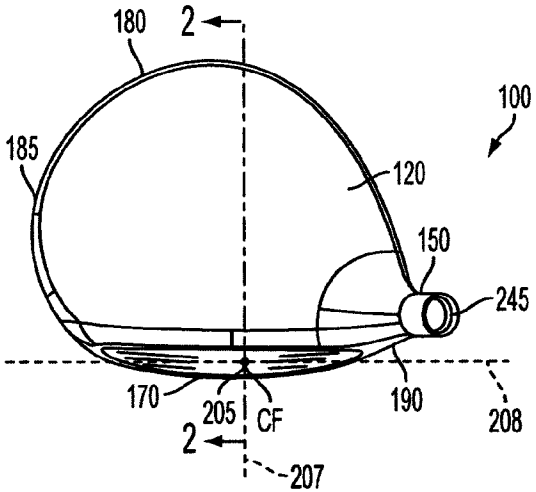
FIG. 1D is a top view of the golf club head of FIG. 1A.
Figure 1A:
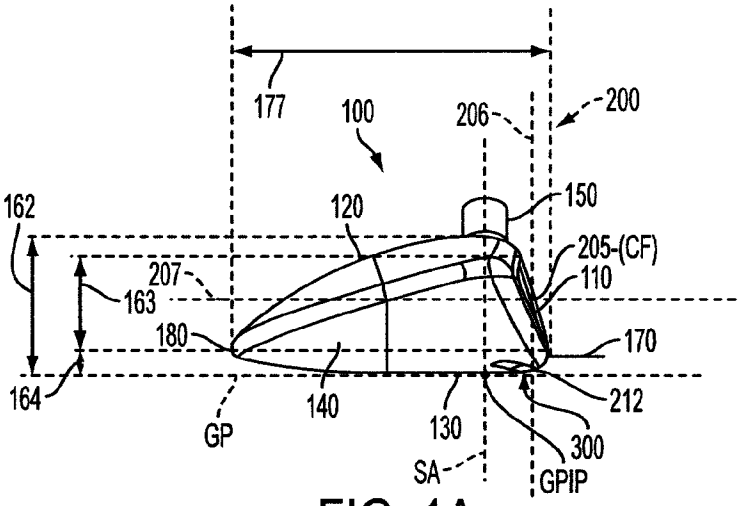
FIG. 1A is a toe side view of a golf club head in accord with one embodiment of the current disclosure.

One embodiment of a golf club head 100 is disclosed and described in with reference to FIGS. 1A-1D. As seen in FIG. 1A, the golf club head 100 includes a face 110, a crown 120, a sole 130, a skirt 140, and a hosel 150. Major portions of the golf club head 100 not including the face 110 are considered to be the golf club body for the purposes of this disclosure. A coefficient of restitution feature (CORF) 300 is seen in the sole 130 of the golf club head 100.

A three dimensional reference coordinate system 200 is shown. An origin 205 of the coordinate system 200 is located at the geometric center of the face (CF) of the golf club head 100. See U.S.G.A. "Procedure for Measuring the Flexibility of a Golf Clubhead," Revision 2.0, Mar. 25, 2005, for the methodology to measure the geometric center of the striking face of a golf club. The coordinate system 200 includes a z-axis 206, a y-axis 207, and an x-axis 208 (shown in FIG. 1B). Each axis 206,207,208 is orthogonal to each other axis 206,207,208. The golf club head 100 includes a leading edge 170 and a trailing edge 180. For the purposes of this disclosure, the leading edge 170 is defined by a curve, the curve being defined by a series of forwardmost points, each forwardmost point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

As seen with reference to FIG. 1B, the x-axis 208 is parallel to a ground plane (GP) onto which the golf club head 100 may be properly soled—arranged so that the sole 130 is in contact with the GP. The y-axis 207 is also parallel to the GP and is orthogonal to the x-axis 208. The z-axis 206 is orthogonal to the x-axis 208, the y-axis 207, and the GP. The golf club head 100 includes a toe 185 and a heel 190. The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 defined in the hosel 150. As such, the arrangement of the SA with respect to the golf club head 100 can define how the golf club head 100 is used. The SA is aligned at an angle 198 with respect to the GP. The angle 198 is known in the art as the lie angle (LA) of the golf club head 100. An ground plane intersection point (GPIP) of the SA and the GP is shown for reference. In various embodiments, the GPIP may be used a point of reference from which features of the golf club head 100 may be measured or referenced. As shown with reference to FIG. 1A, the SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP.

Figure 1C:
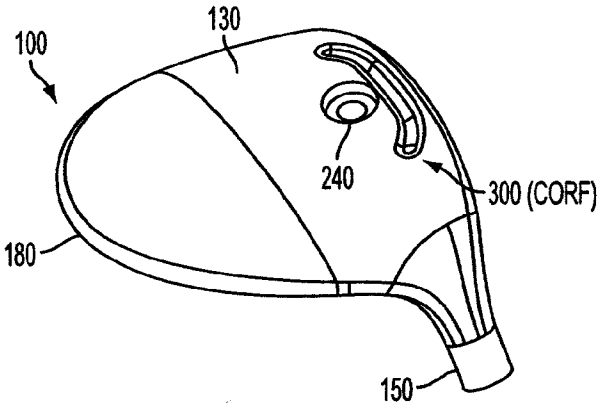
FIG. 1C is a perspective view of the golf club head of FIG. 1A.

As seen with reference to FIG. 1C, the coefficient of restitution feature 300 (CORF) is shown defined in the sole 130 of the golf club head 100. A modular weight port 240 is shown defined in the sole 130 for placement of removable weights. Various embodiments and systems of removable weights and their associated methods and apparatus are described in greater detail with reference to U.S. patent application Ser. Nos. 10/290,817, 11/647,797, 11/524,031, all of which are incorporated by reference herein in their entirety. The top view seen in FIG. 1D shows another view of the golf club head 100. The shaft bore 245 can be seen defined in the hosel 150. The cutting plane for FIG. 2 can also be seen in FIG. 1D. The cutting plane for FIG. 2 coincides with the y-axis 207.

Referring back to FIG. 1A, a crown height 162 is shown and measured as the height from the GP to the highest point of the crown 120 as measured parallel to the z-axis 206. In the current embodiment, the crown height 162 is about 36 mm. In various embodiments, the crown height 162 may be 34-40 mm. In various embodiments, the crown height may be 32-44 mm. In various embodiments, the crown height may be 30-50 mm. The golf club head 100 also has an effective face height 163 that is a height of the face 110 as measured parallel to the z-axis 206. The effective face height 163 measures from a highest point on the face 110 to a lowest point on the face 110 proximate the leading edge 170. A transition exists between the crown 120 and the face 110 such that the highest point on the face 110 may be slightly variant from one embodiment to another. In the current embodiment, the highest point on the face 110 and the lowest point on the face 110 are points at which the curvature of the face 110 deviates substantially from a roll radius. In some embodiments, the deviation characterizing such point may be a 10% change in the radius of curvature. In the current embodiment, the effective face height 163 is about 27.5 mm. In various embodiments, the effective face height 163 may be 2-7 mm less than the crown height 162. In various embodiments, the effective face height 163 may be 2-12 mm less than the crown height 162. An effective face position height 164 is a height from the GP to the lowest point on the face 110 as measured in the direction of the z-axis 206. In the current embodiment, the effective face position height 164 is about 4 mm. In various embodiments, the effective face position height 164 may be 2-6 mm. In various embodiments, the effect face position height 164 may be 0-10 mm. A length 177 of the golf club head 177 as measured in the direction of the y-axis 207 is seen as well with reference to FIG. 1A. In the current embodiment, the length 177 is about 85 mm. In various embodiments, the length 177 may be 80-90 mm. In various embodiments, the length 177 may be 73-97 mm. The distance 177 is a measurement of the length from the leading edge 170 to the trailing edge 180. The distance 177 may be dependent on the loft of the golf club head in various embodiments. In one embodiment, the loft of the golf club head is about 15 degrees and the distance 177 is about 91.6 mm. In one embodiment, the loft of the golf club head is about 18 degrees and the distance 177 is about 87.4 mm. In one embodiment, the loft of the golf club head is about 21 degrees and the distance 177 is about 86.8 mm.

Figure 2:
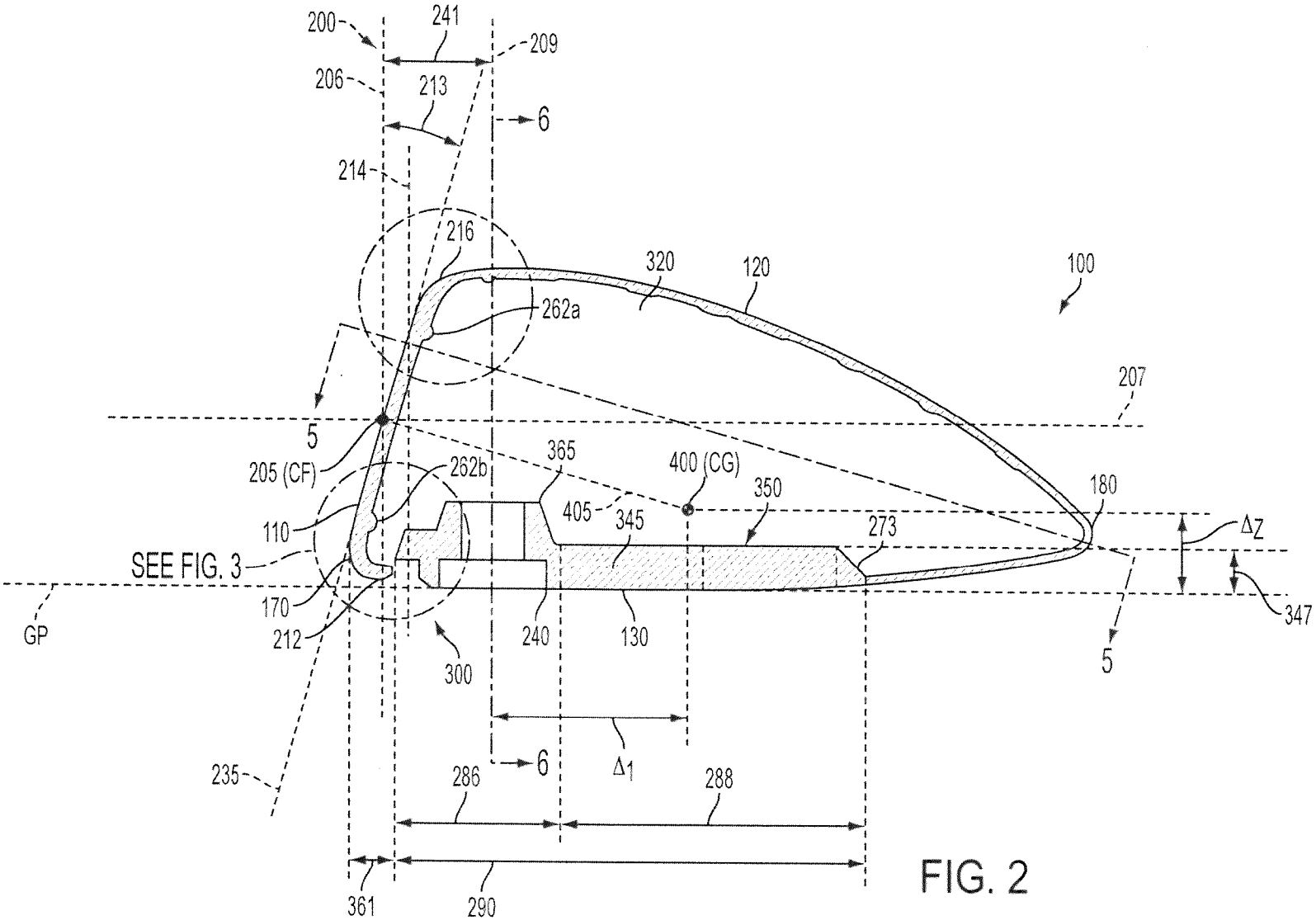
FIG. 2 is a cross-sectional view of the golf club head taken in the plane indicated by line 2-2 of FIG. 1D.

The cutaway view of FIG. 2 shows the hollow nature of the golf club head 100. The golf club head 100 of the current embodiment defines an interior 320 that is bounded by the portions of the golf club head 100 already discussed, including the face 110, crown 120, sole 130, and skirt 140, among other possible features that may provide a boundary to the interior. In the current embodiment, the modular weight port 240 provides access from any region exterior of the golf club head 100 to the interior 320. One object among many of the current embodiment is to provide at least one of a low center of gravity and a forward center of gravity while maintaining a CORF 300. In the current embodiment, a second weight pad portion 345 provides a region of increased mass low inside the golf club head 100. Both a first weight pad portion 365 and the second weight pad portion 345 are portions of a weight pad 350 of the current embodiment. The weight pad 350 is integral with the golf club head 100 in the current embodiment. In various embodiments, the weight pad 350 may be of various materials and may be joined to the golf club head 350. For example, in various embodiments, the weight pad 350 may be of tungsten, copper, lead, various alloys, and various other high density materials if a relocation of mass in the direction of the weight pad 350 is desired. If the weight pad 350 is a separate part joined to the golf club head 100, the weight pad 350 may be joined to the golf club head 100 via welding, gluing, epoxy, mechanical fixing such as with fasteners or with key fit arrangements, or various other joining interfaces. In various embodiments, the weight pad 350 may be arranged on the inside or on the outside of the golf club head 100. The first weight pad portion 365 extends a distance 286 in the direction of the y-axis 207; the second weight pad portion 345 extends a distance 288 in the direction of the y-axis 207; together, a length 290 defines the entirety of the weight pad 350 in the direction of the y-axis 207 and is about 55 mm. In various embodiments, the length 290 may be 50-60 mm. In various embodiments, the length 290 may be 45-62 mm. As seen, the weight pad 350 is offset from the leading edge 170 a distance 361, as discussed in further detail below with reference to FIG. 3. In the current embodiment, the distance 361 is 5.3 mm, and in various embodiments it may be desired for the distance 361 to be as small as possible. In various embodiments, the distance 361 may be 4.5-6.5 mm. The second weight pad portion 345 is of a thickness 347 as measured in the direction of the z-axis. In the current embodiment, the thickness 347 is about 3.6 mm. In various embodiments, the thickness 347 may be 2-4 mm. In various embodiments, the thickness 347 may be up to 5 mm. An end 273 of the weight pad 350 is seen in the cutaway view (further detail seen in FIG. 5). The end 273 is sloped for weight distribution and manufacturability.

For reference, a center line 214 that is parallel to the z-axis 206 is shown at the center of the CORF 300 in the view of FIG. 2. The location of the center line 214 is provided in greater detail below with reference to FIG. 3. A face-to-crown transition point 216 is also seen in the view. The face-to-crown transition point 216 is the point at which the face 110 stops and the crown 120 begins in a plane cut along the y-axis 207, which is at the origin 205 in the current embodiment or, globally, at CF. It is understood that the face 110 and crown 120 transition along a curve, and the face-to-crown transition point 216 is located only in the plane of the y-axis 207 in the current embodiment, or, globally, in a plane intersecting CF under any coordinate system. Because of roll radius and bulge radius of the face 110, the face-to-crown transition point 216 the transition between the face 110 and crown 120 is no closer to the origin 205 in any geometric space than at the face-to-crown transition point 216 in the current embodiment. Additionally, no part of the transition from face 110 to crown 120 is closer to the z-axis 206 as measured parallel to the y-axis 207. As can be seen in the view of FIG. 2, the center line 214 is closer to the z-axis 206 at all points as measured parallel to the y-axis 207 than the face-to-crown transition point 216. As such, no point of the transition between the face 110 and crown 120 is closer to the z-axis 206 than a center line passing through the center of the CORF 300 as measured parallel to the y-axis 207, and, as such the CORF 300 is closer to the origin 205 (CF) than the transition of the face 110 to the crown 120 at any point in the current embodiment. It should be noted that, as loft of the golf club head 100 reduces, the face-to-crown transition point 206 may approach the center line 214—for example, in driver-type golf club heads. However, the disclosure is accurate for the current embodiment and for all lofts of 13 degrees or greater.

Figure 6:
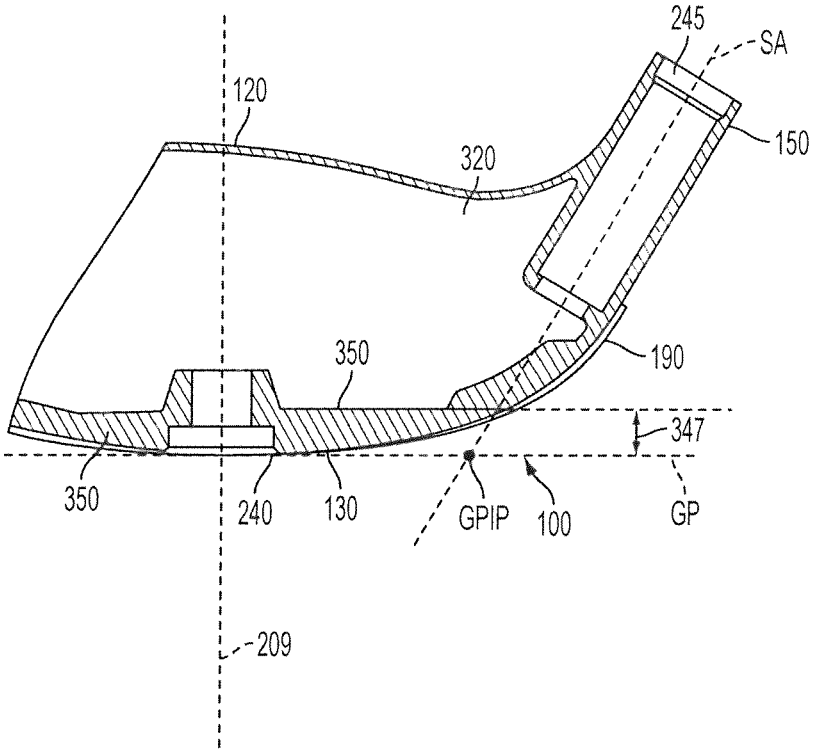
FIG. 6 is a cross-sectional view of the golf club head taken in the plane indicated by line 6-6 of FIG. 2.

Also seen in FIG. 2, a shaft plane z-axis 209 is seen. The shaft plane z-axis 209 is parallel to z-axis 206 but is in the same plane as the SA. For reference the view of FIG. 6 shows the location of the shaft plane z-axis 209 in the same cutting plane as the SA. The shaft plane z-axis 209 is located a distance 241 from the z-axis 206 as measured in the direction of the y-axis 207. In the current embodiment, the distance 241 is 13.25 mm. In various embodiments, the distance 241 may be 13-14 mm. In various embodiments, the distance 241 may be 10-17 mm. In various embodiments, the distance 241 may be as little as 1 mm and as large as 24 mm. In the current embodiment, the shaft plane z-axis 209 is located collinearly with a center of the modular weight port 240. The location of the modular weight port 240 need not be correlated to the shaft plane z-axis 209 for all embodiments.

With returning reference to FIG. 2, in the current embodiment, the CORF 300 is defined in the sole 130 of the golf club head 100 such that the interior 320 of the golf club head 100 is not physically bounded by metal on all sides of the golf club head 100. In the current embodiment, the CORF 300 is a through-slot, thereby being defined as an open region such that the interior 320 of the golf club head 100 is not separated from the exterior at the CORF 300. The CORF 300 of the current embodiment decouples the face 110 from the sole 130. Such a feature provides multiple unexpected advantages, as will be described in greater detail later in this disclosure. In various embodiments, the various features of the CORF 300 may include various shapes, sizes, and various embodiments to achieve desired results. In multiple embodiments, the golf club head 100 includes a face 110 that is fabricated separately and is secured to the golf club head 100 after fabrication. In the current embodiment, the face 110 is secured to the golf club head 100 by welding. Weld beads 262*a,b* are seen in the current embodiment. A tangent face plane 235 (TFP) can be seen in the profile view as well. The TFP 235 is a plane tangent to the face 110 at the origin 205 (at CF). The TFP 235 approximates a plane for the face 110, even though the face 110 is curved at a roll radius and a bulge radius. The TFP 235 is angled at an angle 213 with respect to the z-axis 206. The angle 213 in the current embodiment is the same as a loft angle of the golf club head as would be understood by one of ordinary skill in the art. For the current embodiment, the SA is entirely within a plane parallel to the plane formed by the x-axis 208 and the z-axis 206. In some embodiments, the SA will not be in a plane parallel to the plane formed by the x-axis 208 and the z-axis 206. In such embodiments, the shaft plane z-axis 209 will be a plane parallel to the plane formed by the x-axis 208 and the z-axis 206 and intersecting the GPIP.

A center of gravity 400 (CG) of the golf club head 100 is seen in FIG. 2. Because the weight pad 350 makes up a large portion of the mass of the golf club head 100, the CG 400 is located relatively proximate the weight pad 350. The distance of the CG 400 from the GP as measured in the direction of the z-axis 206 is seen and labeled as $\Delta_z$ in the current view. In the current embodiment, $\Delta_z$ is about 12 mm. In at least one embodiment, $\Delta_z$ is between 9 mm and 10 mm. In various embodiments, $\Delta_z$ may be 11-13 mm. In various embodiments, $\Delta_z$ may be 10-14 mm. In various embodiments, $\Delta_z$ may be 8-12 mm. In various embodiments, $\Delta_z$ may be 8-16 mm. Similarly, a distance labeled as $\Delta_1$ is seen as the distance from the shaft plane z-axis 209 to the CG 400 as measured in the direction of the y-axis 207. In the current embodiment, $\Delta_1$ is about 11.5 mm. In various embodiments, $\Delta_1$ may be between and including 11 mm and 13 mm. In various embodiments, $\Delta_1$ may be between and including 10 mm and 14 mm. In various embodiments, $\Delta_1$ may be between and including 8 mm and 16 mm.

The location of the CG 400 and the actual measurements of $\Delta_z$ and $\Delta_1$ affect the playability of the golf club head 100, as will be discussed below. A projection 405 of the CG 400 can be seen orthogonal to the TFP 235. A projection point (not labeled in the current embodiment) is a point at which the projection 405 intersects the TFP 235. In the current embodiment, the location of the CG 400 places the projection point at about the center of the face 110, which is the location of the origin 205 (at CF) in the current embodiment.

In various embodiments, the projection point may be in a location other than the origin 205 (at CF).

The location of the CG 400—particularly the dimensions $\Delta_z$ and $\Delta_1$—affect the use of the golf club head 100. Particularly with fairway wood type golf club heads similar to the golf club head 100, small $\Delta_z$ has been used in various golf club head designs. Many designs have attempted to maximize $\Delta_1$ within the parameters of the particular golf club head under design. Such a design may focus on MOI, as rearward movement of the CG can increase MOI in some designs.

However, there are several drawbacks to rearward CG location. One such drawback is dynamic lofting. Dynamic lofting occurs during the golf swing when the $\Delta_1$ (for any club, $\Delta_1$ is the distance from the shaft plane to the CG measured in the direction of the y-axis 207) is particularly large. Although the loft angle (seen in the current embodiment as angle 213) is static, when the $\Delta_1$ is large, the CG of the golf club head is in position to cause the loft of the club head to increase during use. This occurs because, at impact, the offset CG of the golf club head from the shaft axis creates a moment of the golf club head about the x-axis 208 that causes rotation of the golf club head about the x-axis 208. The larger $\Delta_1$ becomes, the greater the moment arm to generate moment about the x-axis 208 becomes. Therefore, if $\Delta_1$ is particularly large, greater rotation is seen of the golf club head about the x-axis 208. The increased rotation leads to added loft at impact.

Dynamic lofting may be desired in some situations, and, as such, low and rearward CG may be a desired design element. However, dynamic lofting causes some negative effects on the resulting ball flight. First, for each degree of added dynamic loft, launch angle increases by 0.1°. Second, for each degree of added dynamic loft, spin rate increases by about 200-250 rpm. The increased spin rate is due to several factors. First, the dynamic lofting simply creates higher loft, and higher loft leads to more backspin. However, the second and more unexpected explanation is gear effect. The projection of a rearward CG onto the face of the golf club head creates a projection point above center face (center face being the ideal impact location for most golf club heads). Gear effect theory states that, when the projection point is offset from the strike location, the gear effect causes rotation of the golf ball toward the projection point. Because center face is an ideal impact location for most golf club heads, offsetting the projection point from the center face can cause a gear effect on perfectly struck shots. Particularly with rearward CG fairway woods, loft of the golf club head causes the projection point to be above the center face—or, above the ideal strike location. This results in a gear effect on center strikes that causes the ball to rotate up the face of the golf club head, generating even greater backspin. Backspin may be problematic in some designs because the ball flight will "balloon"—or, in other words, rise too quickly—and the distance of travel of the resultant golf shot will be shorter than for optimal spin conditions. A third problem with dynamic lofting is that, in extreme cases, the trailing edge of the golf club head may contact the ground, causing poor golf shots; similarly, the leading edge may raise off the ground, causing thin golf shots.

A further consideration with offsetting the CG such that the projection point is not aligned with center face is the potential loss of energy due to spin. Because of the aforementioned gear effect problem, moving the projection point anywhere other than the ideal strike location reduces the energy transfer on ideal strikes, as more energy is turned into spin. As such, golf club heads for which the projection point is offset from the ideal strike location may experience less distance on a given shot than golf club heads for which the projection point is aligned with the ideal strike location (assumed to be at center face).

As stated previously, in some embodiments, the events described above are desired outcomes of the design process. In the current embodiment, the location of the CG 400 creates a projection point (not labeled) that is closely aligned to the CF (at the origin 205).

As can be seen, the golf club head 100 of the current embodiment is designed to produce a small $\Delta_z$ and, thereby, to have a relatively low CG 400. In various embodiments, however, the size of $\Delta_1$ may become more important to the goal to achieve ideal playing conditions for a given set of design considerations.

A measurement of the location of the CG from the origin 205 (CF) along the y-axis 207—termed $CG_y$ distance—is a sum of $\Delta_1$ and the distance 241 between the z-axis 206 and the shaft plane z-axis 209. In the current embodiment of the golf club head 100, distance 241 is nominally 13.25 mm, and $\Delta_1$ is nominally 11.5 mm, although variations on the $CG_y$ distance are described herein. In the current embodiment, the $CG_y$ distance is 24.75 mm, although in various embodiments of the golf club head 100 the $CG_y$ distance may be as little as 28 mm and as large as 32 mm.

Knowing the $CG_y$ distance allows the use of a CG effectiveness product to describe the location of the CG in relation to the golf club head space. The CG effectiveness product is a measure of the effectiveness of locating the CG low and forward in the golf club head. The CG effectiveness product ($CG_{eff}$) is calculated with the following formula and, in the current embodiment, is measured in units of the square of distance ($mm^2$):

$$CG_{eff}=CG_y\times\Delta_z$$

With this formula, the smaller the $CG_{eff}$, the more effective the club head is at relocating mass low and forward. This measurement adequately describes the location of the CG within the golf club head without projecting the CG onto the face. As such, it allows for the comparison of golf club heads that may have different lofts, different face heights, and different locations of the CF. For the current embodiment, $CG_y$ is 24.75 mm and $\Delta_z$ is about 12 mm. As such, the $CG_{eff}$ of the current embodiment is about 297 $mm^2$. In various embodiments, $CG_{eff}$ is below 300 $mm^2$, as will be shown elsewhere in this disclosure. In various embodiments, $CG_{eff}$ of the current embodiments is below 310 $mm^2$. In various embodiments, $CG_{eff}$ of the current embodiments is below 315 $mm^2$. In various embodiments, $CG_{eff}$ of the current embodiments is below 325 $mm^2$. Further, $CG_y$ distance informs the distance of the CG to the face as measured orthogonally to the TFP 235. The distance to the CG measured orthogonally to the TFP 235 is the distance of the projection 405. For any loft θ of the golf club head (which is the same as angle 213 for the current embodiment), the distance of the golf club face to the CG ($D_{CG}$) as measured orthogonally to the TFP 235 is described by the equation below:

$$D_{CG}=CG_y\times\cos(\theta)$$

For the current embodiment, a loft of 15 degrees and $CG_y$ of 24.75 mm means the $D_{CG}$ is about 23.9 mm. In various embodiments, $D_{CG}$ may be 20-25 mm. In various embodiments, $D_{CG}$ may be 15-30 mm. In various embodiments, $D_{CG}$ may be less than 35 mm. In various embodiments, $D_{CG}$ may be governed by its relationship to previously determined $CG_y$, $\Delta_1$, $\Delta_2$, or some other physical aspect of the golf club head 100.

Figure 3:
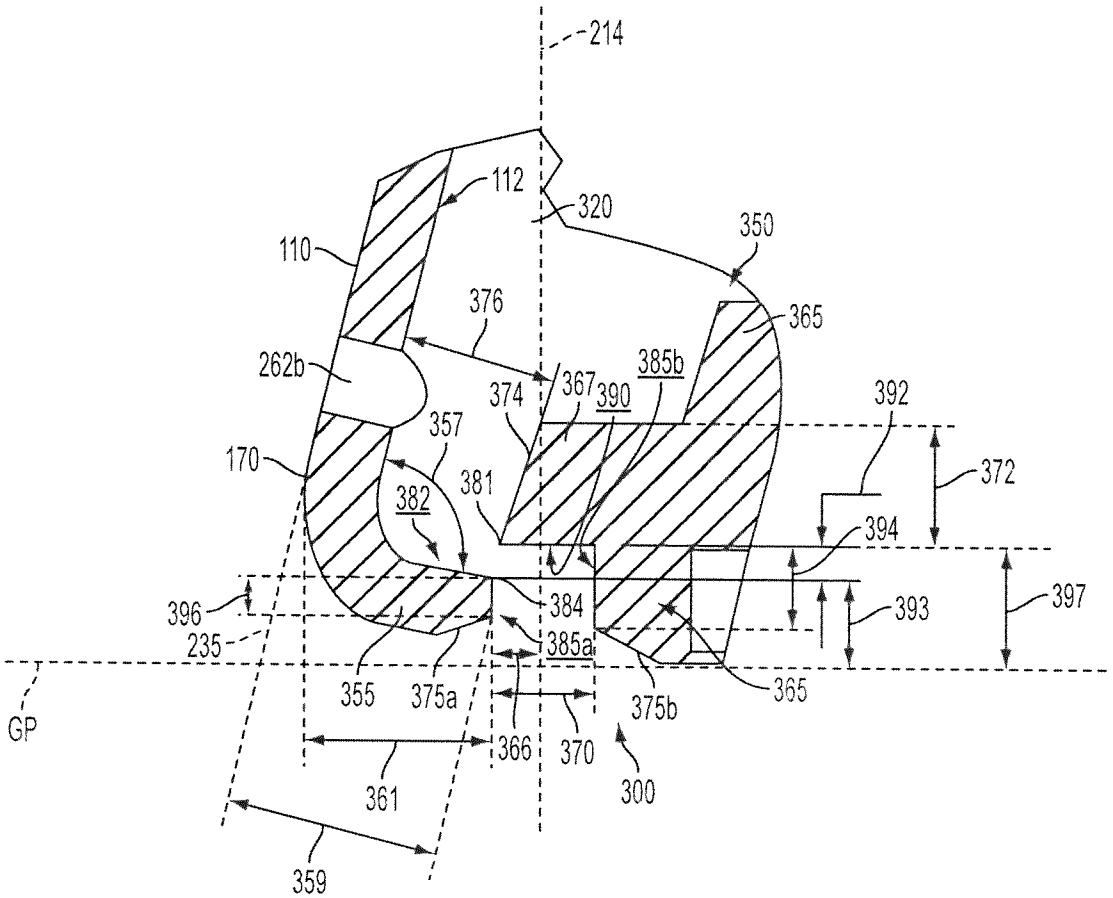
FIG. 3 is a detail view of detail 3 of FIG. 2.

The CORF 300 of the current embodiment is defined proximate the leading edge 170 of the golf club head 100, as seen with reference to FIG. 3. As previously discussed, the CORF 300 of the current embodiment is a through-slot providing a port from the exterior of the golf club head 100 to the interior 320. The CORF 300 is defined on one side by a first sole portion 355. The first sole portion 355 extends from a region proximate the face 110 to the sole 130 at an angle 357, which is acute in the current embodiment. In various embodiments, the first sole portion 355 is coplanar with the sole 130; however, it is not coplanar in the current embodiment. In the current embodiment, the angle 357 is about 88 degrees. In various embodiments, the angle 357 may be 85-90 degrees. In various embodiments, the angle 357 may be 82-92 degrees. The first sole portion 355 extends from the face 110 a distance 359 of about 5.6 mm as measured orthogonal to the TFP 235. In various embodiments, the distance 359 may be 5-6 mm. In various embodiments, the distance 359 may be 4-7 mm. In various embodiments, the distance 359 may be up to 12.5 mm. The first sole portion 355 projects along the y-axis 207 the distance 361 as measured to the leading edge 170, which is the same distance that the weight pad 350 is offset from the leading edge 170. In the current embodiment, the distance 361 is about 5 mm. In various embodiments, the distance 361 is 4.5-5.5 mm. In various embodiments, the distance 361 is 3-7 mm. In various embodiments, the distance 361 may be up to 10 mm. In the current embodiment, the distances 359,361 are measured at the cutting plane, which is coincident with the y-axis 207 and z-axis 206. In various embodiments, measurements—including angles and distances such as distances 359,361—may vary depending on the location where measured and as based upon the shape of the CORF 300.

The CORF 300 is defined over a distance 370 from the first sole portion 355 to the first weight pad portion 365 as measured along the y-axis. In the current embodiment, the distance 370 is about 3.0 mm. In various embodiments, the distance 370 may be larger or smaller. In various embodiments, the distance 370 may be 2.0-5.0 mm. In various embodiments, the distance 370 may be variable along the CORF 300. It would be understood by one of skill in the art that, in various embodiments, the first sole portion 355 may extend in a location for which no rearward vertical surface 385*b* is immediately adjacent and, as such, the distance 370 may become large if measured along the y-axis 207. As previously discussed, the center line 214 passes through the center of the CORF 300. The center of the CORF 300 is defined by a distance 366, which is exactly one half the distance 370. In the current embodiment, the distance 366 is 1.5 mm.

The CORF 300 is defined distal the leading edge 170 by the first weight pad portion 365. The first weight pad portion 365 in the current embodiment includes various features to address the CORF 300 as well as the modular weight port 240 defined in the first weight pad portion 365. In various embodiments, the first weight pad portion 365 may be various shapes and sizes depending upon the specific results desired. In the current embodiment, the first weight pad portion 365 includes an overhang portion 367 over the CORF 300 along the y-axis 207. The overhang portion 367 includes any portion of the weight pad 350 that overhangs the CORF 300. For the entirety of the disclosure, overhang portions include any portion of weight pads overhanging the CORFs of the current disclosure. The overhang portion 367 includes a faceward most point 381 that is the point of the overhang portion 367 furthest toward the leading edge 170 as measured in the direction of the y-axis 207.

The overhang portion 367 overhangs a distance that is about the same as the distance 370 of the CORF 300 in the current embodiment. In the current embodiment, the weight pad 350 (including the first weight pad portion 365 and the second weight pad portion 345) are designed to provide the lowest possible center of gravity of the golf club head 100. A thickness 372 of the overhang portion 367 is shown as measured in the direction of the z-axis 206. The thickness 372 may determine how mass is distributed throughout the golf club head 100 to achieve desired center of gravity location. The overhang portion 367 includes a sloped end 374 that is about parallel to the face 110 (or, more appropriately, to the TFP 235, not shown in the current view) in the current embodiment, although the sloped end 374 need not be parallel to the face 110 in all embodiments. A separation distance 376 is shown as the distance between an inner surface 112 of the face 110 and the sloped end 374 as measured orthogonally to the TFP 235. In the current embodiment, the separation distance 376 of about 4.5 mm is seen as the distance between the inner surface 112 of the face 110 and the sloped end 374 of the overhang portion 367 as measured orthogonal to the TFP 235. In various embodiments, the separation distance 376 may be 4-5 mm. In various embodiments, the separation distance 376 may be 3-6 mm. The CORF 300 includes a beveled edge 375 (shown as 375*a* and 375*b* in the current view). In the current embodiment, the beveled edge 375 provides some stress reduction function, as will be described in more detail later. In various embodiments, the distance that the overhang portion 367 overhangs the CORF 300 may be smaller or larger, depending upon the desired characteristics of the design.

As can be seen, an inside surface 382 of the first sole portion 355 extends downward toward the sole 130. The inside surface 382 terminates at a low point 384. The CORF 300 includes a vertical surface 385 (shown as 385*a,b* in the current view) that defines the edges of the CORF 300. The CORF 300 also includes a termination surface 390 that is defined along a lower surface of the overhang portion 367. The termination surface 390 is offset a distance 392 from the low point 384 of the inside surface 382. The offset distance 392 provides clearance for movement of the first sole portion 355, which may deform in use, thereby reducing the distance 370 of the CORF 300. Because of the offset distance 392, the vertical surface 385 is not the same for vertical surface 385*a* and vertical surface 385*b*. However, the vertical surface 385 is continuous around the CORF 300. In the current embodiment, the offset distance 392 is about 0.9 mm. In various embodiments, the offset distance 392 may be 0.2-2.0 mm. In various embodiments, the offset distance 392 may be up to 4 mm. An offset to ground distance 393 is also seen as the distance between the low point 384 and the GP. The offset to ground distance 393 is about 2.25 mm in the current embodiment. The offset to ground distance 393 may be 2-3 mm in various embodiments. The offset to ground distance 393 may be up to 5 mm in various embodiments. A rearward vertical surface height 394 describes the height of the vertical surface 385*b* and a forward vertical surface height 396 describes the height of the vertical surface 385*a*. In the current embodiment, the forward vertical surface height 396 is about 0.9 mm and the rearward vertical surface height 394 is about 2.2 mm. In various embodiments, the forward vertical surface height 396 may be 0.5-2.0 mm. In various embodiments, the rearward vertical surface height 394 may be 1.5-3.5 mm. A termination surface to ground distance 397 is also seen and is about 3.2 mm in the current embodiment. The termination surface to ground distance 397 may be 2.0-5.0 mm in various embodiments. The termination surface to ground distance 397 may be up to 10 mm in various embodiments.

In various embodiments, the vertical surface 385*b* may transition into the termination surface 390 via fillet, radius, bevel, or other transition. One of skill in the art would understand that, in various embodiments, sharp corners may not be easy to manufacture. In various embodiments, advantages may be seen from transitions between the vertical surface 385 and the termination surface 390. Relationships between these surfaces (385, 390) are intended to encompass these ideas in addition to the current embodiments, and one of skill in the art would understand that features such as fillets, radii, bevels, and other transitions may be substantially fall within such relationships. For the sake of simplicity, relationships between such surfaces shall be treated as if such features did not exist, and measurements taken for the sake of relationships need not include a surface that is fully vertical or horizontal in any given embodiment.

The thickness 372 of the overhang portion 567 of the current embodiment can be seen. The thickness 372 in the current embodiment is about 3.4 mm. In various embodiments, the thickness 372 may be 3-5 mm. In various embodiments, the thickness 372 may be 2-10 mm. As shown with relation to other embodiments of the current disclosure, the thickness 372 maybe greater if combined with features of those embodiments. Additionally, the rearward vertical surface height 394 defines the distance of the CORF 300 from the termination of the bevel 375 to the termination surface 390 as well as the distance of the vertical surface 385*b*, although such a relationship is not necessary in all embodiments. As can be seen, each of the offset distance 392, the offset to ground distance 393, and the vertical surface height 394 is less than the thickness 372. As such, a ratio of each of the offset distance 392, the offset to ground distance 393, and the vertical surface height 394 to the thickness 372 is less than or equal to 1. In various embodiments, the CORF 300 may be characterized in terms of the termination surface to ground distance 397. For the current embodiment, a ratio of the termination surface to ground distance 397 as compared to the thickness 372 is about 1, although it may be less in various embodiments. For the sake of this disclosure, the ratio of termination surface to ground distance 397 as compared to the thickness 372 is termed the "CORF mass density ratio." While the CORF mass density ratio provides one potential characterization of the CORF, it should be noted that all ratios cited in this paragraph and throughout this disclosure with relation to dimensions of the various weight pads and CORFs may be utilized to characterize various aspects of the CORFs, including mass density, physical location of features, and potential manufacturability. In particular, the CORF mass density ratio and other ratios herein at least provide a method of describing the effectiveness of relocating mass to the area of the CORF, among other benefits.

The CORF 300 may also be characterized in terms of distance 370. A ratio of the offset distance 392 as compared to the distance 370 is about equal to 1 in the current embodiment and may be less than 1 in various embodiments.

In various embodiments, the CORF 300 may be plugged with a plugging material (not shown). Because the CORF 300 of the current embodiment is a through-slot (providing a void in the golf club body), it is advantageous to fill the CORF 300 with a plugging material to prevent introduction of debris into the CORF 300 and to provide separation between the interior 320 and the exterior of the golf club head 100. Additionally, the plugging material may be chosen to reduce or eliminate unwanted vibrations, sounds, or other negative effects that may be associated with a through-slot. The plugging material may be various materials in various embodiments depending upon the desired performance. In the current embodiment, the plugging material is polyurethane, although various relatively low modulus materials may be used, including elastomeric rubber, polymer, various rubbers, foams, and fillers. The plugging material should not substantially prevent deformation of the golf club head 100 when in use (as will be discussed in more detail later).

Figure 4:
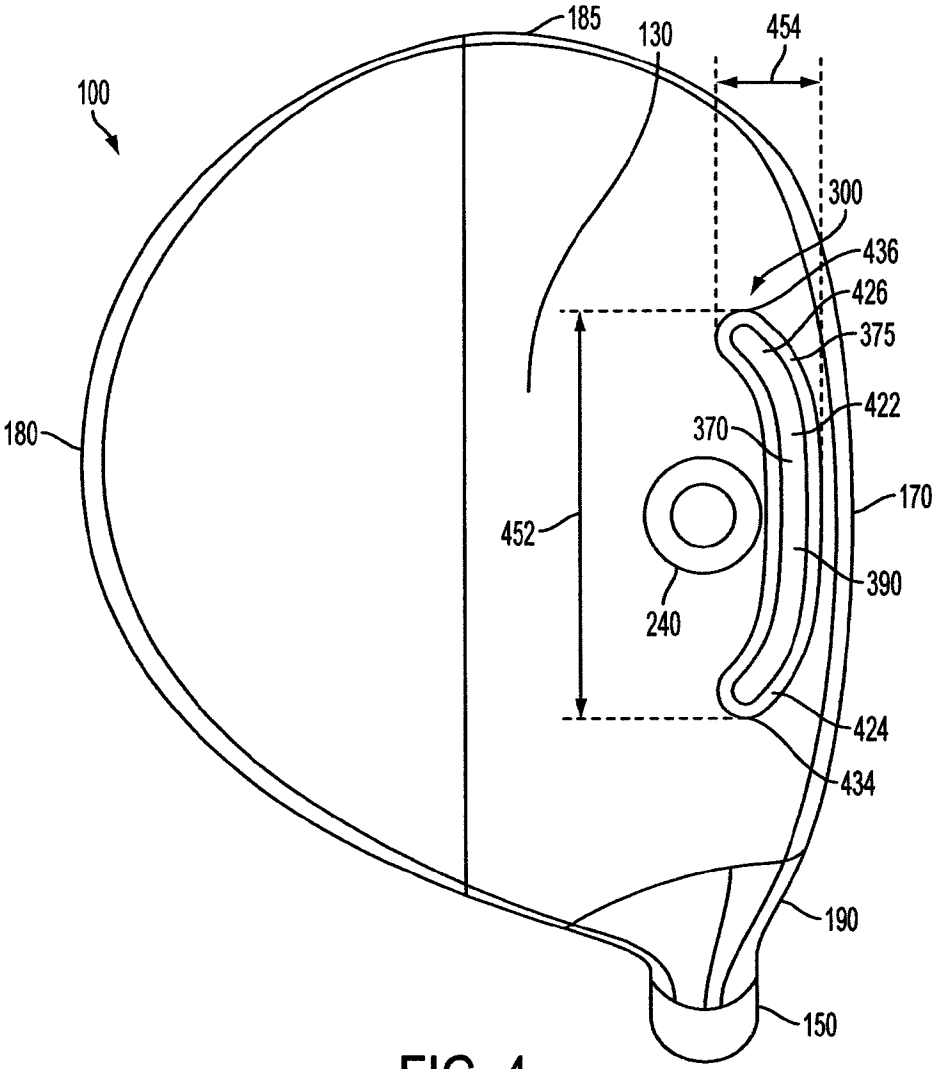
FIG. 4 is a bottom view of the golf club head of FIG. 1A.

The CORF 300 is shown in the view of FIG. 4. The CORF 300 of the current embodiment includes multiple portions that define its shape. The CORF 300 includes a central portion 422 that comprises a plurality of the CORF 300. The central portion 422 is relatively straight as compared to other portions of the CORF 300. In the current embodiment, the central portion 422 is a curve of a radius of about 100 mm. A profile of the central portion 422 approximately follows the profile of the leading edge 170 such that the curvature of the central portion 422 does not substantially deviate from a curvature of the leading edge 170. The distance 370 can be seen as the defining width of the CORF 300. The defining width is measured orthogonally to the vertical surface 385 such that the defining width is not necessarily at a constant angle with respect to any axis (x-axis 208, y-axis 207, z-axis 206). The CORF 300 includes two additional portions. A heelward return portion 424 and a toeward return portion 426 are seen. The heelward return portion 424 and toeward return portion 426 diverge from the leading edge 170 such that a curvature of the CORF 300 in the region of the heelward return portion 424 and the toeward return portion 426 is not substantially the same as the curvature of the leading edge 170. In the current embodiment, the defining width of the CORF 300 remains constant such that the distance 370 defines the defining width of the CORF 300 throughout all portions (central portion 422, heelward return portion 424, toeward return portion 426). In various embodiments, the defining width of at least one of the heelward return portion 424 and the toeward return portion 426 may be variable with respect to the defining with of the central portion 422. In the current embodiment, the divergence of the heelward return portion 424 and the toeward return portion 426 from the leading edge 170 provides additional stress reduction to avoid potential failure—such as cracking or permanent deformation—of the golf club head 100 along the CORF 300. In the current embodiment, the heelward return portion 424, central portion 422, and toeward return portion 426 are not constant radius between the three portions. Instead, the CORF 300 of the current embodiment is a multiple radius (hereinafter "MR") CORF 300. Because of the arrangement of the view of FIG. 4, the termination surface 390 can be seen under the CORF 300.

The CORF 300 includes a heelward end 434 and a toeward end 436. Each end 434,436 of the CORF 300 is identified at the end of the beveled edge 375. In various embodiments, the beveled edge 375 may be omitted, and the ends 434,436 may be closer together as a result. A distance 452 is shown between the toeward end 436 and the heelward end 434 as measured in the direction of the x-axis 208. In the current embodiment, the distance 452 is 40-43 mm. In various embodiments, the distance 452 may be 33-50 mm. In various embodiments, the distance 452 may be larger or smaller than the ranges cited herein and is limited only by the size of the golf club head. The CORF 300 includes a distance 454 as measured in the direction of the y-axis 207. In the current embodiment, the distance 454 is 9-10 mm. In various embodiments, the distance 454 may be 7-12 mm. In various embodiments, the distance 454 may be larger or smaller than ranges cited herein and is limited only by the size of the golf club head.

Figure 5:
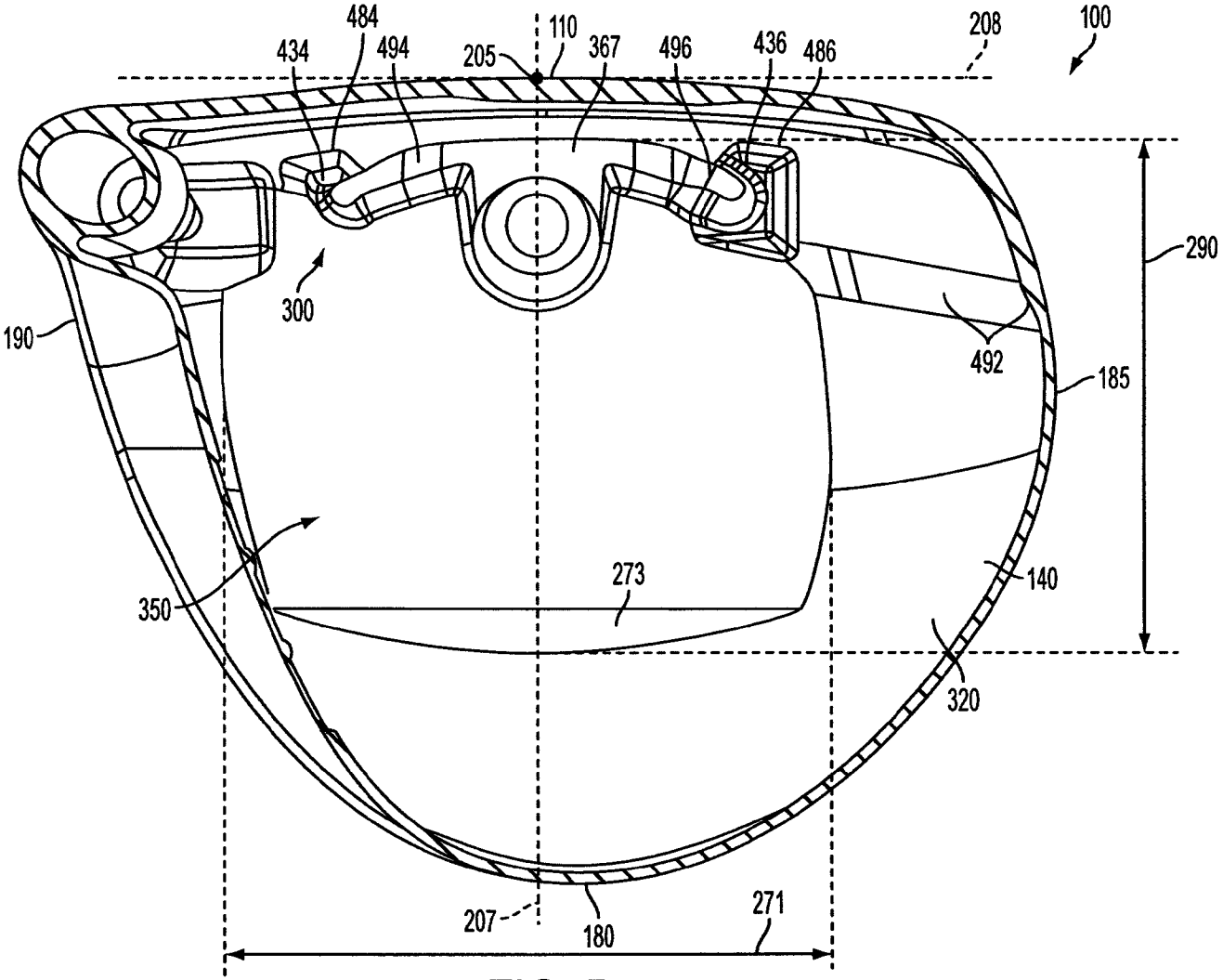
FIG. 5 is a cross-sectional view of the golf club head taken in the plane indicated by line 5-5 of FIG. 2.

As seen with reference to FIG. 5, the CORF 300 of the current embodiment is reinforced along its ends 434,436 and with various features. The CORF 300 is subject to cracking under high stress. A heel stress relief pad 484 and a toe stress relief pad 486 are included along the interior 320 at the CORF 300. In particular, the stress relief pads 484,486 are regions of relatively thick construction along ends 434,436 of the CORF 300. The stress relief pads 484,486 may also aid in flow of material during casting, as the increased thickness of the material at the ends 434,436 may help define those regions of the CORF 300 that experience the greatest stresses in use. A thickness transition region 492 is seen both in the cutaway view and in cross-sectional view of the toe 185. The thickness transition region 492 provides a step up in thickness of walls of the golf club head 100 proximate the face 110. The increased thickness provides multiple benefits, including relocation of mass close to the face 110 and increased structural integrity in the region of the face 110, among others. As can be seen in the view of FIG. 5, the overhang portion 367 generally follows the profile of the CORF 300, which includes the central portion 422, the heelward return portion 424, and the toeward return portion 426 (see FIG. 4). As can be seen, the overhang portion 367 of the current embodiment includes at least two reinforcement sections 494,496 wherein the thickness of the overhang portion 367 is variable. The reinforcement sections 494,496 provide similar benefits to the stress relief pads 484,486, including better stress relief, mold flow, and movement of mass. A dimension 271 of the weight pad 350 is seen as the largest length of the weight pad 350 as measured along the x-axis 208, and the dimension 271 is about 63 mm in the current embodiment. The dimensions 271 may be 60-70 mm in various embodiments. The dimension 271 may be 50-75 mm in various embodiments. The weight pad 350 of the current embodiment extends to its edges where it contacts the skirt 140. A further view of the golf club head 100 is seen in FIG. 6. Various stress relief pads and reinforcements of the current disclosure may be replaced with similar features in various embodiments, including ribs, changes in thickness, or dimension changes, among other methods. One of skill in the art would understand that such alternative features are intended to be encompassed by the scope of this disclosure.

As previously mentioned, coefficient of restitution features such as CORF 300 and previously cited embodiments provide multiple benefits, particularly in a fairway wood type golf club head. In general, coefficient of restitution features provide benefits that would otherwise be unavailable in a fairway wood type golf club head.

For example, fairway woods with coefficient of restitution features are capable of seeing higher COR than non-CORF fairway woods. Multiple reasons exist for this. In the embodiment of CORF 300 in golf club head 100, a strike of a golf ball on the center of the face experiences—as with most wood-type golf club heads—maximum COR. As shown, a golf club head with a coefficient of restitution feature such as CORF 300 becomes unconstrained in the plane of the center face in at least the direction of impact, thereby allowing an increase in COR.

At impact, the golf club head 100 may experience normal forces of greater than 1 ton (2,000 pounds) concentrated in the location of impact—ideally, center face. Under such force, the metals with which most golf club heads are made experience at least some deflection, which results in a measurable COR. If a golf club face is as rigid as possible, any deflection will be minimal, and the amount of energy stored as potential spring energy is minimal as well. With minimal deflection, the face does not return to its typical position with a great amount of energy, and, thus, does not impart additional energy onto the golf ball.

In some designs, it may be possible to make a golf club head with advanced materials and with thinner faces. Materials may include 6-4 titanium, 15-3-3-3 titanium, and steels of strength greater than 1400 MPa, among others. A thinner face will often result in a higher COR because the bending stiffness of the face is a function of thickness. However, designers run a risk in making golf club faces too thin, as cracking or other failure may occur if the golf club face becomes too thin.

In driver-type golf club heads, many golf club heads have maximized the USGA size limit of 460 cubic centimeters in volume. Many drivers have faces with relatively large surface area resulting from relatively large face height and relatively large face width. Accordingly, many drivers are able to achieve the USGA maximum 0.830 COR, as described previously, because the large area of the face makes it possible to spread deflection of greater distances. Cumulatively, small deflections in the face result in a large deflection upon center face hits, leading to greater restitution, even when driver-type golf club heads are manufactured with less thin faces than would be required to achieve the same COR in a smaller face. In fact, many driver-type golf club heads—for example, as in U.S. patent application Ser. No. 12/813,442, as previously referenced and incorporated herein by reference in its entirety—are designed with variable face thickness (VFT) to increase the area of the face for which COR is maximized. As such, variability in distance for off-center hits is reduced, leading to a larger COR area.

Conversely, in fairway wood type golf club heads, it is often difficult to reach maximum COR even on center face strikes. Fairway wood type golf club heads typically include much smaller face area, much smaller face height, and much smaller face width than driver type golf club heads. To maximize COR on fairway wood type golf club heads, many designs decrease face thickness, and, in doing so, often compromise structural integrity of the face of the golf club head. Additionally, the joints at the edges of the face between the face and the club body are often more rigid than in the center of the face, leading to widely varying distances between center-face strikes and off-center strikes, even on driver-type golf club heads. Coefficient of restitution features as described in references cited herein provide some benefit but are still largely constrained. Further, the geometric space occupied within the golf club head by protruding coefficient of restitution features prevents relocation of mass, as previously discussed.

The embodiments of the current disclosure address the challenges that previous designs were unable to address. Because the CORF 300 and other CORFs of the current disclosure (as described with reference to other embodiments of the current disclosure below) do include physical elements occupying space in the interior 320 of the golf club head 100 or other golf club heads of the current disclosure, it becomes possible to relocate mass in a region proximate the CORF 300 and other CORFs of the current disclosure—particularly, in the low and forward region—in various embodiments of the golf club heads of the current disclosure. Such relocation of mass allows maximum design flexibility to provide optimal playing conditions based on the desired CG location of the club designer.

Because the CORF 300 and other CORFs of the current disclosure are not physically coupled at the leading edge 170 to the sole 130 for at least a region proximate the center of the face, leading to greater deflection and, thereby, greater COR. Elementary beam theory explains how this is possible.

Figure 31:
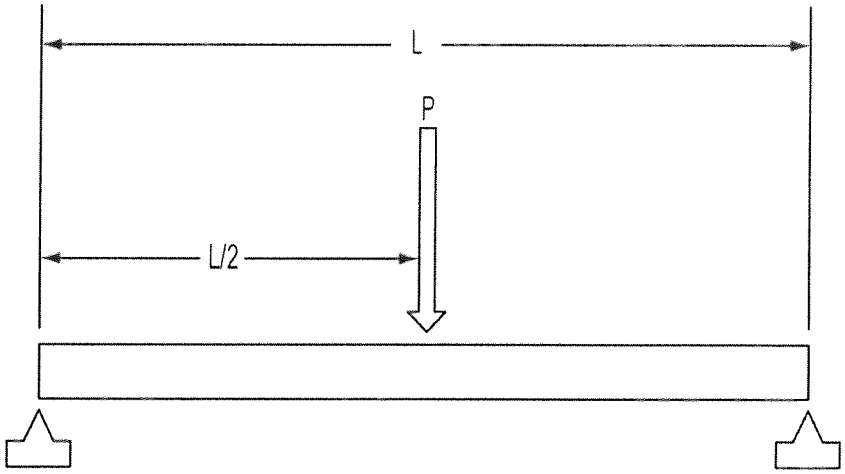
FIG. 31 is a schematic diagram of a rigid beam.

For illustration, a traditional golf club head having a face connected to the golf club body at all ends can be approximated by a rigid beam supported at its ends, as shown in FIG. 31.

For the supported beam above with rigid supports along its ends, deflection δ at the point of application of force P is found using the equation below where L is the length of the beam, E is the elastic modulus of the material of the beam, and I is the area moment of inertia of the beam:

$$\delta = \frac{PL^3}{48EI}$$

Figure 32:
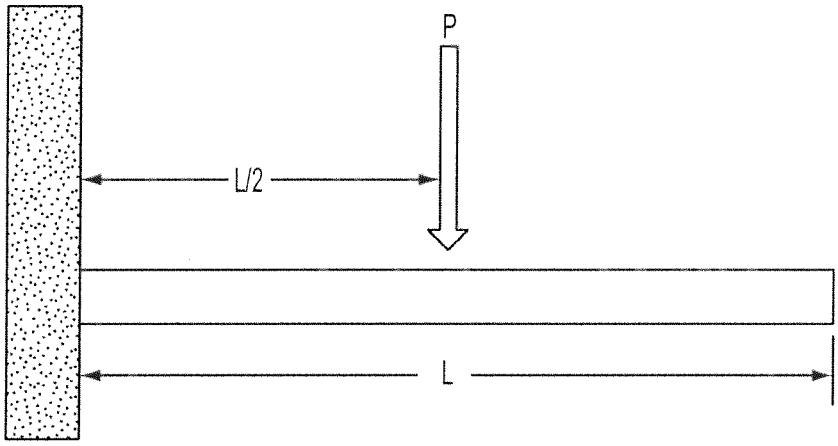
FIG. 32 is a schematic diagram of a cantilever beam.

A golf club head such as golf club head 100 including a coefficient of restitution feature such as CORF 300 and other CORFs of the current disclosure can be approximated by a cantilever beam for the sake of illustration, as shown in FIG. 32.

The deflection at the point of application of force P is as described in the equation below:

$$\delta = \frac{PL^3}{24EI}$$

As such, with all other variables being equal, the deflection at the center point of a cantilever beam is twice that of an end-supported beam. This relationship illustrates the value of coefficient of restitution features such as CORF 300 and other CORFs of the current disclosure in allowing greater deflection at the center of the face.

However, there is additional benefit to CORF 300 and other CORFs of the current disclosure not seen in simple beam theory. As previously mentioned, even the greatest golfers do not strike the golf ball perfectly on every golf shot. As seen in particular detail with reference to FIG. 3, the leading edge of most golf club heads includes an angle that is acute—in the current embodiment, leading edge 170 includes angle 357. Because of the angle 357 is acute, material in the region proximate the angle 357 is particularly less flexible. As such, shots hit "thin"—or, low on the face of a traditional golf club head—experience particularly poor distance because the COR difference between thin shots and shots struck center face is particularly great. In the embodiments of the current disclosure, the CORF 300 and other CORFs of the current disclosure allow the usually-rigid leading edge 170 to have greater flexibility than would otherwise be seen, allowing the COR for thin shots to be much closer to the COR for center face strikes than would be seen for a typical golf club head.

Figure 7:
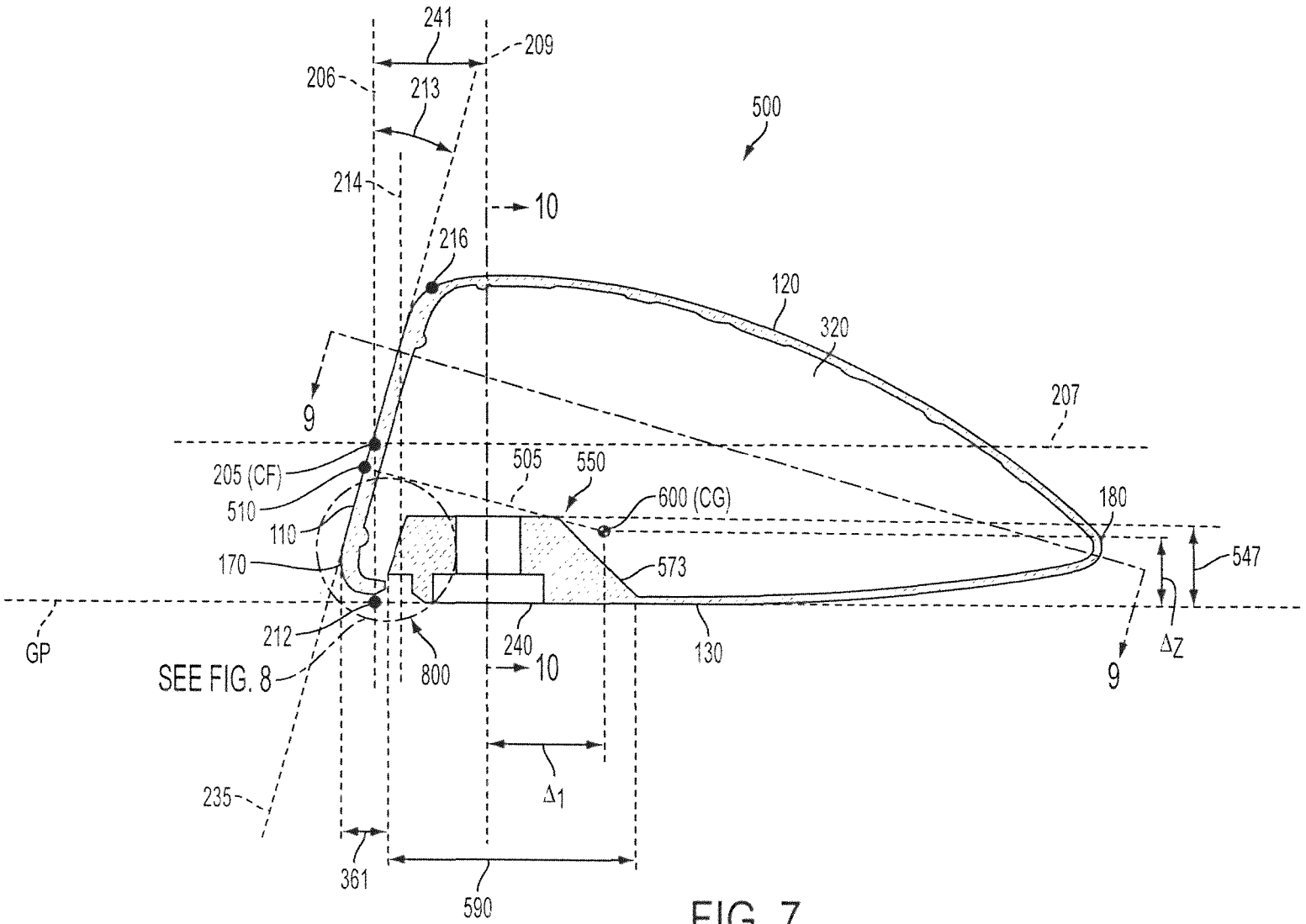
FIG. 7 is a cross-sectional view of a golf club head in accord with one embodiment of the current disclosure as would be shown along the plane indicated by line 2-2 of FIG. 1D.

Another embodiment of a golf club head 500 is seen in cross-sectional view in FIG. 7. The cross-sectional view of FIG. 7 is taken along the same plane for the golf club head 500 as was FIG. 2 for the golf club head 100. The golf club head 500 is substantially similar to the golf club head 100 in many ways. For the sake of simplicity of the disclosure, where features are similarly drawn and/or identified with common reference identifiers, one of skill in the art would understand that the features of one embodiment may be included in another embodiment where the inclusion of such features would not contradict other elements of the disclosure. Even where reference identifiers are not included in the several exemplary embodiments described herein, one of skill in the art would understand that similarly drawn features are intended to be consistent amongst the several embodiments except wherein the disclosure contradicts such assumption or for which such assumption would be antithetical so some explicit disclosure.

The golf club head 500 is similar in shape and features to the golf club head 100. A weight pad 550 of the golf club head 500 is more compacted to the low and forward location in the golf club head 500 than the weight pad 350 of the golf club head 100. In the current embodiment, the weight pad 550 includes a thickness 547 of about 9.5 mm. In various embodiments, the thickness 547 may be 8-10 mm. In various embodiments, the thickness 547 may be 6-12 mm. The thickness 547 in the current embodiment is greater than the thickness 347. However, a length 590 of the weight pad 550 is about 26.5 mm and is smaller than the length 290 of weight pad 350. In various embodiments, the length 590 may be 24-30 mm. in various embodiments, the length 590 may be 21-33 mm. A CORF 800 can be seen and is substantially similar to CORF 300. An end 573 of the weight pad 550 is seen in the cutaway view (further detail seen in FIG. 9). The end 573 is sloped for weight distribution and manufacturability.

One noted difference among at least several is that the golf club head 500 is designed to located the CG 600 of the current embodiment in a location that is low and forward in the golf club head. $\Delta_z$ for golf club head 500 is about 12.9 mm. In various embodiments, $\Delta_z$ may be 11-13 mm. In various embodiments, $\Delta_z$ may be 10-13.5 mm. In various embodiments, $\Delta_z$ may be up to 14.5 mm. $\Delta_1$ for golf club head 500 is about 7 mm. In various embodiments, $\Delta_1$ may be 6.5-7.5 mm. In various embodiments, $\Delta_1$ may be 6-11 mm. In various embodiments, $\Delta_1$ may be up to 12 mm. As comparing $\Delta_1$ for the golf club head 100 to $\Delta_1$ for the golf club head 500, it can be noted that $\Delta_1$ is smaller for the golf club head 500 than for the golf club head 100. Although $\Delta_z$ is larger for the golf club head 500 than for the golf club head 100, the difference is not substantial.

As can be seen, a projection 505 of the CG 600 onto the face 110 results in a projection point 510 that is notably different from the location of the origin 205 at CF. In the current embodiment, the projection point 510 is below the origin 205 by a distance of about 1 mm as measured in the TFP 235. In various embodiments, the projection point 510 may be below the origin 205 be 1.5 mm. In various embodiments, the projection point 510 may be below the origin 205 by up to 3 mm. The low and more forward CG 600 results in a design that changes the playability of the golf club head 500. As described above, a low CG (such as CG 400) may include a projection point at the CF or even above the CF in various designs. Because of the low and relatively forward location of the CG 600, the projection point 510 is below CF in the current embodiment. The previously mentioned effects of CG location apply here. Several advantages are surprisingly found. First, because $\Delta_1$ is relatively small, dynamic lofting is reduced, thereby reducing spin that may, in turn, reduce distance. Additionally, because the projection of the CG 600 is below the CF, the gear effect biases the golf ball to rotate toward the projection of the CG 600—or, in other words, with forward spin. This is countered by the loft of the golf club head 500 imparting back spin. The overall effect is a relatively low spin profile. However, because the CG 600 is below the CF (and, thereby, below the ideal impact location) as measured along the z-axis 206, the golf ball will tend to rise higher on impact. The result is a high launching but lower spinning golf shot on purely struck shots, which leads to better ball flight (higher and softer landing) with more distance (less energy lost to spin).

For the current embodiment of the golf club head 500, $CG_y$ is equal to $\Delta_1$ plus the distance 241 of 13.25 mm. In the current embodiment, $\Delta_1$ is nominally about 7 mm, so $CG_y$ is about 20.25 mm. As previously mentioned, $\Delta_z$ is about 12.9 mm. As such, $CG_{eff}$ is equal to the product of $CG_y$ and $\Delta_z$, which, for the current embodiment, $CG_{eff}$ is about 261 $mm^2$. In various embodiments of the current disclosure, $CG_{eff}$ may be 260-275 $mm^2$. In various embodiments, $CG_{eff}$ may be 255-300 $mm^2$. In various embodiments, $CG_{eff}$ may be 245-275 $mm^2$. In various embodiments, $CG_{eff}$ of the current disclosure may be at most 275 $mm^2$. In various embodiments, $CG_{eff}$ of the current disclosure may be at most 250 $mm^2$. In various embodiments, $CG_{eff}$ of the current disclosure may be at most 225 $mm^2$. In various embodiments, $CG_{eff}$ of the current disclosure may be at most 200 $mm^2$. $D_{CG}$ is determined as mentioned above with respect to golf club head 100. $D_{CG}$ for the current embodiment of about 15 degrees loft (A) and $CG_y$ of 20.25 is about 19.5 mm. In various embodiments, $D_{CG}$ may be 15-25 mm. In various embodiments, $D_{CG}$ may be 10-30 mm. In various embodiments, $D_{CG}$ may be determined from other physical aspects of the golf club head 500 as described herein.

One of skill in the art would understand that the $CG_{eff}$ measurement is particularly difficult to achieve in a fairway wood type golf club head. For example, low $CG_{eff}$ numbers may be seen in hybrid type golf club heads and, particularly, in iron type golf club heads. As such, one of skill in the art would understand that various measurements as combined herein may apply to fairway wood or driver type golf club heads but may not apply to hybrid type golf club heads.

While these effects are seen, it has previously been impossible to implement such design elements within a golf club head that included a coefficient of restitution feature. Because the designs of features for increasing coefficient of restitution described in U.S. patent application Ser. No. 12/791,025, filed Jun. 1, 2010, and U.S. patent application Ser. No. 13/338,197, filed Dec. 27, 2011, which are incorporated by reference herein in their entirety, include physical elements making up the coefficient of restitution features of those designs, it may not be possible to locate a large amount of mass in the vicinity of the coefficient of restitution features and proximate the face of the golf club head. As such, it may not be possible to create a low and forward CG location along with a coefficient of restitution feature as described in previous designs. Such a combination is one inventive element among many of the current disclosure.

Figure 8:
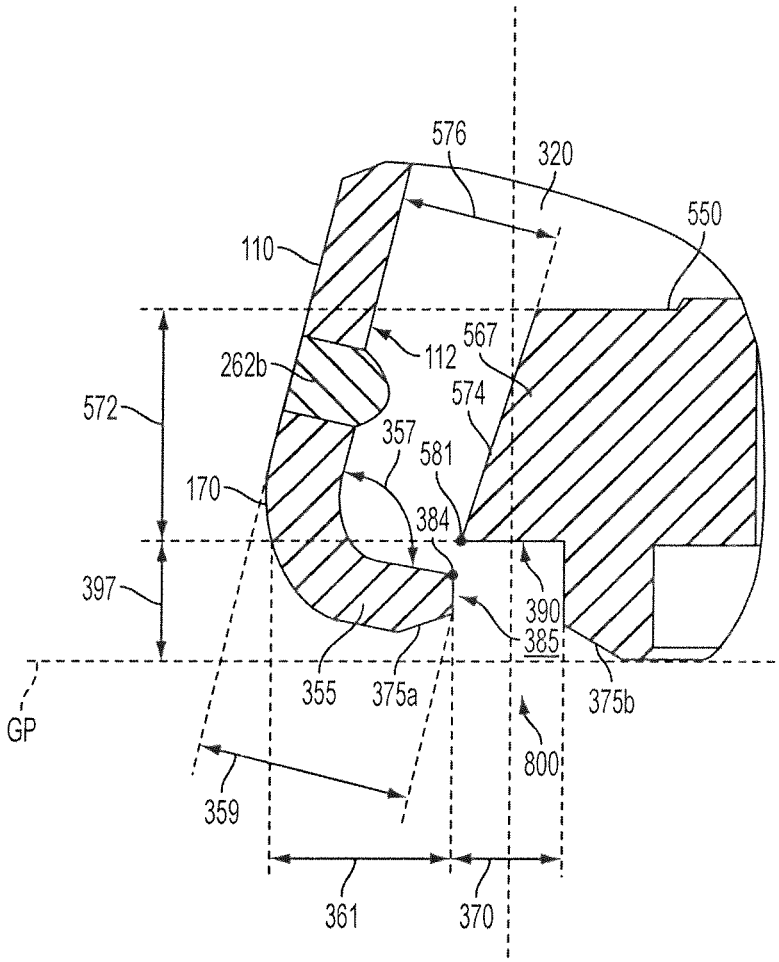
FIG. 8 is a detail view of detail 8 of FIG. 7.

As can be seen with reference to FIG. 8, the CORF 800 is substantially the same for the current embodiment as for prior embodiments of this disclosure, in that various dimensions and surfaces are similar. However, there are some differences. Particularly, the weight pad 550 includes an overhang portion 567 that about fully covers the CORF 800 in the current embodiment. A thickness 572 of about 6.1 mm as measured in the direction of the z-axis 206 (not shown in the current view) is seen that is notably larger than the thickness 372. In various embodiments, the thickness 572 may be 5.5-7 mm. In various embodiments, the thickness 572 may be 4-10 mm. In various embodiments, the thickness 572 may be up to 12.5 mm. In the current embodiment, the overhang portion 567 includes a sloped end 574 that is about parallel to the face 110 (or, more appropriately, to the TFP 235, not shown in the current view). A separation distance 576 of about 4.5 mm is seen as the distance between the inner surface 112 of the face 110 and the sloped end 574 of the overhang portion 567 as measured orthogonal to the TFP 235. In various embodiments, the separation distance 576 may be 4-5 mm. In various embodiments, the separation distance 576 may be 3-6 mm. The overhang portion 567 includes a faceward most point 581 that is the point of the overhang portion 567 furthest toward the leading edge 170 as measured in the direction of the y-axis 207.

As previously discussed, a ratio of each of the offset distance 392, the offset to ground distance 393, and the vertical surface height 394 to the thickness 572 (or thickness 372) is less than or equal to 1. In the current embodiment, the ratio of each of the offset distance 392, the offset to ground distance 393, and the vertical surface height 394 to the thickness 572 is less than 0.5, or, in some embodiments, less than 0.33. In various embodiments, the CORF 300 may be characterized in terms of the termination surface to ground distance 397 to achieve the CORF mass density ratio as previously discussed. For the current embodiment, the CORF mass density ratio is less than about 0.55, and may be less than 0.40 in various embodiments, less than 0.50 in various embodiments, or less than 0.60 in various embodiments depending on the thickness of the overhang portion 567 and the features of the golf club head 500 that allow the termination surface to ground distance 397 to be minimized.

In the current embodiment, a weight of the golf club head 500 is about 215 grams and may be anywhere from 180 grams to 260 grams in various embodiments. In the current embodiment, the weight pad 550 makes up about 43%-44%, or about 93 grams, of the weight of the golf club head 500. In various embodiments, the weight pad 550 may be 35%-50% of the weight of the golf club head 500. As can be understood by one of skill in the art, locating as much mass at a particular location in a golf club head can have a dramatic effect on the location of the CG of a particular golf club head.

Figure 9:
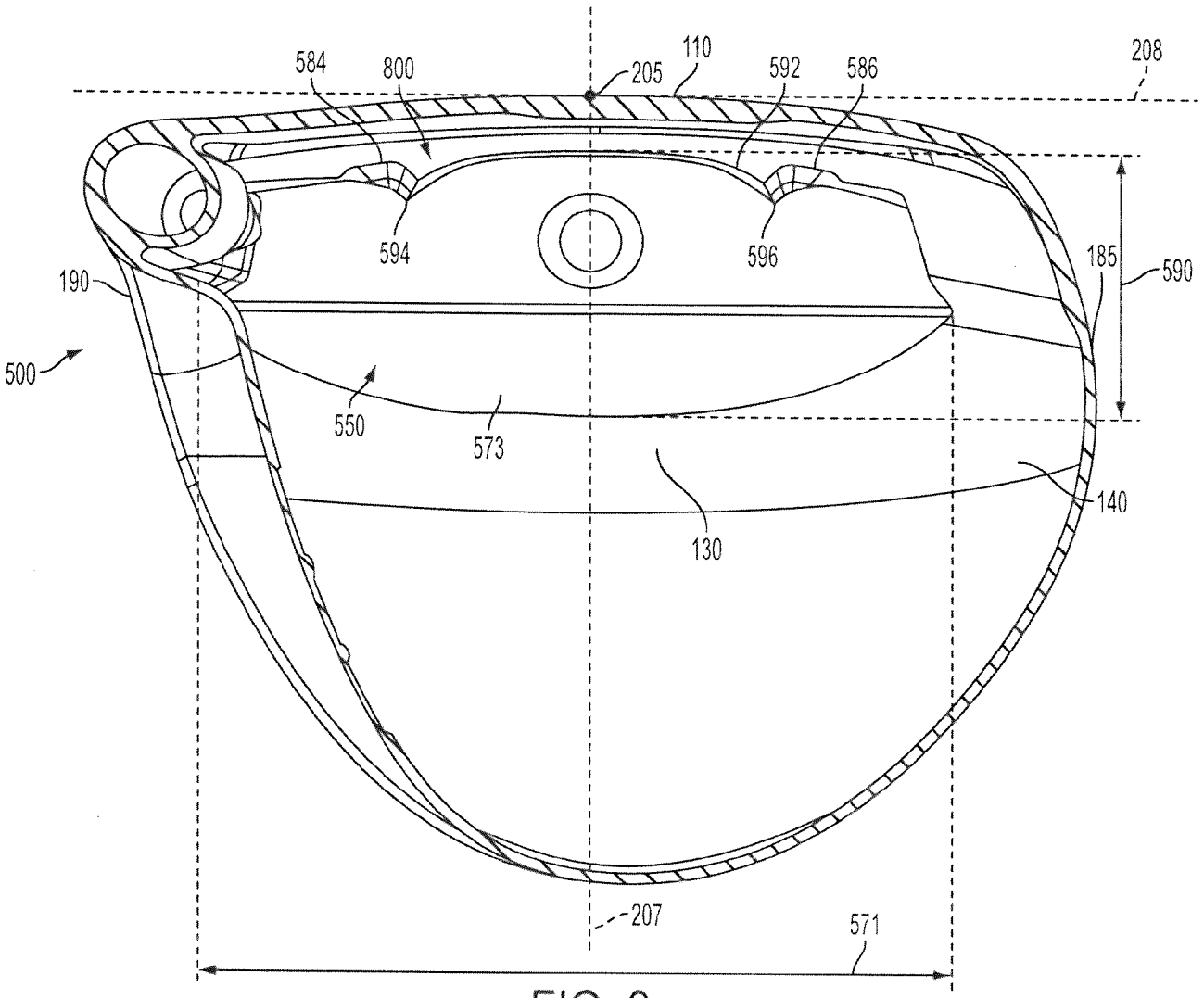
FIG. 9 is a cross-sectional view of the golf club head taken in the plane indicated by line 9-9 of FIG. 7.

As seen in FIG. 9, the golf club head 500 includes the weight pad 550. The weight pad 550 includes a dimension 571 that is the largest length of the weight pad 550 as measured along the x-axis 208. The dimension 571 is about 79.5 mm in the current embodiment. In various embodiments, the dimension 571 may be 75-85 mm. In various embodiments, the dimension 571 may be 70-90 mm. The weight pad 550 of the current embodiment extends to its edges where it contacts the skirt 140. In the current view, the area of contact between the weight pad 550 and the skirt 140 on the heel 190 is out of view. The location of contact is as measured. Also, the weight pad 550 of the current embodiment does not terminate at the skirt 140 for all its ends. In the current embodiment, end 573 terminates into an inner surface of the sole 130.

Figure 10:
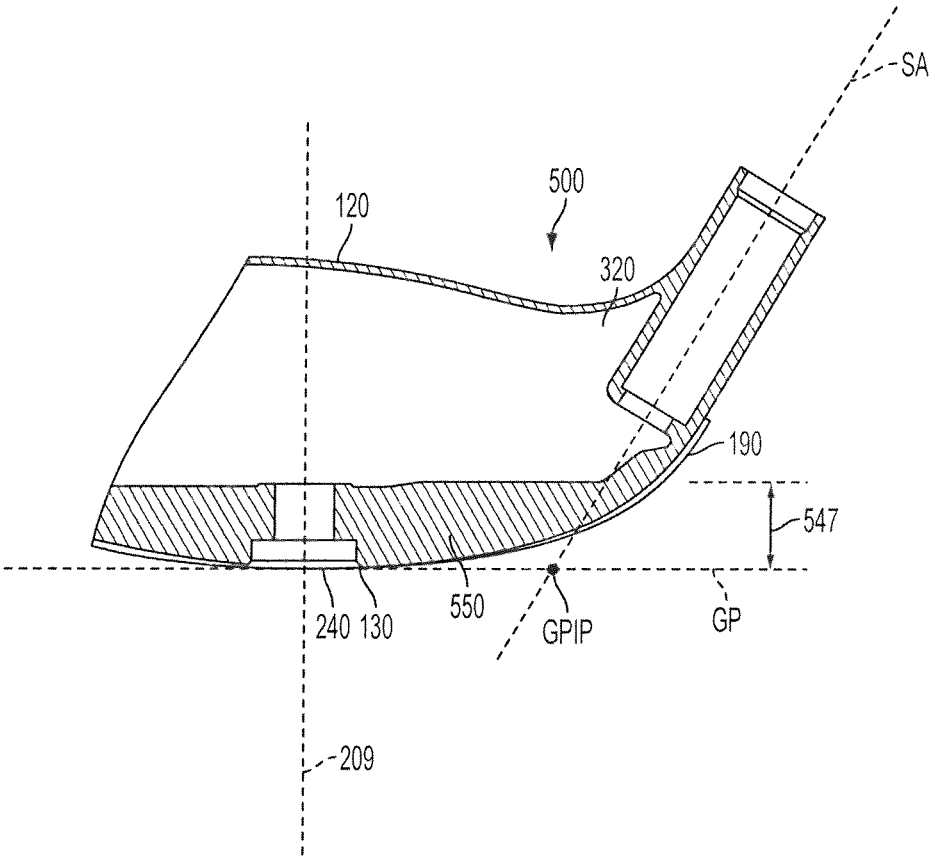
FIG. 10 is a cross-sectional view of the golf club head taken in the plane indicated by line 10-10 of FIG. 7.

A heel stress relief pad 584 and a toe stress relief pad 586 can be seen proximate the ends 434,436 of the CORF 300 beneath the overhang portion 567. The stress relief pads 584,586 are regions of increased thickness of material to prevent cracking of the CORF 300 in various embodiments. Because the weight pad 550 overhangs the CORF 300, regions of the weight pad 550 in proximity to the CORF 300 need not be substantially reinforced as may have been seen in prior embodiments. A face end 592 of the weight pad 550 (including the sloped end 574) generally follows the curvature of the CORF 300 in the current embodiment. Indentations 594,596 of the face end 592 occur proximate the ends 434,436 of the CORF 300. Otherwise, the face end 592 of the weight pad 550 generally follows the curvature of the face 110. A further view of the golf club head 500 is seen in FIG. 10.

Figure 11:
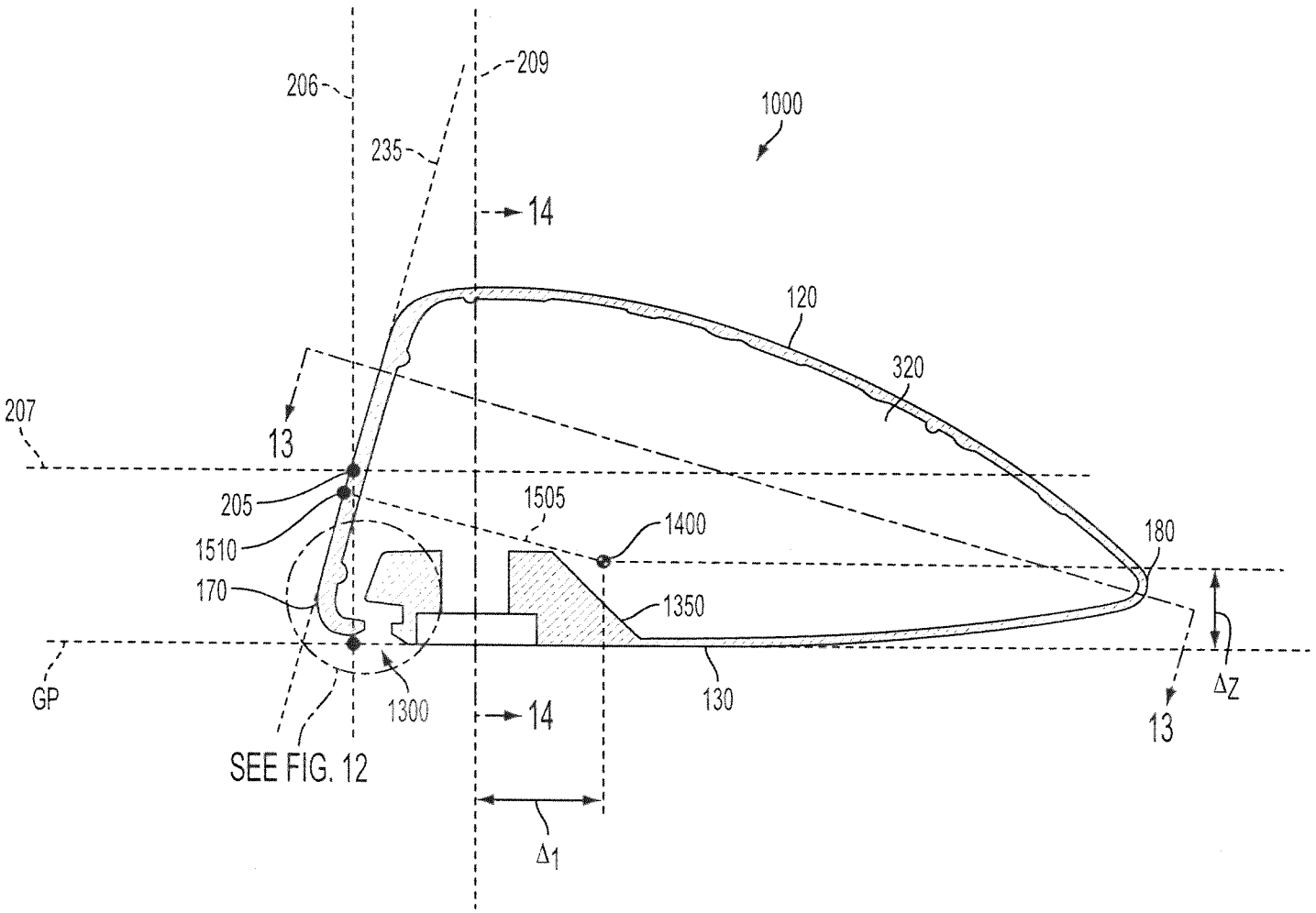
FIG. 11 is a cross-sectional view of a golf club head in accord with one embodiment of the current disclosure as would be shown along the plane indicated by line 2-2 of FIG. 1D.

Another embodiment of a golf club head 1000 is shown in FIG. 11. The golf club head 1000 is substantially similar to golf club head 500 in shape and features. There are some substantial differences. However, as stated previously, for the sake of simplicity of the disclosure, where features are similarly drawn and/or identified with common reference identifiers, one of skill in the art would understand that the features of one embodiment may be included in another embodiment where the inclusion of such features would not contradict other elements of the disclosure. Even where reference identifiers are not included in the several exemplary embodiments described herein, one of skill in the art would understand that similarly drawn features are intended to be consistent amongst the several embodiments except wherein the disclosure contradicts such assumption or for which such assumption would be antithetical so some explicit disclosure.

In the current embodiment, the golf club head 1000 includes a CG 1400, which is set at $\Delta_z$ and $\Delta_1$, which projection 1505 and projection point 1510. In the current embodiment, CG 1400, $\Delta_z$, $\Delta_1$, projection 1505, and projection point 1510 are all about the same as CG 600, $\Delta_z$, $\Delta_1$, projection 505, and projection point 510 for golf club head 500 as previously described with reference to FIG. 7, although such features of the current embodiment may be nominally different. The weight pad 1350 is about the same mass as the weight pad 550, although various features of the weight pad 550 are different, as will be described below. The golf club head 1000 includes CORF 1300, which includes many features consistent with CORF 800 and CORF 300.

Figure 12:
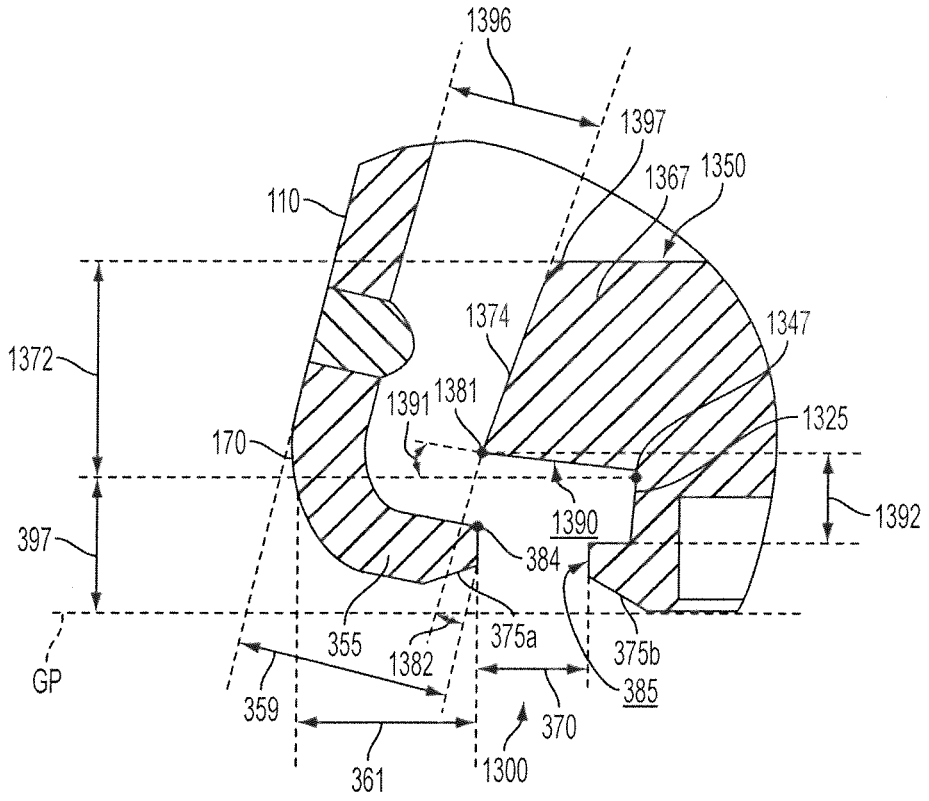
FIG. 12 is a detail view of detail 12 of FIG. 11.

As seen with reference to FIG. 12, the CORF 1300 of the current embodiment is shaped similarly to the CORF 800. There are several substantial differences. First, the CORF 1300 includes a retention feature 1325. The retention feature 1325 in the current embodiment is a channel defined in the weight pad 1350. The retention feature 1325 is defined by The retention feature 1325 follows the general contour of the CORF 1300. A termination surface 1390 is seen in the current view. The termination surface 1390 is disposed at an angle 1391 with respect to the direction of the y-axis 207 (not shown in FIG. 12). The weight pad 1350 includes an overhang portion 1367 which has a sloped end 1374. The sloped end 1374 is disposed at an angle 1396 with respect to an inner surface of the face 110. A fillet 1397 is seen at a top edge of the overhang portion 1367. A thickness 1372 of the overhang portion 1367 measured in the direction of the z-axis 206 is about 5.4 mm and is the largest thickness of the overhang portion 1367 because the angle 1391 causes the overhang portion 1367 to taper. In various embodiments, the thickness 1372 may be 5.5-7 mm. In various embodiments, the thickness 1372 may be 4-8 mm. In various embodiments, the thickness 1372 may be up to 12.5 mm.

As previously discussed, a ratio of the offset distance 1392 to the thickness 1372 (or thicknesses 372,572) is less than or equal to 1. In the current embodiment, the ratio of the offset distance 1392 to the thickness 1372 is less than 0.5. In various embodiments, this ratio may be less than 0.4. In various embodiments, this ratio may be less than 0.33. In various embodiments, the CORF 300 may be characterized in terms of the termination surface to ground distance 397 to achieve the CORF mass density ratio as previously discussed. In the current embodiment, the termination surface to ground distance 397 is measured from a lowest point 1347 of the termination surface. For the current embodiment, the CORF mass density ratio is less than about 0.55, and may be less than 0.40 in various embodiments, less than 0.50 in various embodiments, or less than 0.60 in various embodiments depending on the thickness of the overhang portion 567 and the features of the golf club head 500 that allow the termination surface to ground distance 397 to be minimized.

Unlike in prior embodiments, the overhang portion 1367 includes a substantial overhang 1382 as measured orthogonal to the TFP 235 from a faceward most point 1381 of the overhang portion 1397 to an end of the first sole portion 1355. The faceward most point 1381 is the point of the overhang portion 1367 furthest toward the leading edge 170 as measured in the direction of the y-axis 207. The overhang 1382 is about 0.75 mm in the current embodiment. In various embodiments, the overhang 1382 may be 0.5-1.5 mm. Because of the substantial overhang 1382, the angle 1391 allows for flow of the relatively viscous polyurethane plugging material into the CORF 1300 upon injection.

As previously described (particularly with reference to CORF 300), the golf club heads of the current disclosure (golf club head 100, golf club head 500, golf club head 1000) include a plugging material injected into the CORF 300, 800, 1300. The plugging material may be various materials in various embodiments depending upon the desired performance. In the current embodiment, the plugging material is polyurethane, although various relatively low modulus materials may be used, including elastomeric rubber, polymer, various rubbers, foams, and fillers. In the current embodiment, the plugging material is a polyurethane reactive adhesive. The plugging material of the current embodiment is applied at 250° F. The plugging material of the current embodiment has a viscosity of 16,000 cps, although in various embodiments the plugging material may be of a viscosity of 7,000-16,000 cps, and in various embodiments may be up to 20,000 cps. The plugging material of the current embodiment has a Shore D hardness of 47. In various embodiments, the Shore D hardness may be 45-50. In various embodiments, the Shore D hardness may be 35-55. The plugging material of the current embodiment has a modulus of 3,300 psi. In various embodiments, the modulus may be 2,850-5,600 psi. The plugging material of the current embodiment has an ultimate tensile strength of 3,200 psi. In various embodiments, the plugging material may have an ultimate tensile strength of 2,750-3,900 psi. The plugging material of the current embodiment may have an elongation at break of 600-860%. The ranges cited apply to plugging materials of the current embodiment. As stated in this disclosure, various materials may be used as plugging materials and have properties outside of those listed with respect to the current embodiment. Should design goals change, it may be appropriate to change plugging materials to achieve desired design goals.

The plugging material should not substantially prevent deformation of the golf club head 100, particularly of the face 110. In use, golf club heads of the current disclosure (golf club head 100, golf club head 500, golf club head 1000) experience peak forces of greater than 2,000 pounds. Under such environment, the face 110 of the club head deforms, as discussed previously with reference to COR. Because of the face 110 of the golf club heads of the current disclosure (golf club head 100, golf club head 500, golf club head 1000) include roll and bulge radii, deformation of the face 110 causes the edges to expand. Particularly in the region of the CORFs 300, 800, 1300, this causes the first sole portion 355 to expand downward in the direction of the z-axis 206 (not shown in FIG. 12). As such, the first sole portion 355 travels away from the termination surface 1390.

In some embodiments and combination of materials, the plugging material may become loosened upon the deformation of the face 110 and, particularly, upon the deformation of the first sole portion 355. As such, the retention feature 1325 creates a void into which the plugging material may flow, creating a mechanical interference to prevent the plugging material from becoming removed from the CORF 1300. In various embodiments, the retention feature 1325 may be various shapes, sizes, and/or include various features to redistribute mass, to aid in manufacturability, or to improve coupling with the plugging material. Also, an offset distance 1392 as measured in the direction of the z-axis 206 between the faceward most point 1381 and the low point 384 is greater than seen in prior embodiments, and may be about 2.3 mm in various embodiments. In various embodiments, the offset distance 1392 may be 1-3 mm. In various embodiments, the offset distance 1392 may be as little as 0.5 mm and up to about 12.5 mm. It should be noted that, because the plugging material may be viscous, in various embodiments the plugging material may not entirely fill the CORF (300, 800, 1300) and/or the retention feature 1325. In various embodiments, the plugging material may entirely fill the CORF (300,800,1300) and/or the retention feature 1325. However, the various features are included to at least partially retain the plugging material.

Figure 13:
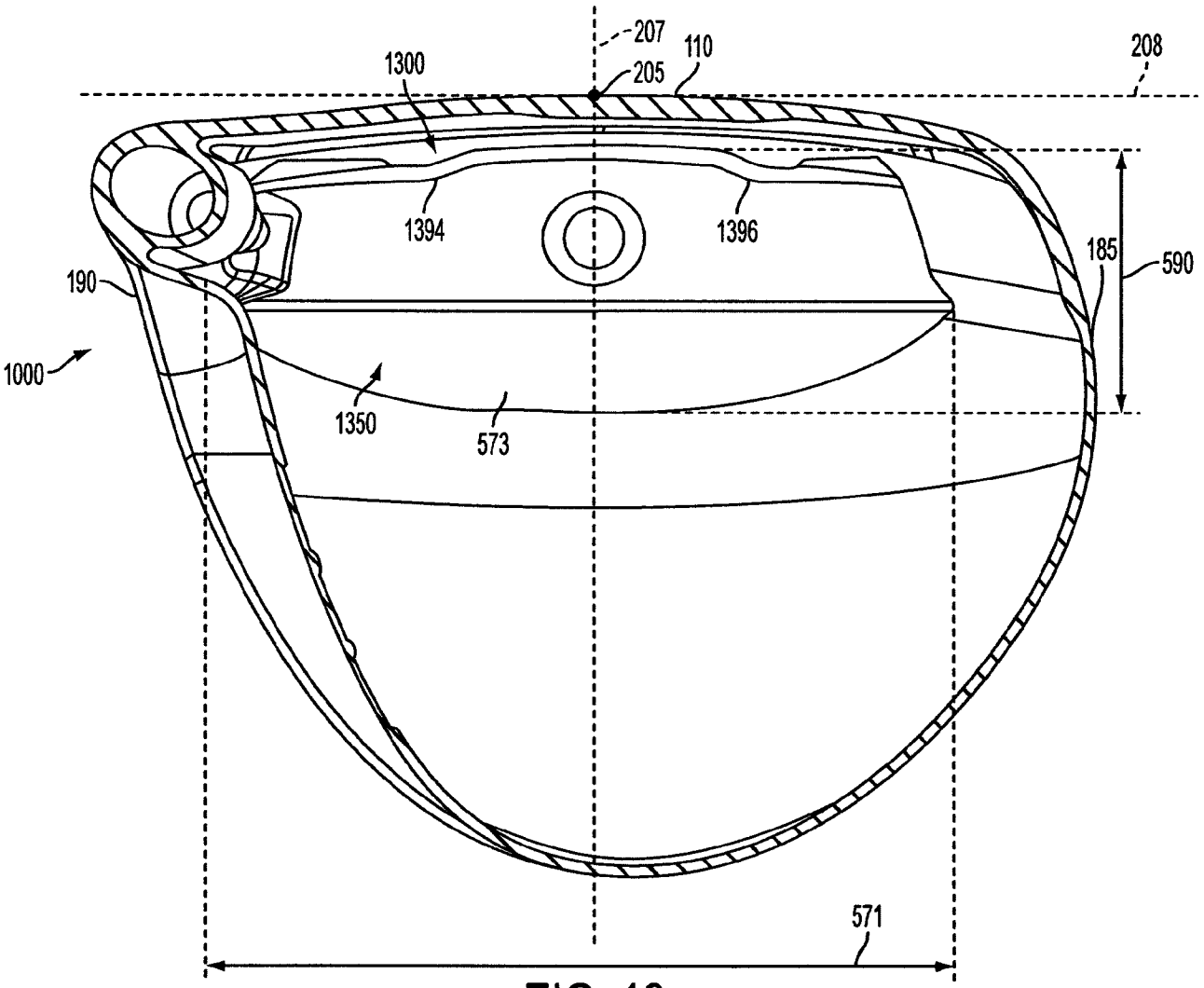
FIG. 13 is a cross-sectional view of the golf club head taken in the plane indicated by line 13-13 of FIG. 11.
Figure 14:
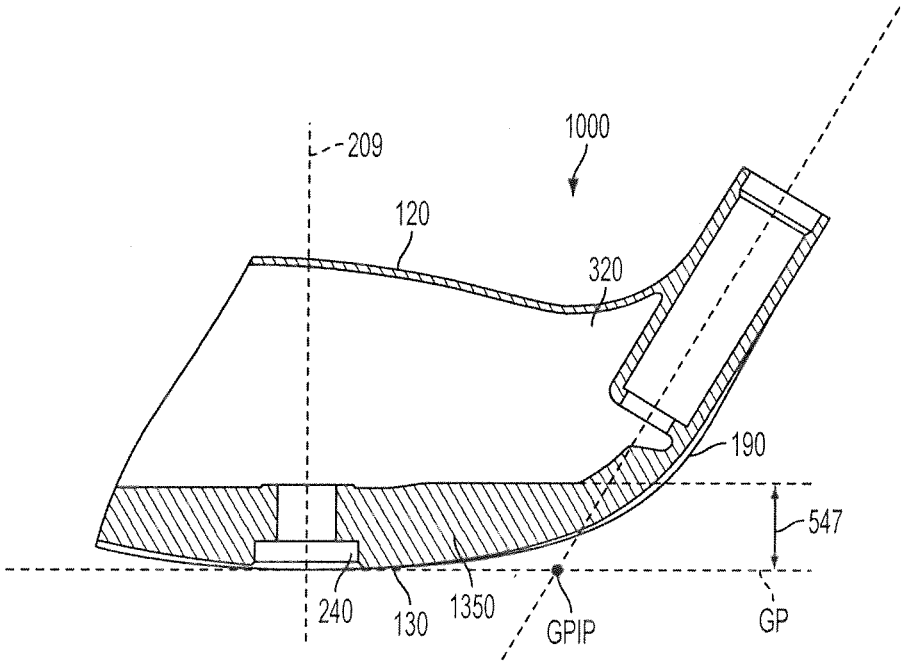
FIG. 14 is a cross-sectional view of the golf club head taken in the plane indicated by line 14-14 of FIG. 11.

With reference to FIG. 13, the weight pad 1350 of the current embodiment includes similar general dimensions to weight pad 550. The weight pad 1350 includes indentations 1394,1396 that are not as substantial as indentations 594, 596. Another view of the golf club head is seen in FIG. 14.

Figure 15:
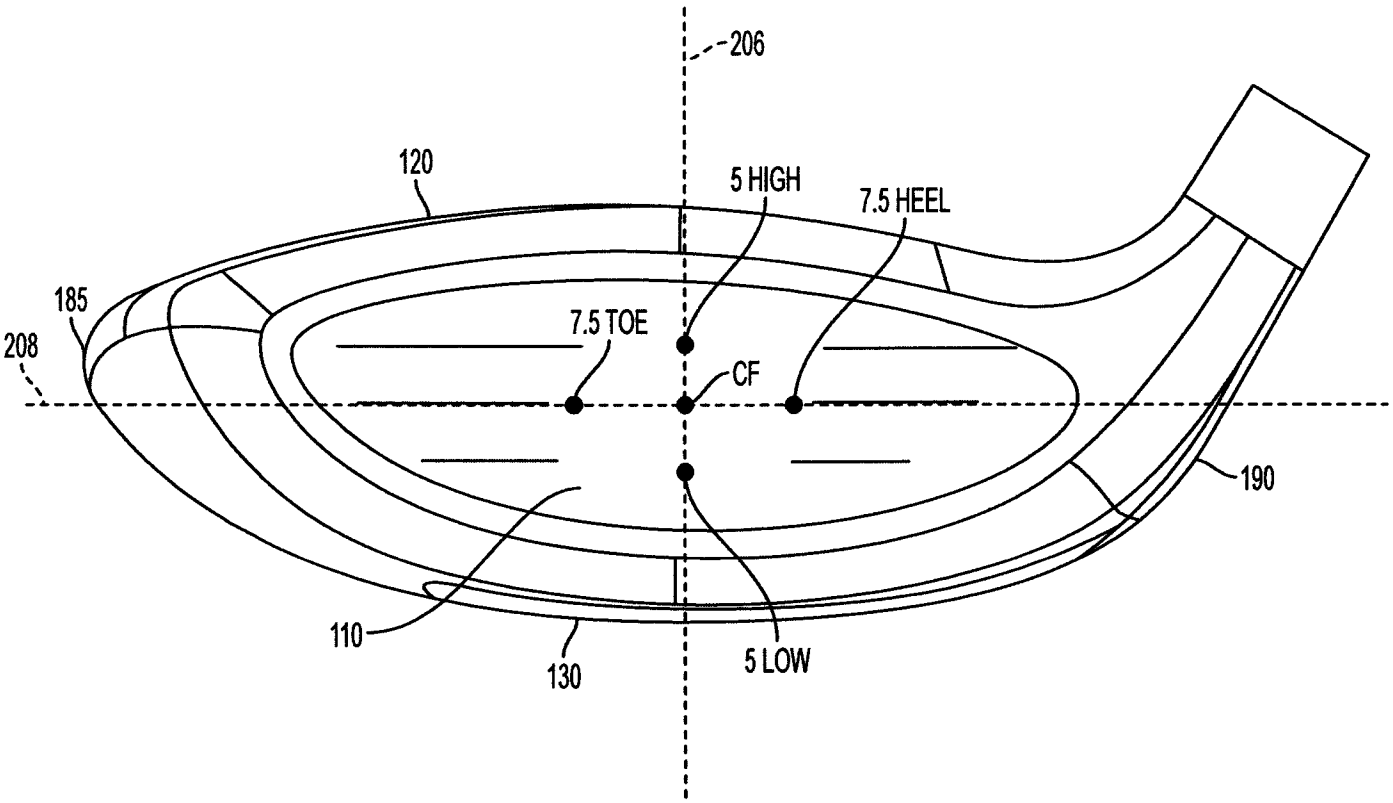
FIG. 15 is a face side view of a golf club head of the current disclosure illustrating locations of COR testing.

In at least one example test, the CORF 300 and other CORFs of the current disclosure were compared with golf club heads that were identical but did not have a CORF. As seen with reference to FIG. 15, golf club heads of the current disclosure (golf club head 100, golf club head 500, golf club head 1000) with CORFs (CORF 300, CORF 800, CORF 1300) were tested for COR against identical heads without CORFs. Impacts tested for COR were measured at locations at the CF (CF), 5 mm above the CF (5 High) in the TFP 235, 5 mm below the CF (5 Low) in the TFP 235, 7.5 mm toward the heel from the CF (7.5 Heel) in the TFP 235 and along the x-axis 208, and 7.5 min toward the toe from the CF (7.5 Toe) in the TFP 235 and along the x-axis 208. COR data gathered showed the changes in COR for each location from standard as measured below.

| Test 1 | | | |
|---|---|---|---|
| Position | No CORF | CORF | Change |
| CF | 0.794 | 0.811 | 0.017 |
| 5 High | 0.782 | 0.798 | 0.016 |
| 5 Low | 0.761 | 0.79 | 0.029 |
| 7.5 Heel | 0.772 | 0.794 | 0.022 |
| 7.5 Toe | 0.777 | 0.785 | 0.008 |
| Average | 0.777 | 0.796 | 0.018 |

| Test 2 | | | |
|---|---|---|---|
| Position | No Slot | MR Slot | Change |
| CF | 0.79 | 0.806 | 0.016 |
| 5 High | 0.785 | 0.798 | 0.013 |
| 5 Low | 0.764 | 0.779 | 0.015 |
| 7.5 Heel | 0.766 | 0.789 | 0.023 |
| 7.5 Toe | 0.773 | 0.789 | 0.016 |
| Average | 0.776 | 0.792 | 0.017 |

As can be seen, the inclusion of CORFs of the current disclosure (CORF 300, CORF 800, CORF 1300) provided increased COR at all locations of the face and more consistent COR from strikes in the CF to off-center strikes.

Figure 16B:
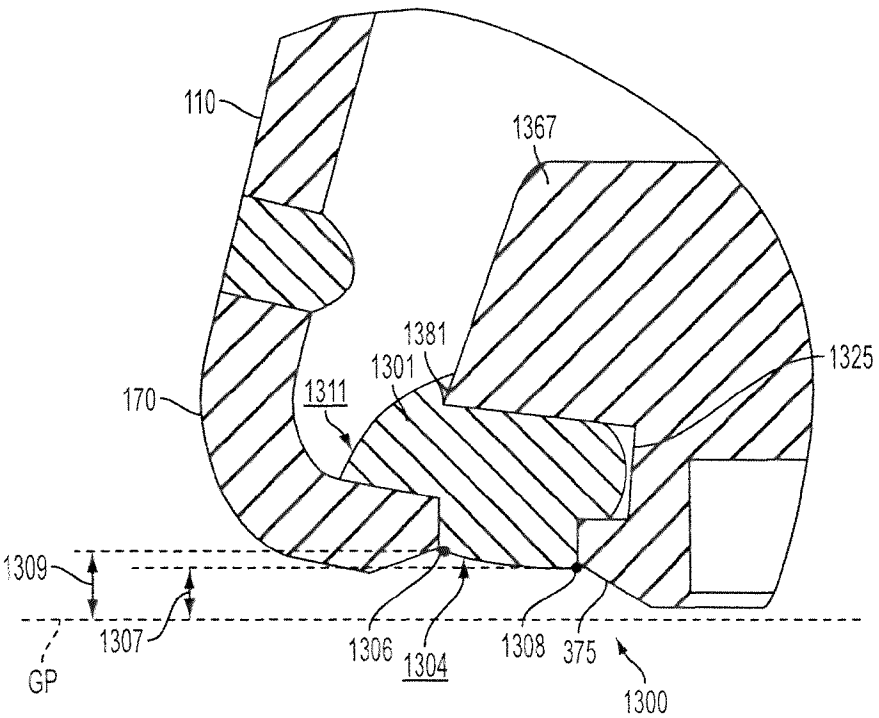
FIG. 16B is the detail view of FIG. 12 including plugging material located in a coefficient of restitution feature in accord with one embodiment of the current disclosure.
Figure 16A:
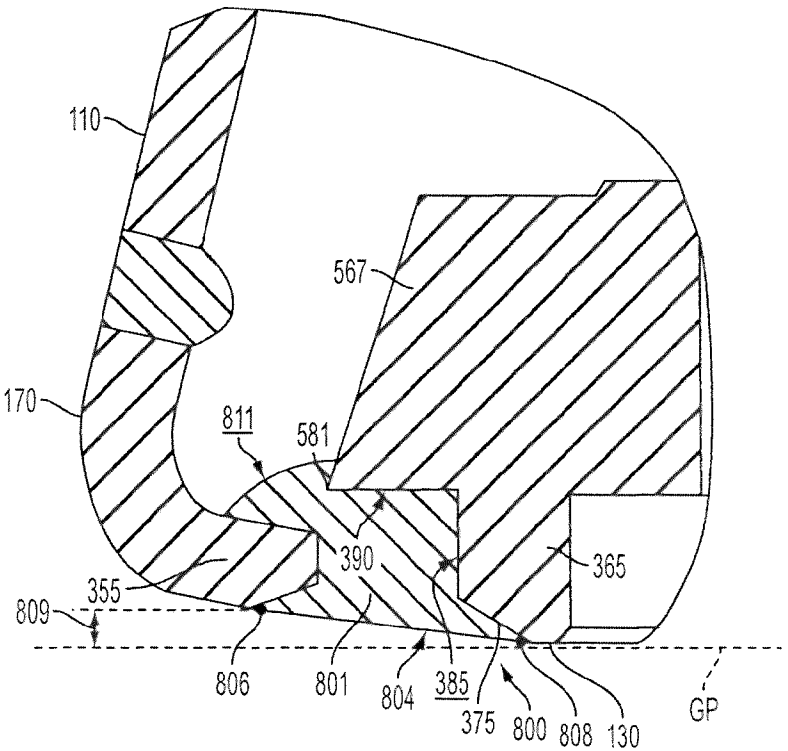
FIG. 16A is the detail view of FIG. 8 including plugging material located in a coefficient of restitution feature in accord with one embodiment of the current disclosure.
Figure 17A:
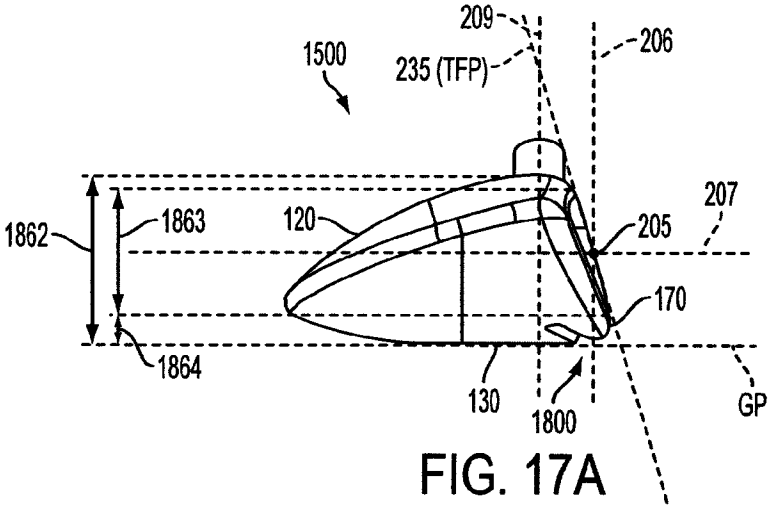
FIG. 17A is a toe side view of a golf club head in accord with one embodiment of the current disclosure.
Figure 17C:
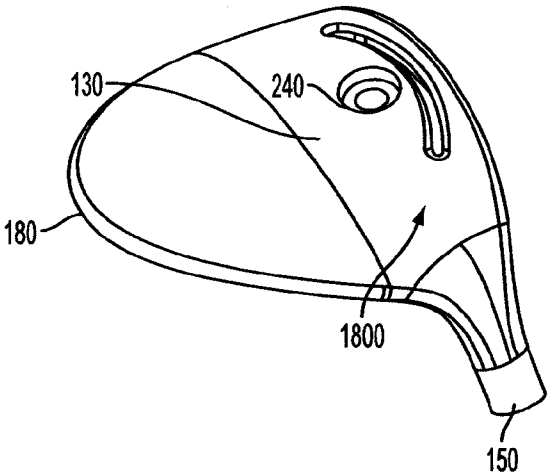
FIG. 17C is a perspective view of the golf club head of FIG. 17A.
Figure 17B:
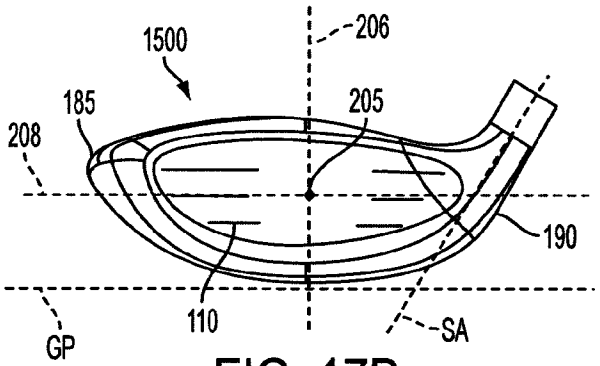
FIG. 17B is a face side view of the golf club head of FIG. 17A.
Figure 17D:
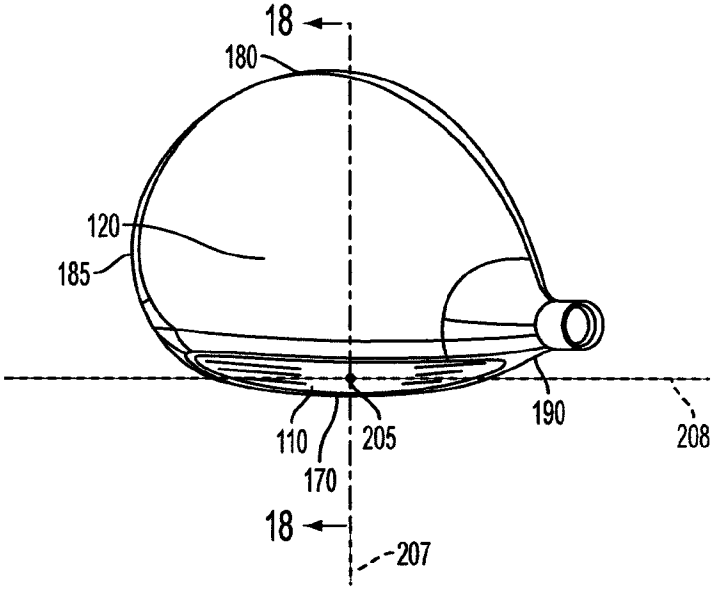
FIG. 17D is a top view of the golf club head of FIG. 17A.

As seen in FIGS. 16A and 16B, plugging material 801, 1301 is found in CORFs 800,1300, respectively. The plugging material 801,1301 may be molded in place, injected into the CORFs 800,1300, or otherwise placed in the CORFs 800,1300, among other possible assembly and manufacturing methods. As seen with reference to FIG. 16A, the plugging material 801 is placed in the CORF 800 such that an outer surface 804 is about flush with a surface of the sole 130, with a first end 806 about flush with the first sole portion 355 and a second end 808 about flush with the first weight pad portion 365 and almost in contact with the GP. The first end 806 is disposed at a distance 809 above the ground of about 0.72 mm that is about consistent with an outer surface of the first sole portion 355. The distance 809 may be 0.5-1.0 mm in various embodiments. The distance 809 may be 0-1.5 mm in various embodiments. The distance 809 may be up to 2 mm in various embodiments. An inner surface 811 of the plugging material 801 extends beyond the faceward most point 581, which helps provide surface are and mechanical retention properties. In various embodiments, the plugging material 801 may not extend beyond the faceward most point 581 or may have another advantage associated with another configuration. As can be seen, the plugging material 801 of the current embodiment does not fully engage the transition of the vertical surface 385 to the termination surface 390, but instead there may be an air bubble between the plugging material 801 and the joint of the vertical surface 385 and the termination surface 390. In various embodiments, the plugging material fully engages the entirety of the CORF.

As seen with reference to FIG. 16B, the plugging material 1301 is placed in the CORF 1300 such that an outer surface 1304 is disposed inward from the surface of the sole 130. As contrasted with outer surface 804, outer surface 1304 includes a first end 1306 and a second end 1308 that are about flush with ends of the bevel 375. The first end 1306 is disposed at a distance 1309 above the GP that is about 1.30 mm. In various embodiments, the distance 1309 may be 1-2 mm. In various embodiments, the distance 1309 may be 0.5-1.5 mm. In various embodiments, the distance 1309 may be up to 4 mm. The second end 1308 is disposed at a distance 1307 above the GP that is about 0.92 mm. In various embodiments, the distance 1307 may be 0.75-1.5 mm. In various embodiments, the distance 1307 may be 0.5-2 mm. In various embodiments, the distance 1307 may be up to 3 mm. An inner surface 1311 of the plugging material 1301 extends beyond the faceward most point 1381, which helps provide surface are and mechanical retention properties. In various embodiments, the plugging material 1301 may not extend beyond the faceward most point 1381 or may have another advantage associated with another configuration.

As can be seen, the plugging material 1301 of the current embodiment has extended into the retention feature 1325. However, the plugging material 1301 of the current embodiment does not fully engage the retention feature 1325. Instead there may be various air bubbles between the plugging material 1301 and the CORF 1300. However, sufficient volume of plugging material 1301 has engaged the retention feature 1325 to provide benefits of retaining the plugging material 1301 inside the CORF 1300 even under extreme deformation of the face 110 and the golf club head 1000. In various embodiments, the plugging material fully engages the entirety of the CORF. One of skill in the art would understand that features and explanations related to FIGS. 16A and 16B may be interchanged between the two embodiments, and no one element should be considered to be binding on any embodiments of the current disclosure simply because of its depiction in one figure.

Another embodiment of a golf club head 1500 is seen in FIGS. 17A-17D and includes a number of features consistent with prior embodiments of golf club heads (100, 500, 1000) of the current disclosure. The golf club head 1500 includes a CORF 1800 that is a constant radius. In the current embodiment, the constant radius of the CORF 1800 is about 44 mm. In various embodiments, the constant radius may be 38-50 mm. In various embodiments, the constant radius may be 30-60 mm. In various embodiments, the constant radius may be less than 80 mm.

A crown height 1862 is shown and measured as the height from the GP to the highest point of the crown 120 as measured parallel to the z-axis 206. In the current embodiment, the crown height 1862 is about 41 mm. In various embodiments, the crown height 1862 may be 38-43 mm. In various embodiments, the crown height may be 30-50 mm. The golf club head 1500 also has an effective face height 1863 that is a height of the face 110 as measured parallel to the z-axis 206. In the current embodiment, the face height 1863 is about 39 mm. The face height 1863 may be 2-5 mm less than the crown height in various embodiments. The face height 1863 may be 1-10 mm less than the crown height in various embodiments. The face height 1863 measures from a highest point on the face 110 to a lowest point on the face 110 proximate the leading edge 170. A transition exists between the crown 120 and the face 110 such that the highest point on the face 110 may be slightly variant from one embodiment to another. In the current embodiment, the highest point on the face 110 and the lowest point on the face 110 are points at which the curvature of the face 110 deviates substantially from a roll radius. In some embodiments, the deviation characterizing such point may be a 10% change in the radius of curvature. Finally, an effective face position height 1864 is a height from the GP to the lowest point on the face 110 as measured in the direction of the z-axis 206. In the current embodiment, the effective face position height 1864 is 1 mm. In various embodiments, the effective face position height 1864 may be 0-4 mm.

Figure 18:
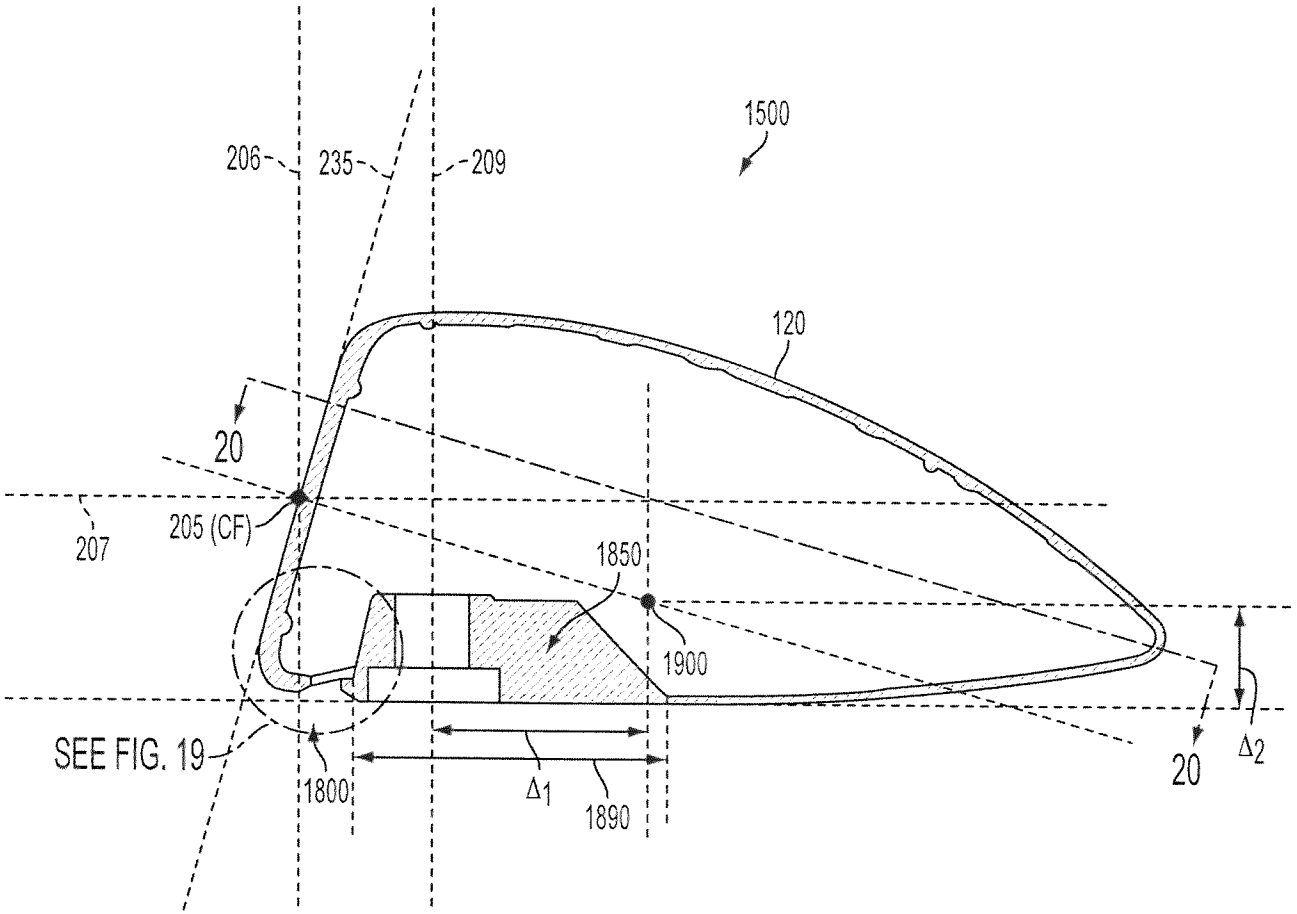
FIG. 18 is a cross-sectional view of the golf club head taken in the plane indicated by line 18-18 in FIG. 17D.

As seen with reference to FIG. 18, the golf club head 1500 includes a weight pad 1850. The weight pad 1850 distributes weight similarly to prior embodiments. However, the weight pad 1850 does not have an overhang portion. Although a length 1890 of the weight pad 1850 is about the same as the length 590, the weight pad 1850 does not include an overhang portion, so the center of the weight pad 1850 is located further rearward in the golf club head 1500. As such, a location of a CG 1900 is further back and higher than in similar prior embodiments. $\Delta_1$ and $\Delta_z$ are larger for the golf club head 1500 than for golf club head 500 and 1000. A projection point of the CG 1900 onto the TFP 235 is about at the origin 205 (at CF). A thickness of the CORF 1800 is about the same as for CORF 800 and CORF 1300. It should be noted that the origin 205 (at CF) of the current embodiment is farther from the GP than the origin 205 of prior embodiments because the crown height 1862 is larger than the crown height 162.

Figure 19:
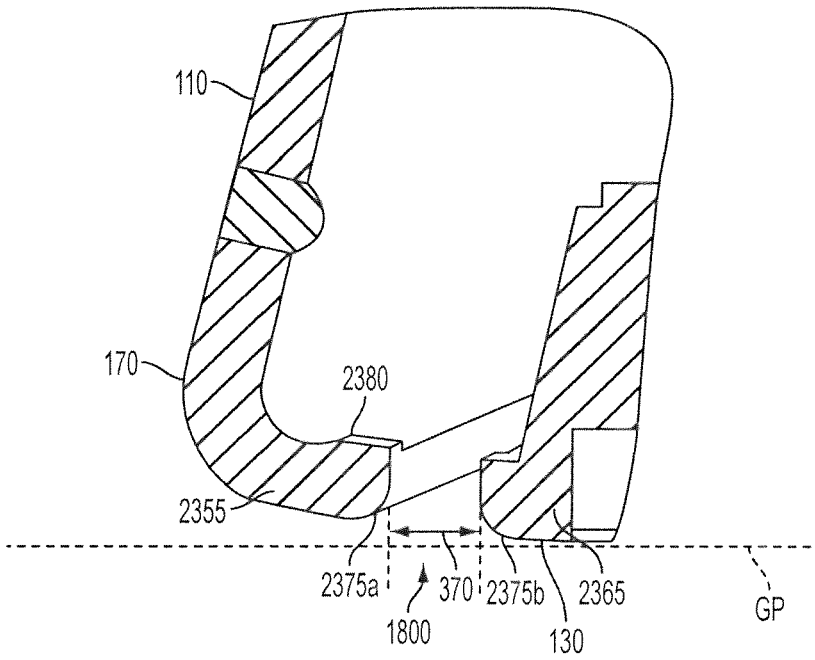
FIG. 19 is a detail view of detail 19 of FIG. 18.

As seen with reference to FIG. 19, the CORF 1800 includes several features not seen in prior embodiments. A first sole portion 2355 extends toward and defines the CORF 1800. The CORF 1800 is defined on its other end by a first weight pad portion 2365. As can be seen, a radiused edge 2375 (shown as 2375*a,b*) of the CORF 1800 is included in the current embodiment. The first sole portion 2355 includes an inner ledge portion 2380 that is a thickened region or boss of the first sole portion 2355.

Figure 20:
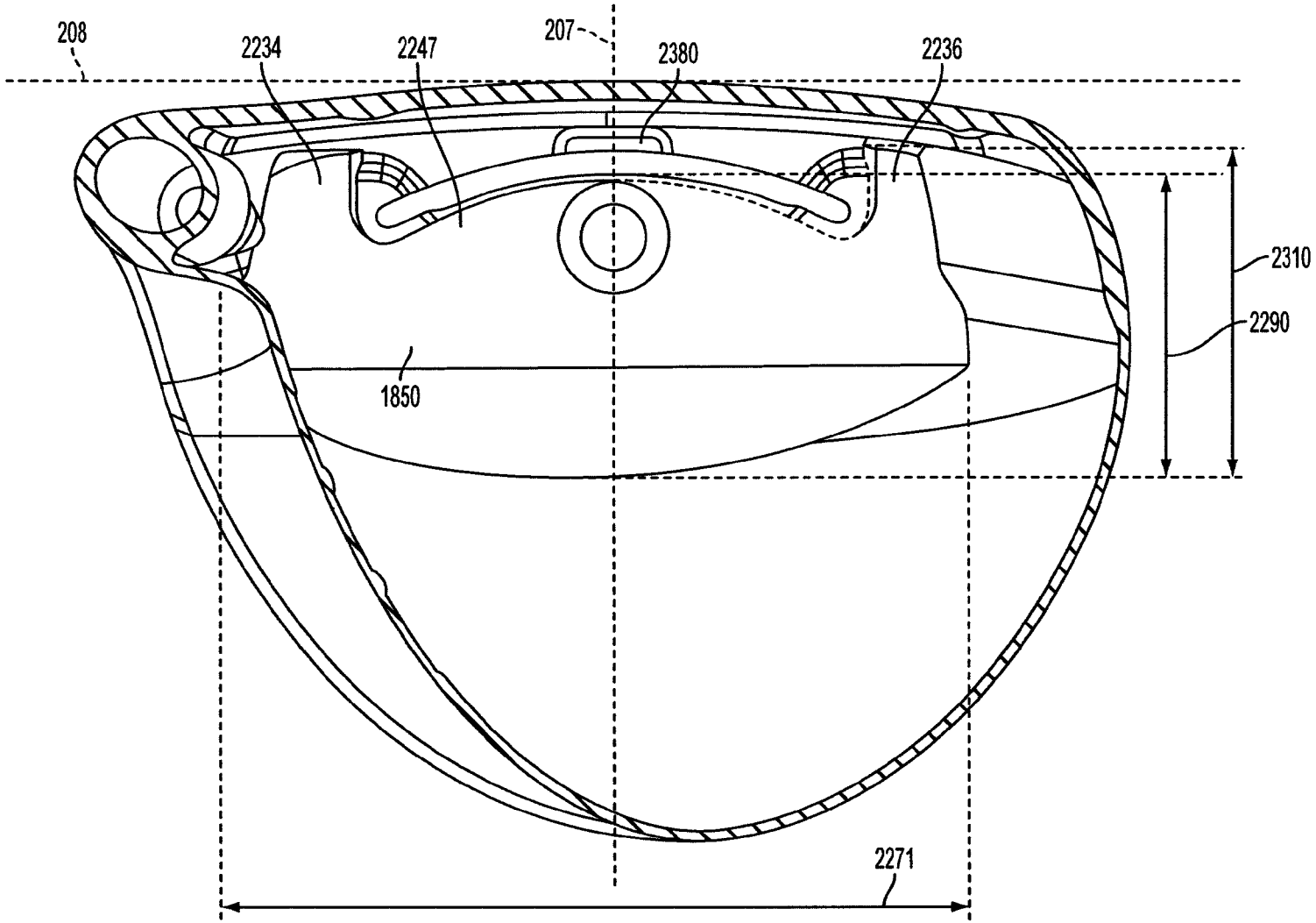
FIG. 20 is a cross-sectional view of the golf club head taken in the plane indicated by line 20-20 of FIG. 18.

The weight pad 1850 is disposed further rearward in the golf club head 1500 of the current embodiment, as seen with reference to FIG. 20. A length 2290 of the weight pad 1850 is about 20 mm in the current embodiment and is a little bit less than the length 590. In various embodiments, the length 2290 may be 18-24 mm. In various embodiments, the length 2290 may be 12-30 mm. However, the weight pad 1850 of the current embodiment includes a heel extension 2234 and a toe extension 2236. A distance 2310 of the weight pad 1850 as measured to the heel extensions 2234 and the toe extension 2236 is about 22.5 mm in the current embodiment. In various embodiments, the distance 2310 may be 20-25 mm. In various embodiments, the distance may be 15-30 mm. The weight pad 1850 defines a CORF contour 2247. The CORF contour 2247 provides a void that about follows the curvature of the CORF 1800. A dimension 2271 of the weight pad 1850 is about 75 mm in the current embodiment, or a little less than the dimension 571. In various embodiments, the dimension 2271 may be 70-80 mm. In various embodiments, the dimension 2271 may be 60-85 mm.

Figure 21:
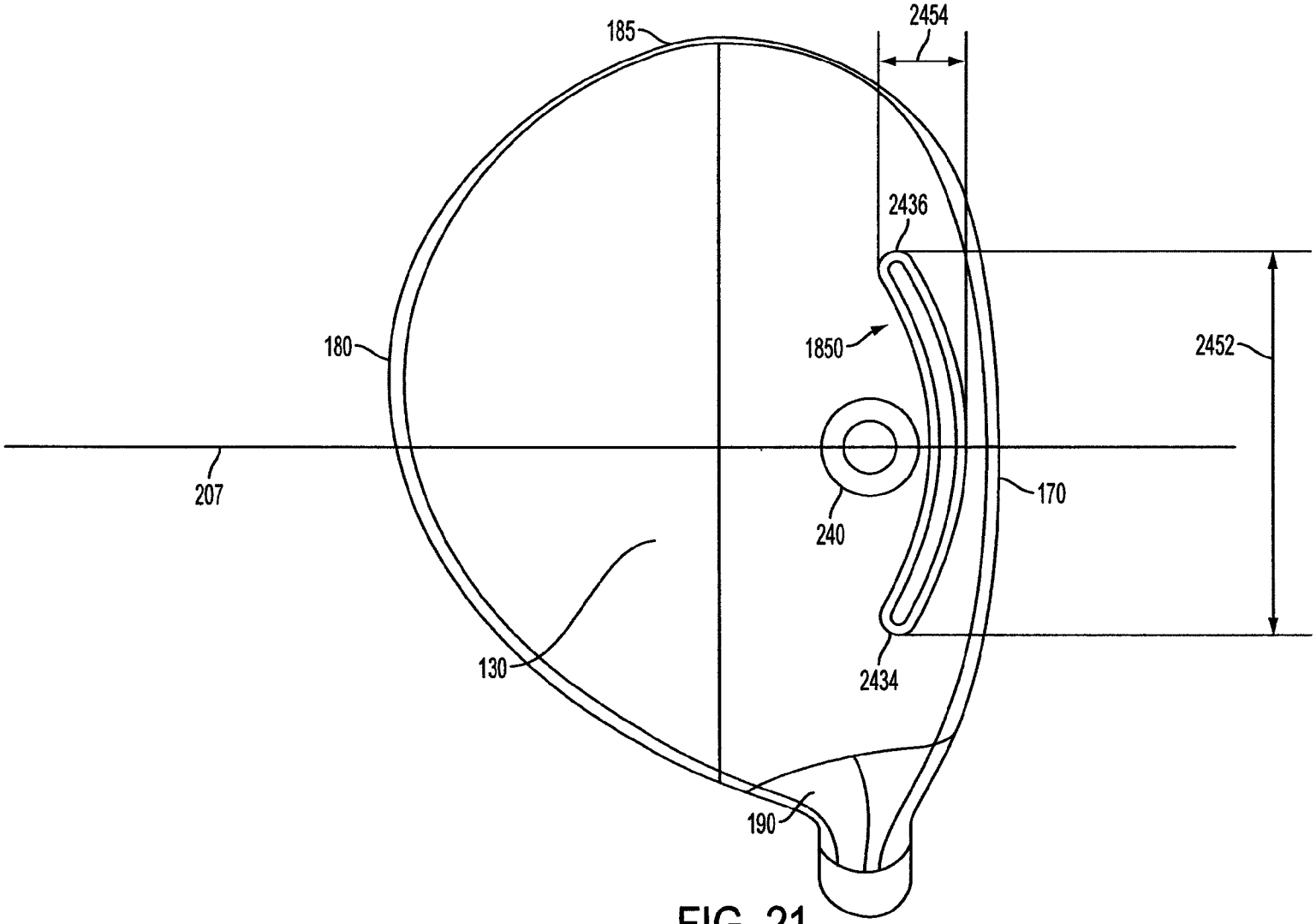
FIG. 21 is a bottom view of a golf club head in accord with one embodiment of the current disclosure.

General dimensions of the CORF 1800 are seen with reference to FIG. 21. A distance 2452 is shown between a toeward end 2436 and the heelward end 2434 as measured in the direction of the x-axis 208. In the current embodiment, the distance 2452 is 48-50 mm. In various embodiments, the distance 2452 may be 45-55 mm. In various embodiments, the distance 2452 may be 40-60 mm. In various embodiments, the distance 2452 may be larger or smaller than the range shown for the current embodiment. The CORF 1800 includes a distance 2454 as measured in the direction of the y-axis 207. In the current embodiment, the distance 2454 is 9-10 mm. In various embodiments, the distance 2454 may be 8-11 mm. In various embodiments, the distance 2454 may be 7-14 mm. In various embodiments, the distance may be larger or smaller than the range shown for the current embodiment.

In at least one example test, the CORF 1800 of the current disclosure was compared with golf club heads that were identical but did not have a CORF. Positions of the current test are as seen with reference to FIG. 15. Impacts tested for COR were measured at locations at the CF (CF), 5 mm above the CF (5 High) in the TFP 235, 5 mm below the CF (5 Low) in the TFP 235, 7.5 mm toward the heel from the CF (7.5 Heel) in the TFP 235 and along the x-axis 208, and 7.5 mm toward the toe from the CF (7.5 Toe) in the TFP 235 and along the x-axis 208. COR data gathered showed the changes in COR for each location from standard as measured below.

| Position | No Slot | CORF 1800 | Change |
|---|---|---|---|
| | | Test 1 | |
| CF | 0.799 | 0.814 | 0.015 |
| 5 High | 0.794 | 0.788 | −0.006 |
| 5 Low | 0.771 | 0.784 | 0.013 |
| 7.5 Heel | 0.793 | 0.797 | 0.004 |
| 7.5 Toe | 0.765 | 0.781 | 0.016 |
| Average | 0.784 | 0.793 | 0.008 |
| | | Test 2 | |
| CF | 0.791 | 0.810 | 0.019 |
| 5 High | 0.786 | 0.800 | 0.014 |
| 5 Low | 0.760 | 0.778 | 0.018 |
| 7.5 Heel | 0.782 | 0.795 | 0.013 |

-continued

| Position | No Slot | CORF 1800 | Change |
|---|---|---|---|
| 7.5 Toe | 0.756 | 0.786 | 0.030 |
| Average | 0.775 | 0.794 | 0.019 |

As can be seen, the inclusion of CORF 1800 provided increased COR at all locations of the face other than one location in one test. COR was also more consistent across the face.

An additional COR measurement was taken at the balance point of the golf club head 1500. The average numbers in the above chart did not take into account the measurements at the balance point, shown below.

| Position | No Slot | CORF 1800 | Change |
|---|---|---|---|
| | | Test 1 | |
| BP | 0.800 | 0.814 | 0.014 |
| | | Test 2 | |
| BP | 0.795 | 0.810 | 0.015 |

As seen with reference to the charts above, the CORF 1800 increased COR at virtually all positions on the face in each test.

Figure 22:
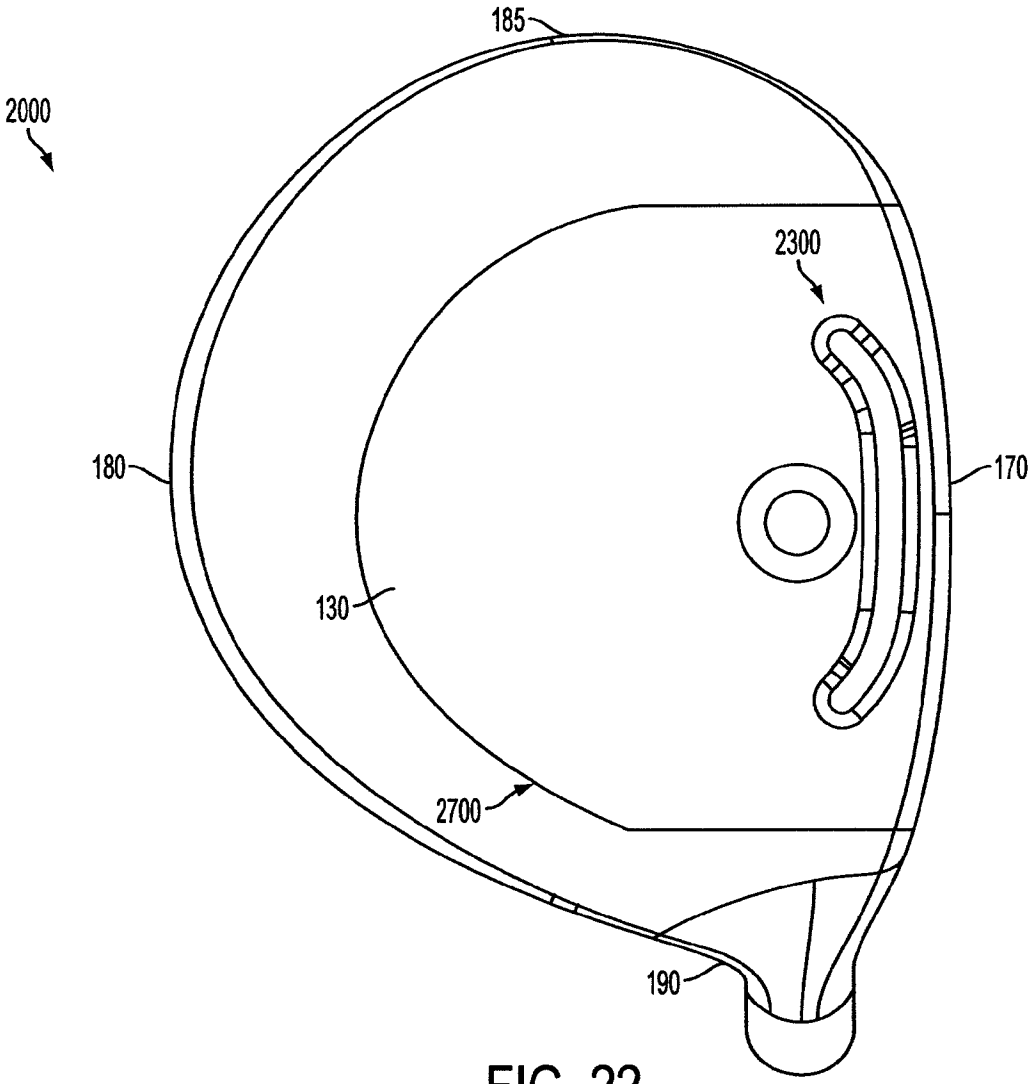
FIG. 22 is a bottom view of a golf club head in accord with one embodiment of the current disclosure.

Another embodiment of a golf club head 2000 is seen with reference to FIG. 22. The golf club head 2000 includes many features similar to other golf club heads (100, 500, 1000, 1500) of the current disclosure. The golf club head 2000, however, includes a sole wrap insert 2700 that includes the various features of the CORF 2300. In shape, the CORF 2300 is similar to the CORFs 300,800. However, CORF 2300 is included on a sole wrap insert 2700.

In many golf club heads, the face (such as face 110) is a part manufactured separately from the golf club body. The face is typically welded to the golf club body or otherwise joined in method suitable for striking a golf ball. In some golf club heads, the face may be of a different material than the golf club body. For example, to reduce costs, the golf club body may be made of a low quality steel while the face is made a high quality steel that can withstand impacts, even with thinner faces. In the embodiments of the current disclosure—and in embodiments that seek to implement CORFs such as those disclosed herein without such weight redistribution features described herein—it may be advantageous to construct a golf club head (such as golf club head 2000) with an insert that is welded to the golf club body that is not just a face insert but includes the CORF in a piece that wraps to the sole of the golf club head. One challenge in design of CORF is stress concentrations in various features of the CORFs. As previously mentioned, certain features as described in the current disclosure address stress concentrations in the CORF and in surrounding features to reduce and to eliminate potential for failure of the golf club head. In embodiments including the sole wrap insert 2700, the entirety of the face 110 through the sole 130 are of high-strength material typically used only for face inserts. For example, in one embodiment, a high nickel content steel alloy having a yield strength of 2,000 MPa with 11% elongation may be used to fabricate the sole wrap insert 2700, allowing for thinner construction with greater strength of material. The steel alloy includes a composition of about 18-19% nickel, about 8-9.5% cobalt, about 4.5-5.1% molybdenum, about 0.5-1.0% titanium, 0.05-0.15% aluminum, less than 0.10% of each of carbon, phosphorus, silicon, calcium, zirconium, manganese, sulfur, and boron, with the balance of the composition being of iron. The steel alloy used to fabricate the sole wrap insert 2700 can be a maraging steel having a high nickel content between 16%-20%. In other embodiments, a steel alloy having a nickel content of 14%-17% can be used. The steel alloy may be heat treated to achieve higher yield strength. The sole wrap insert 2700 is joined to 17-4 stainless steel—or various other types of material such as Custom 630 Steel by Carpenter®, Custom 455 by Carpenter®, and Custom 475 by Carpenter®—for the remainder of the golf club body. When comparing the body steel to the high strength sole wrap insert 2700 steel, the maximum ultimate tensile strength of the sole wrap insert 2700 steel at room temperature is greater than the maximum ultimate tensile strength of the body steel by about 20%-50% for any given heat treat. For example, the maximum ultimate tensile strength of the Custom 630 at room temperature is about 1365 MPa for any given heat treatment compared to 2000 MPa for the high nickel content steel described above. Thus, a 46% increase in maximum ultimate tensile strength at room temperature is achieved by the high nickel content steel. Similar benefits are seen when using a high strength or high performance titanium alloy sole wrap insert 2700 with a more traditional (and perhaps lower cost) titanium alloy golf club body. In various embodiments of the current disclosure, various materials described herein may be imported to the face 110 or the golf club body of the prior embodiments without the use of a sole wrap insert 2700.

The use of a high strength material in conjunction with a more traditional golf club head material has multiple advantages. The high strength material may be made thinner and may be capable of experiencing greater deflection on impact, especially if such material is not coupled to the golf club body in close proximity to the striking area. This allows for higher COR and use of less material than would be possible for a smaller face insert or a lower quality material. Second, the coupling to a lower cost material golf club body reduces overall cost while maintaining exceptional performance characteristics. In various embodiments, a sole wrap insert without a CORF may be used and may see some of the benefit associated with the current application.

Figure 23:
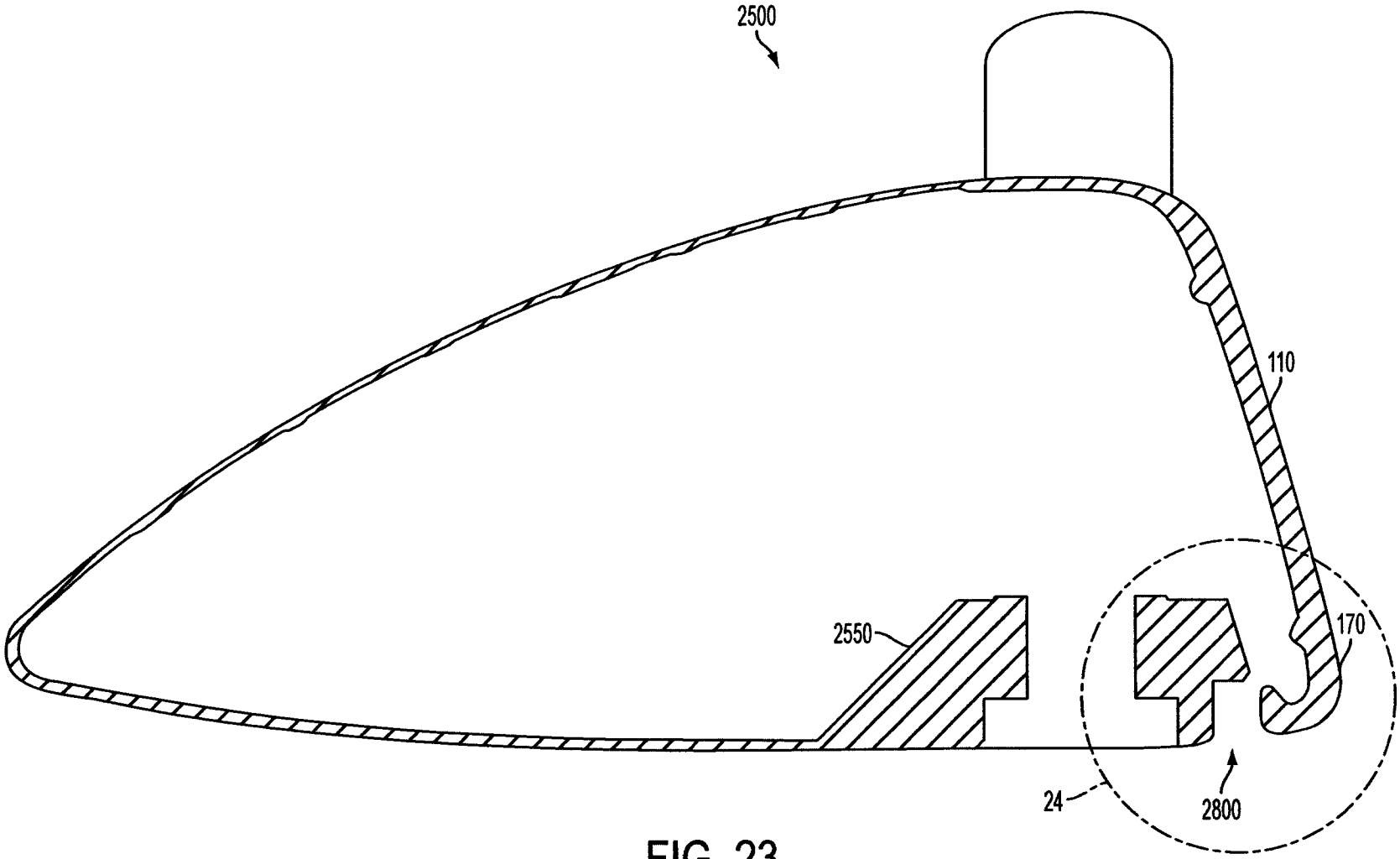
FIG. 23 is a cross-sectional view of a golf club head in accord with one embodiment of the current disclosure as would be shown along a plane taken in the reverse direction of view of the plane indicated by line 2-2 of FIG. 1D.

Another embodiment of a golf club head 2500 is shown in FIG. 23. The golf club head 2000 includes similar features to prior embodiments of golf club heads (100, 500, 1000, 1500, 2000) of the current disclosure. For the sake of simplicity of the disclosure, where features are similarly drawn and/or identified with common reference identifiers, one of skill in the art would understand that the features of one embodiment may be included in another embodiment where the inclusion of such features would not contradict other elements of the disclosure. Even where reference identifiers are not included in the several exemplary embodiments described herein, one of skill in the art would understand that similarly drawn features are intended to be consistent amongst the several embodiments except wherein the disclosure contradicts such assumption or for which such assumption would be antithetical so some explicit disclosure.

The golf club head 2500 includes CORF 2800. CORF 2800 is similar to prior embodiments of CORFs of the current disclosure (CORF 300, 800, 1300, 1800, 2300). The golf club head 2500 includes weight pad 2550 that is similar to prior embodiments of weight pads (350, 550, 1350,1850) of the current disclosure.

Figure 24:
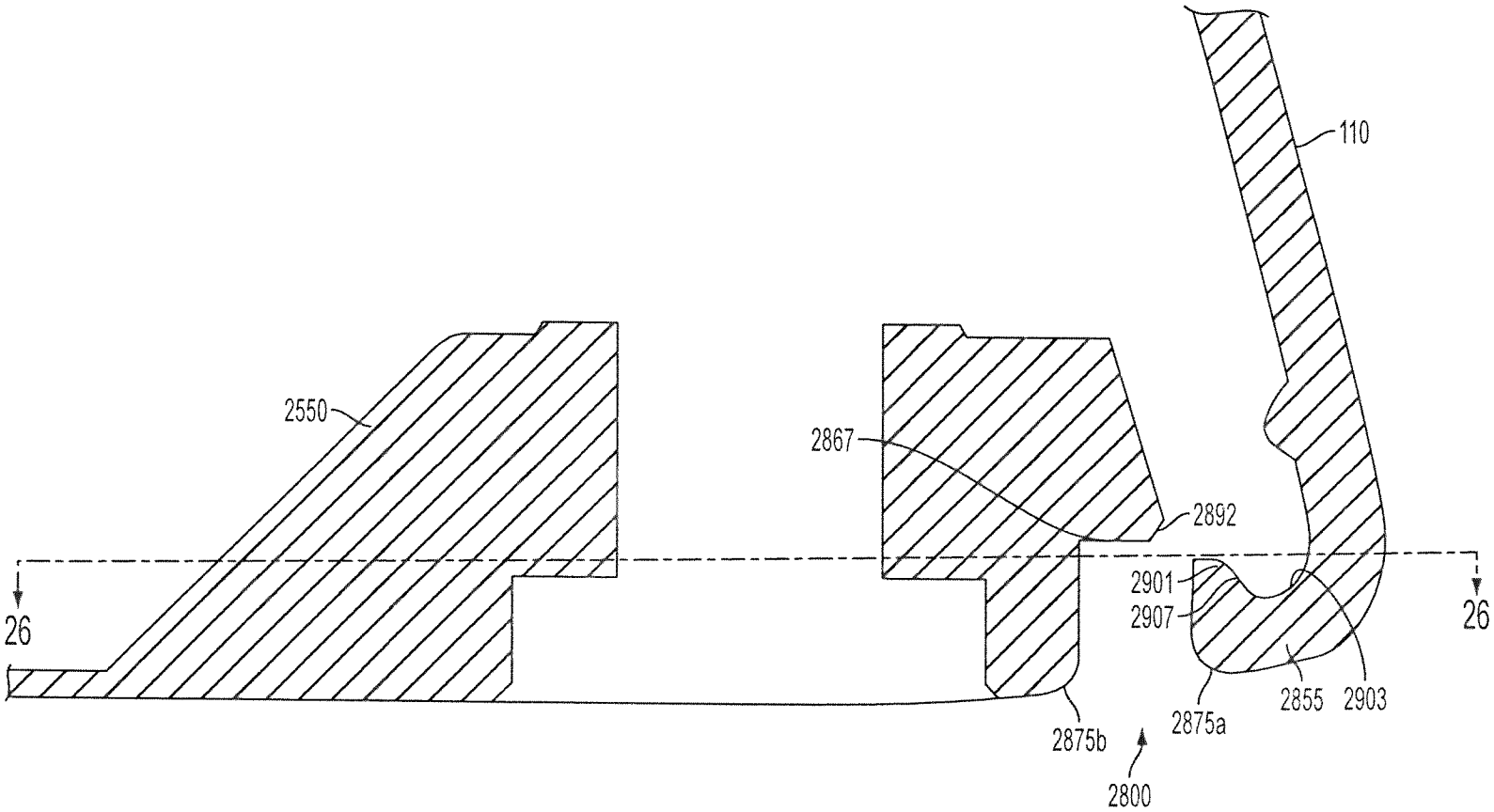
FIG. 24 is a detail view of detail 24 of FIG. 23.

As seen with reference to FIG. 24, the CORF 2800 of the current disclosure includes radiused edges 2875 (shown as 2875*a,b*) in the current embodiment where a bevel 375 may previously have been seen. The weight pad 2550 includes an overhang portion 2867. The overhang portion 2867 includes a chamfered edge 2892. The chamfered edge 2892 may promote flow of plugging material (such as plugging material 801,1301) into the CORF 2800 and may provide additional clearance for added features of the CORF 2800.

In particularly, a first sole portion 2855 includes a stress pad 2901 that is a thickened region or boss extended from the first sole portion 2855 in the direction of the z-axis 206. In use, the CORFs of the current disclosure (300, 800, 1300, 1800, 2300, 2800) experience normal, shear, and multiple torsional when golf club heads of the current disclosure (100, 500, 1000, 1500, 2000, 2500) impact a golf ball. One of skill in the art would understand that the Von Mises stresses in the region of the CORF (300, 800, 1300, 1800, 2300, 2800) can exceed the ultimate stress of the material due to stress concentrations in the geometry of the CORF (300, 800, 1300, 1800, 2300, 2800). As such, stress concentrations in the CORF (300, 800, 1300, 1800, 2300, 2800) may cause failure of the golf club head due to the extremely high Von Mises stresses. To combat such stress concentrations, the embodiment of golf club head 2500 provides some benefit.

In various embodiments, thickening the first sole portion 355 increases the area over which force is applied, thereby reducing stress in the aggregate and reducing the chance of failure of the CORF (300,800,1300,1800,2300,2800). However, it was surprisingly determined that simply thickening the entirety of the first sole portion 355 may reduce COR of the golf club head. As such, the first sole portion 355 was modified to create the first sole portion 2855. The stress pad 2901 provides added thickness of material in the region of the CORF 2800, but the region of the first sole portion 2855 in close proximity to the face 110 remains thinner than the stress pad 2901. It was surprisingly determined that the introduction of the stress pad 2901 reduced stress concentrations without negative effect on COR. In various embodiments, the introduction of the stress pad 2901 doubles the thickness of the first sole portion 2855 in the region of the stress pad 2901. As can be seen, the stress pad 2901 defines a groove 2903 between the face 110 and the stress pad 2901 for at least a portion of the face 110, as will be seen with reference to further figures. In various embodiments, the stress pad 2901 may be straight such that the groove 2903 has straight ends. In the current embodiment, the stress pad 2901 is defined by a curve 2907. The curve 2907 is about the shape of one half of a sine wave. In various embodiments, various shapes of curves 2907 may be used, including round, squared, radiused, chamfered, and various mathematical functions.

Figure 25A:
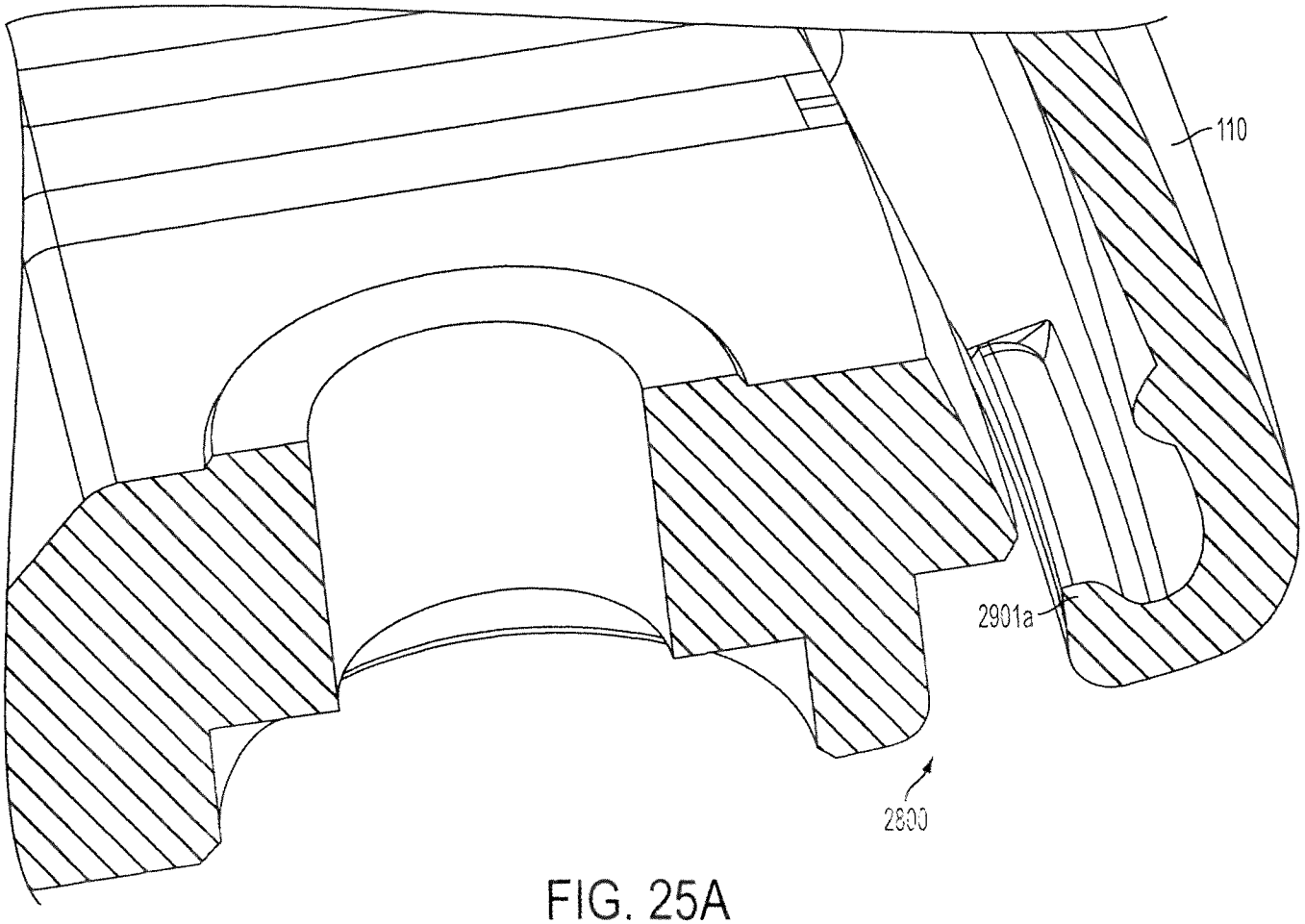
FIG. 25A is a perspective view of detail 24 showing features of one embodiment of a coefficient of restitution feature in accord with one embodiment of the current disclosure.
Figure 25B:
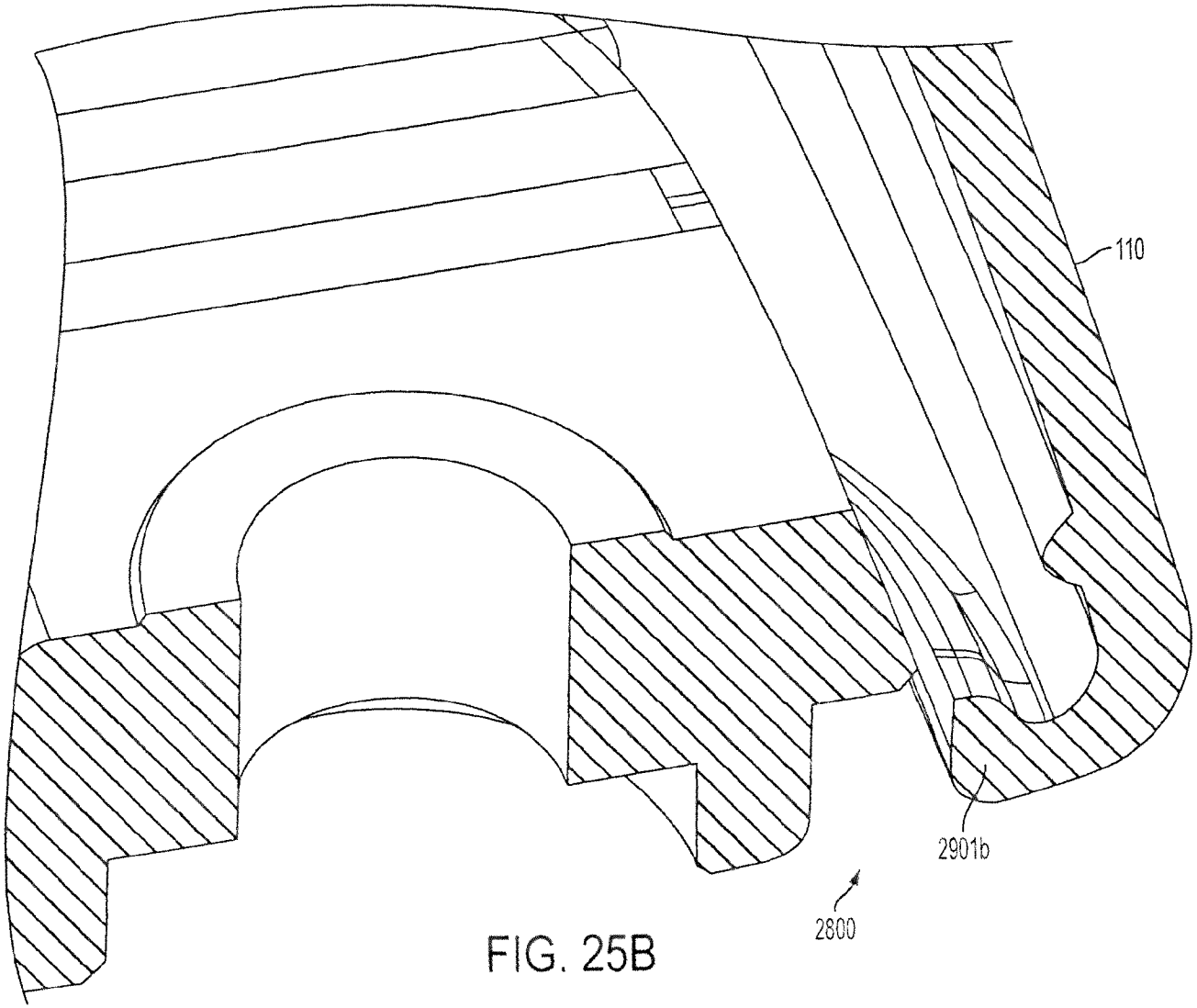
FIG. 25B is a perspective view of detail 24 showing features of one embodiment of a coefficient of restitution feature in accord with one embodiment of the current disclosure.

Various embodiments of the stress pad 2901 are shown in FIGS. 25A and 25B. As seen with reference to FIG. 25A, a stress pad 2901*a* may be of about constant thickness as measured in the direction of the z-axis 206 and follow the contour of the face 110 in the direction of the x-axis 208. The shape of the stress pad 2901*a* may be about constant in the direction of the y-axis 207 as well over its length. A second embodiment of a stress pad 2901*b* is seen with reference to FIG. 25B. Rather than a shape that follows the contour of the face 110, the stress pad 2901*b* tapers. The stress pad 2901*b* decreases in thickness (as measured in the direction of the z-axis 206) as it departs from the face 110. As such, the stress pad 2901*b* is substantially thinner near its ends than proximate CF.

Figure 26A:
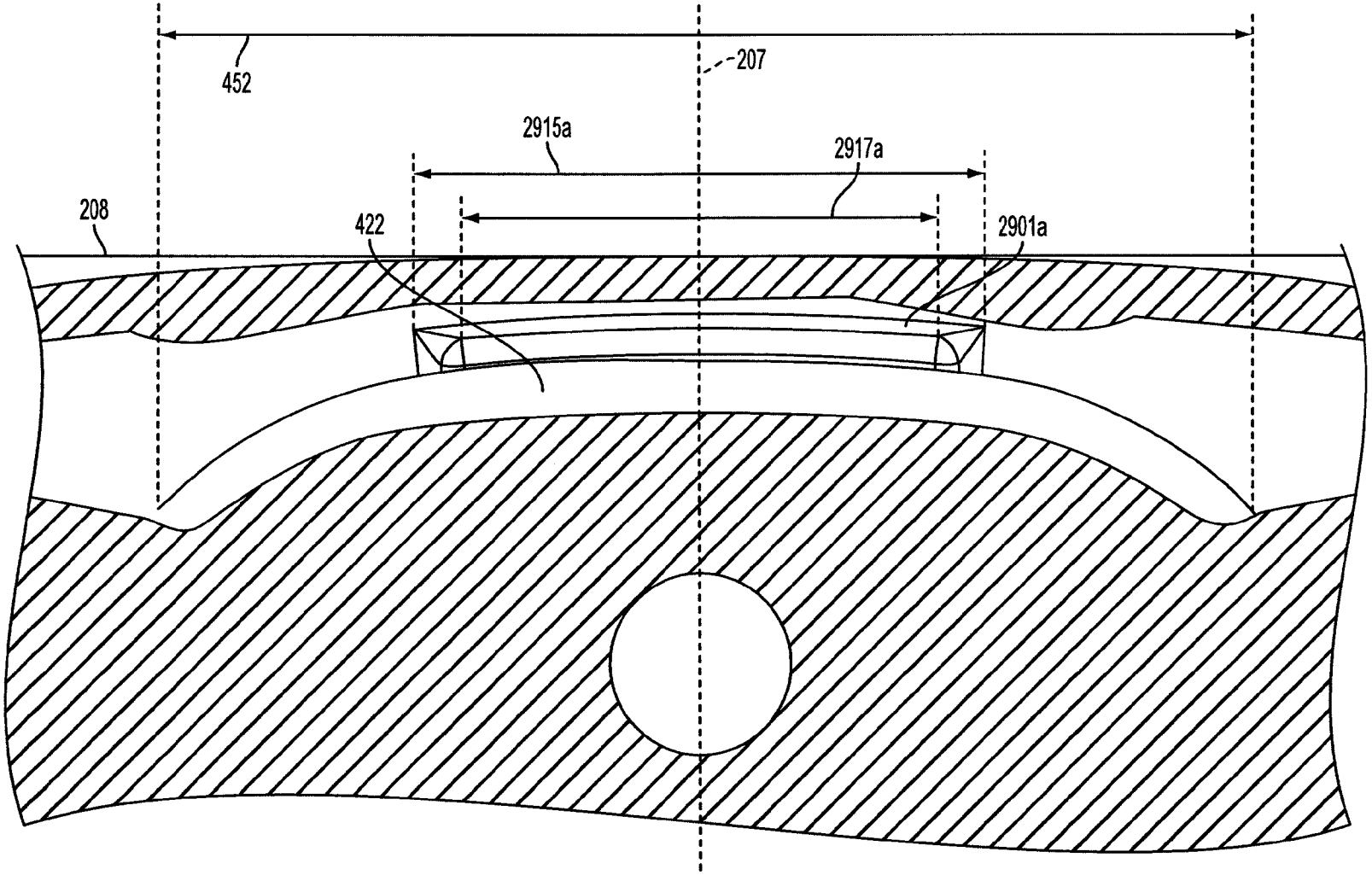
FIG. 26A is a cutaway view of the coefficient of restitution feature of FIG. 25A as would be viewed in the plane indicated by line 26-26 in FIG. 24.
Figure 26B:
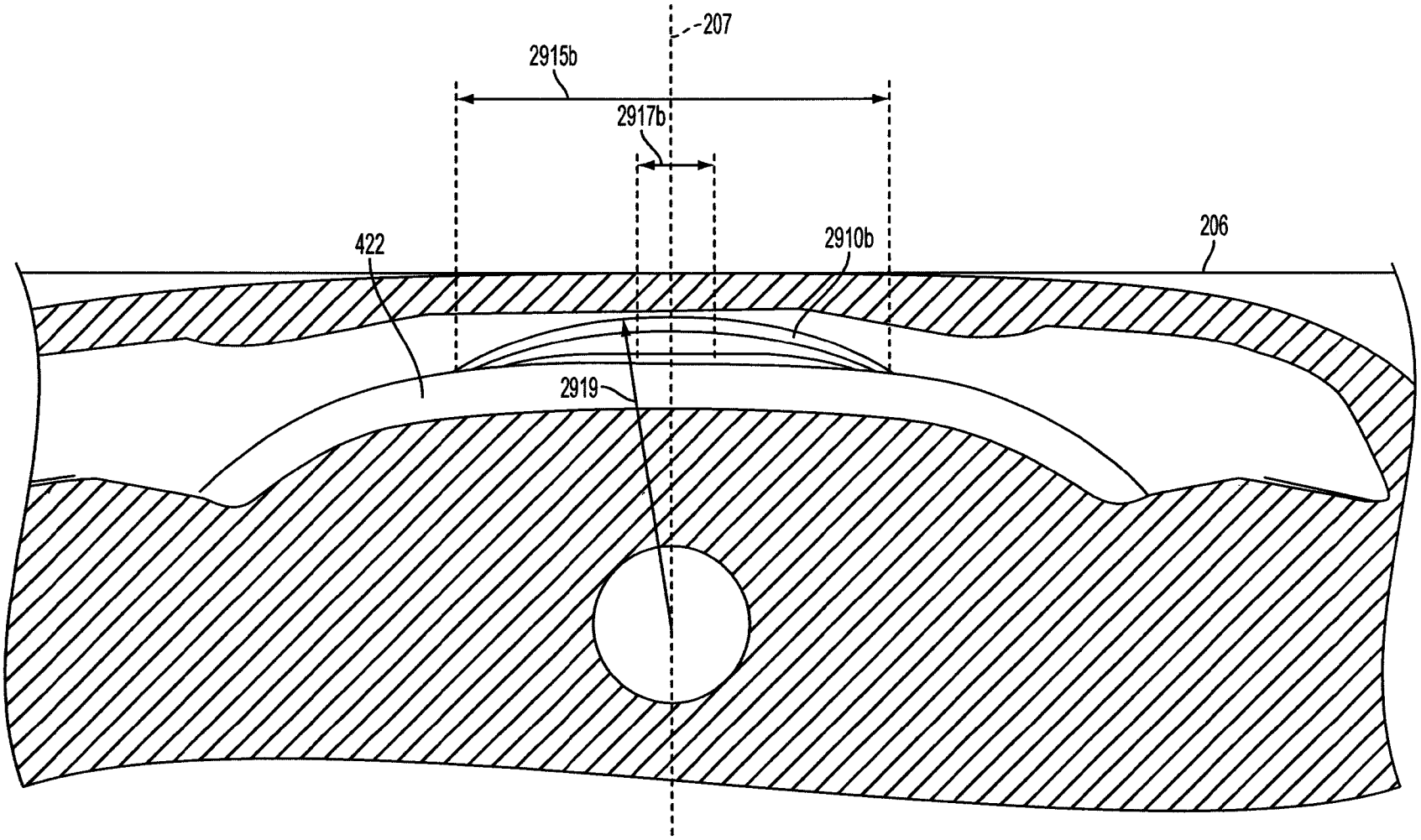
FIG. 26B is a cutaway view of the coefficient of restitution feature of FIG. 25B as would be viewed in the plane indicated by line 26-26 in FIG. 24.

Stress pads 2901*a,b* are also seen with reference to FIGS. 26A and 26B. The stress pad 2901*a* of the current embodiment has a lateral extent 2915*a* that is less than the width of the CORF 2800. In the current embodiment, the lateral extent 2915*a* is less than the width of the central portion 422. In various embodiments, the lateral extent 2915*a* may be larger, smaller, or equal to the width of the central portion 422 or the distance 452. The stress pad 2901*a* also includes a full thickness extent 2917*a* for which the cross-section of the stress pad 2901*a* does not change. As can be seen, the stress pad 2901*b* has a lateral extent 2915*b* that is substantially less than a width of the central portion 422. Additionally, the full thickness extent 2917*b* is substantially smaller than the full thickness extent 2917*a*. The cross-sectional shape of the stress pad 2901*b* changes over its lateral extent 2915*b* such that few cross-sections of the stress pad 2901*b* include the same cross-sectional shape. As can be seen, an outermost edge of the stress pad 2901*b* is defined at a radius 2919. As previously mentioned, the stress pad 2901*b* tapers. The taper of the stress pad 2901*b* is at the radius 2919, which is of about 20-22 mm. In various embodiments, the radius 2919 may be 18-24 mm. In various embodiments, the radius 2919 may be up to 40 mm.

Figure 27:
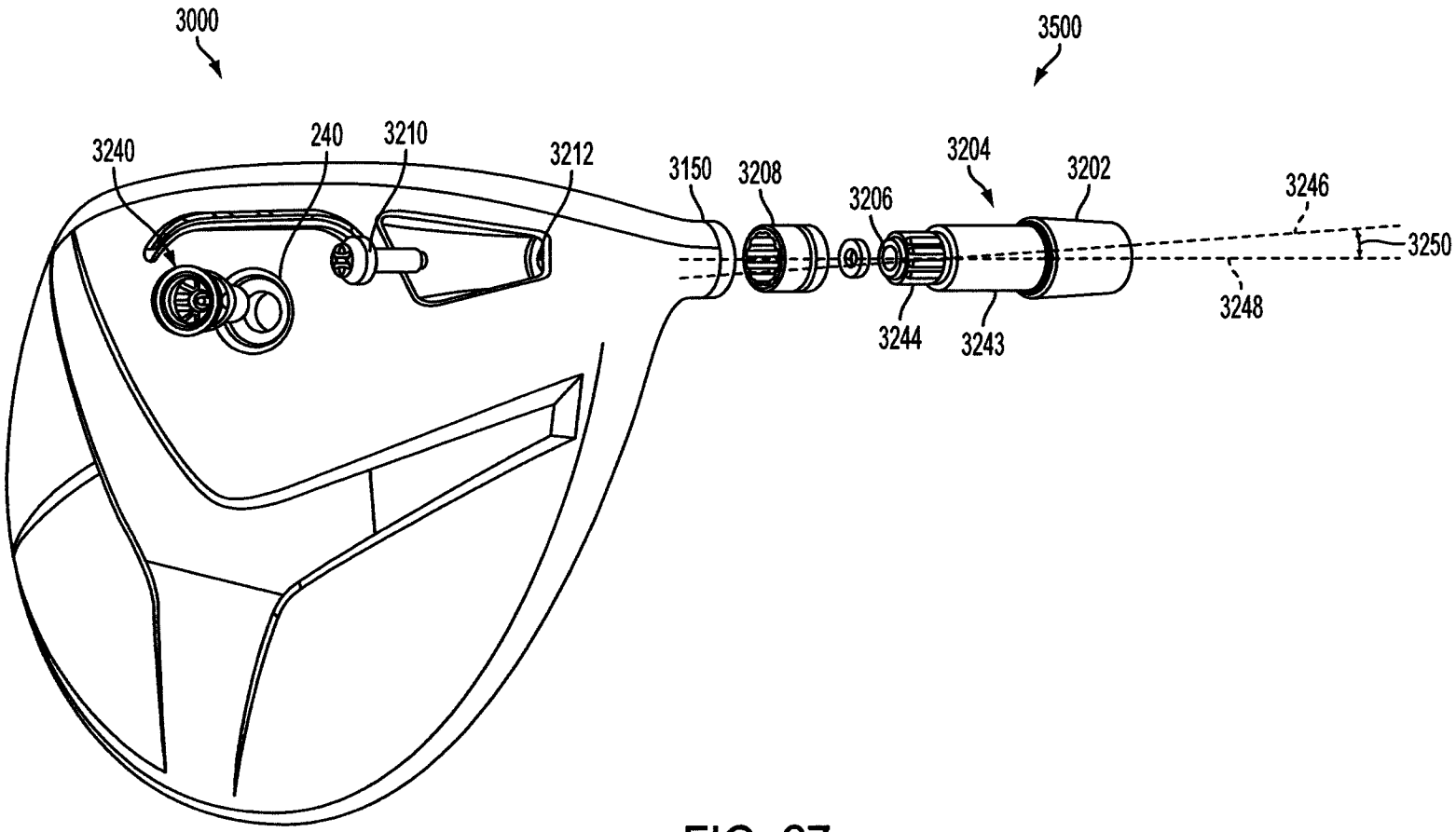
FIG. 27 is a perspective view of a golf club assembly in accord with one embodiment of the current disclosure including a golf club head in accord with one embodiment of the current disclosure.
Figure 28A:
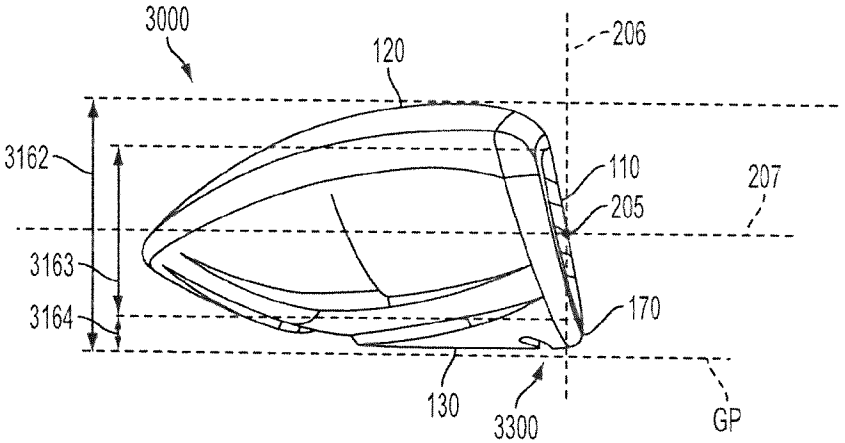
FIG. 28A is a toe side view of a golf club head in accord with one embodiment of the current disclosure.
Figure 28B:
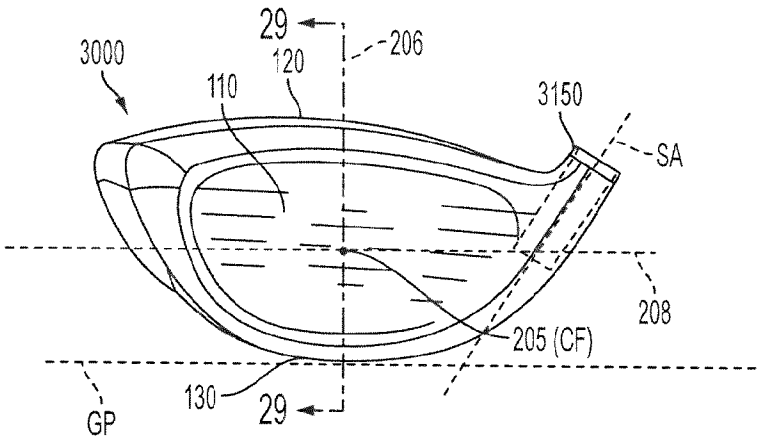
FIG. 28B is a face side view of the golf club head of FIG. 28A.
Figure 28C:
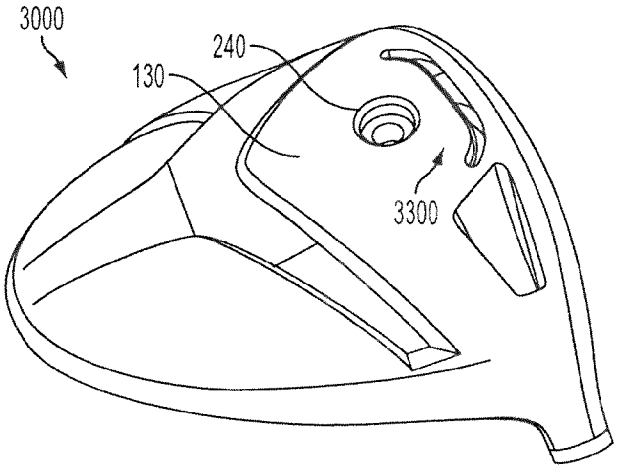
FIG. 28C is a perspective view of the golf club head of FIG. 28A.
Figure 28D:
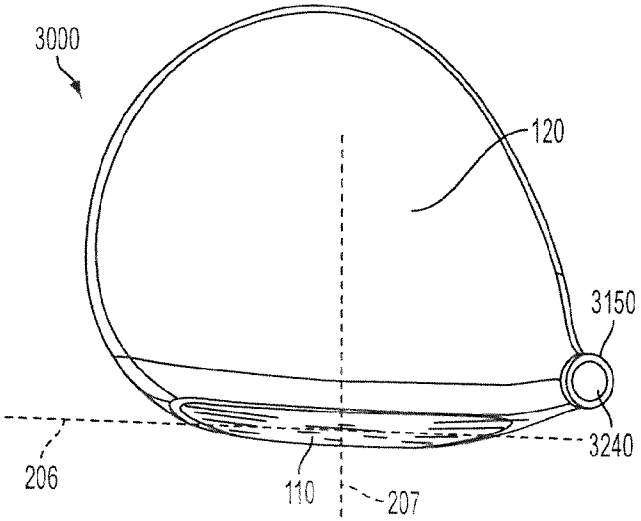
FIG. 28D is a top view of the golf club head of FIG. 28A.

A golf club head 3000 is shown with reference to FIG. 27. The golf club head 3000 is part of a golf club assembly 3500 that includes flight control technology. FIG. 27 illustrates a removable shaft system having a ferrule 3202 having a sleeve bore 3245 (shown in FIG. 28D) within a sleeve 3204. A shaft (not shown) is inserted into the sleeve bore and is mechanically secured or bonded to the sleeve 3204 for assembly into a golf club. The sleeve 3204 further includes an anti-rotation portion 3244 at a distal tip of the sleeve 3204 and a threaded bore 3206 for engagement with a screw 3210 that is inserted into a sole opening 3212 defined in the club head 3000. In one embodiment, the sole opening 3212 is directly adjacent to a sole non-undercut portion. The anti-rotation portion 3244 of the sleeve 3204 engages with an anti-rotation collar 3208 which is bonded or welded within a hosel 3150 of the golf club head 3000. The adjustable loft, lie, and face angle system is described in U.S. patent application Ser. No. 12/687,003 (now U.S. Pat. No. 8,303,431), which is incorporated herein by reference in its entirety. The golf club assembly 3500 includes a weight 3240 for the weight port 240. Although not shown, the shaft and a grip may be included as part of the golf club assembly 3500.

The embodiment shown in FIG. 27 includes an adjustable loft, lie, or face angle system that is capable of adjusting the loft, lie, or face angle either in combination with one another or independently from one another. An adjustable sole piece may be used in combination with the adjustable loft, lie and face angle system as described in detail in U.S. patent application Ser. No. 13/686,677 all of which is incorporated by reference herein it its entirety. For example, a first portion 3243 of the sleeve 3204, the sleeve bore 3242, and the shaft collectively define a longitudinal axis 3246 of the assembly. The sleeve 3204 is effective to support the shaft along the longitudinal axis 3246, which is offset from a longitudinal axis 3248 of the by offset angle 3250. The longitudinal axis 3248 is intended to align with the SA (seen in FIG. 28B). The sleeve 3204 can provide a single offset angle 3250 that can be between 0 degrees and 4 degrees, in 0.25 degree increments. For example, the offset angle can be 1.0 degree, 1.25 degrees, 1.5 degrees, 1.75 degrees, 2.0 degrees or 2.25 degrees. The sleeve 3204 can be rotated to provide various adjustments to the golf club assembly 3500 as described in U.S. patent application Ser. No. 12/687,003 (now U.S. Pat.

No. 8,303,431). One of skill in the art would understand that the system described with respect to the current golf club assembly 3500 can be implemented with various embodiments of the golf club heads of the current disclosure.

As seen with reference to FIGS. 28A-28D, the golf club head 3000 includes CORF 3300. In various embodiments, the golf club head 3000 is a driver type golf club head. As compared to prior embodiments of the current disclosure, the golf club head 3000 has a crown height 3162 that is larger than prior embodiments. In the current embodiment, the crown height 3162 is about 62 mm. In various embodiments, the crown height 3162 may be 55-70 mm. In various embodiments, the crown height 3162 may be 45-75 mm. The face 110 includes an effective face height 3163 of about 52 mm. In various embodiments, the effective face height 3162 may be 47-57 mm. In various embodiments, the effective face height 3162 may be 45-60 mm. An effective face position height 3164 of the golf club head 3000 is about 4.5 mm. In various embodiments, the effective face position height 3164 may be 3-7 mm. In various embodiments, the effective face position height 3164 may be up to 12.5 mm.

Figure 29:
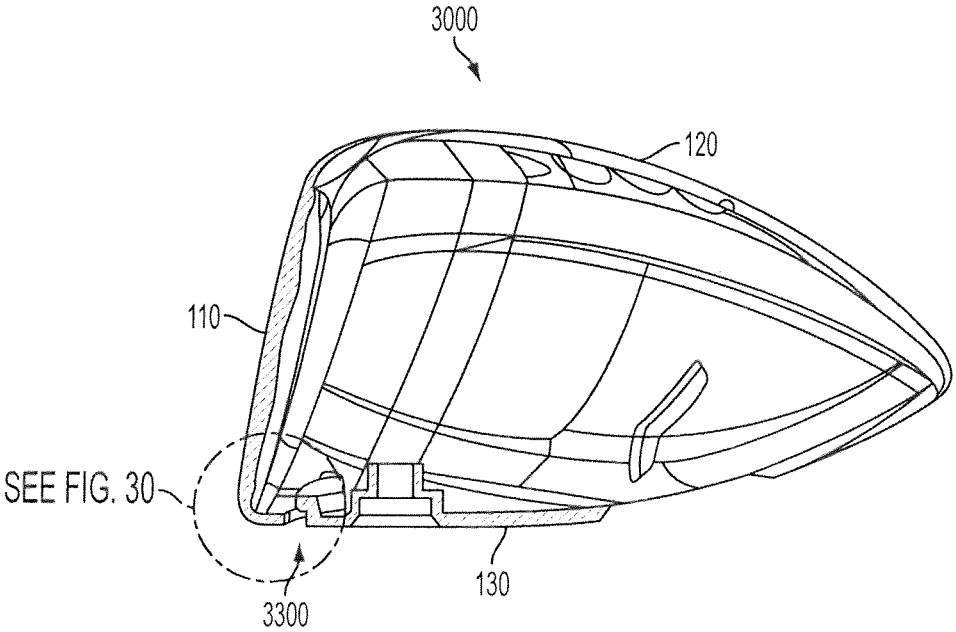
FIG. 29 is a cross-sectional view of the golf club head taken in the plane indicated by line 29-29 of FIG. 28B.
Figure 30:
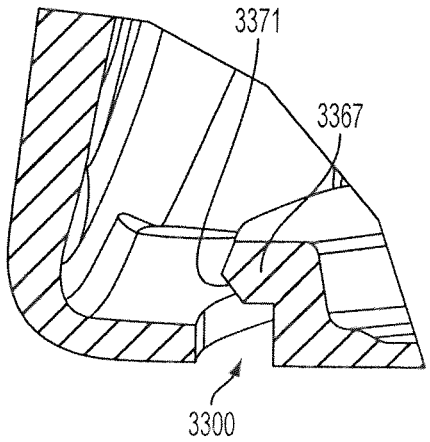
FIG. 30 is a detail view of detail 30 of FIG. 29.

As seen with reference to FIGS. 29 and 30, the golf club head 3000 of the current embodiment does not include a weight pad proximate the sole. Because the golf club head 3000 of the current embodiment is a driver type golf club head, weight is sought to be reduced to a minimum amount, and volume is sought to be maximized. As such, the golf club head 3000 of the current embodiment includes the CORF 3300 without weight relocation. In various embodiments, the golf club head 3000 may include various weight relocation mechanisms. The CORF 3300 includes an overhang portion 3367 that includes a chamfer 3371. The CORF 3300 does not include a bevel, a radius, or a chamfer. The size of various features proximate the CORF 3300 is reduced as compared to prior embodiments. One of skill in the art would understand that various portions of the disclosure may be interchanged, and CORF 3300 may be included with prior embodiments in various embodiments of the disclosure. Additionally, various features of various embodiments of the disclosure may be used with golf club head 3000. No one feature should be considered limiting on any particular embodiment, and one of skill in the art would understand that the various features, advantages, and elements of the various embodiments can be relocated, reconfigured, or combined as necessary to achieve the various design goals cited herein.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A golf club head comprising: a crown, a sole, a skirt and a face, the face including a geometric center defining a center face location, the head having a center of gravity, wherein a reference tangent face plane is defined as a plane tangent to the face at the center face location, wherein the center of gravity defines a projection orthogonal to the tangent face plane and passing through the center of gravity such that a projection point is defined at the intersection of the projection and the tangent face plane, wherein a reference ground plane is defined along a bottom end of the body, the ground plane thereby being below the golf club head, and wherein the projection point is below the center face location;

a body, wherein the golf club head defines an exterior and an interior that is bounded by the crown, the sole, the skirt and the face;

the face and the body together defining a center of gravity, the center of gravity being proximate the face;

a coefficient of restitution feature (CORF) defined in the sole of the golf club head;

wherein the coefficient of restitution feature defines a gap in the body in the form of a through slot providing a port from the exterior of the golf club head to the interior such that the interior of the golf club head is not separated from the exterior at the CORF, the golf club head further comprising a weight pad located proximate to the CORF, the weight pad having a weight that is 35 to 50 percent of a total weight of the golf club head.

2. The golf club of claim 1 wherein the weight pad has a length along the y-axis of 12 to 32 mm or 45 to 62 mm.

3. The golf club of claim 1, wherein the golf club head defines a crown height, the crown height being the largest dimension of the golf club head as measured from the ground plane to an outer surface of the crown, the crown height being at least 30 mm and up to 50 mm.

4. The golf club head of claim 1, wherein at least a portion of the weight pad overhangs the coefficient of restitution feature.

5. The golf club head of claim 1, wherein the weight pad has a width of at least about 60 mm.

6. The golf club head of claim 1, the face including a geometric center defining a center face location, wherein a reference tangent face plane is defined as a plane tangent to the face at the center face location, and wherein the center of gravity is no more than about 19.5 mm from the tangent face plane as measured orthogonally to the tangent face plane.

7. The golf club head of claim 1, wherein the weight pad is proximate the sole.

8. The golf club head of claim 7, wherein the weight pad is proximate the face.

9. The golf club head of claim 8, wherein at least a portion of the weight pad overhangs the coefficient of restitution feature.

10. The golf club head of claim 1, wherein the coefficient of restitution feature includes a beveled edge.

11. The golf club head of claim 1, wherein the coefficient of restitution feature includes a retention feature.

* * * * *